US009562395B2

(12) United States Patent
Grubb et al.

(10) Patent No.: US 9,562,395 B2
(45) Date of Patent: Feb. 7, 2017

(54) HIGH POWER LASER-MECHANICAL DRILLING BIT AND METHODS OF USE

(75) Inventors: Daryl L. Grubb, Houston, TX (US); Sharath K. Kolachalam, Highlands Ranch, CO (US); Brian O. Faircloth, Evergreen, CO (US); Charles C. Rinzler, Denver, CO (US); Erik C. Allen, Minneapolis, MN (US); Lance D. Underwood, Morrison, CO (US); Mark S. Zediker, Castle Rock, CO (US)

(73) Assignee: FORO ENERGY, INC., Houston, TX (US)

( * ) Notice: Subject to any disclaimer, the term of this patent is extended or adjusted under 35 U.S.C. 154(b) by 1042 days.

(21) Appl. No.: 13/403,615

(22) Filed: Feb. 23, 2012

(65) Prior Publication Data

US 2012/0255774 A1 Oct. 11, 2012

Related U.S. Application Data

(63) Continuation-in-part of application No. 12/544,038, filed on Aug. 19, 2009, now Pat. No. 8,820,434, and a continuation-in-part of application No. 12/543,968, filed on Aug. 19, 2009, now Pat. No. 8,636,085, and a continuation-in-part of application No. 12/543,986, filed on Aug. 19, 2009, now Pat. No. 8,826,973.

(60) Provisional application No. 61/446,043, filed on Feb. 24, 2011, provisional application No. 61/446,312, filed on Feb. 24, 2011, provisional application No. 61/446,040, filed on Feb. 24, 2011, provisional application No. 61/446,041, filed on Feb. 24, 2011, provisional application No. 61/446,042, filed on Feb.

(Continued)

(51) Int. Cl.
*E21B 7/14* (2006.01)
*E21B 10/60* (2006.01)

(52) U.S. Cl.
CPC *E21B 7/14* (2013.01); *E21B 10/60* (2013.01)

(58) Field of Classification Search
CPC ..... E21B 10/42; E21B 7/00; E21B 7/14; E21B 17/146; E21B 7/15; E21B 10/00; B23K 26/38; B23K 26/381; B23K 26/40; B23K 26/0626
See application file for complete search history.

(56) References Cited

U.S. PATENT DOCUMENTS 914,636 A 3/1909 Case
2,548,463 A 4/1951 Blood
(Continued)

FOREIGN PATENT DOCUMENTS

EP 0 295 045 A2 12/1988
EP 0 515 983 A1 12/1992
(Continued)

OTHER PUBLICATIONS

U.S. Appl. No. 12/543,986, filed Aug. 19, 2009, Moxley et al.
(Continued)

*Primary Examiner* — Elizabeth Gitlin
(74) *Attorney, Agent, or Firm* — Glen P. Belvis; Steptoe & Johnson, LLP.

(57) ABSTRACT

An apparatus with a high power laser-mechanical bit for use with a laser drilling system and a method for advancing a borehole. The laser-mechanical bit has a beam path and mechanical removal devices that provide for the removal of laser-affected rock to advance a borehole.

52 Claims, 25 Drawing Sheets

Related U.S. Application Data

24, 2011, provisional application No. 61/153,271, filed on Feb. 17, 2009, provisional application No. 61/106,472, filed on Oct. 17, 2008, provisional application No. 61/102,730, filed on Oct. 3, 2008, provisional application No. 61/090,384, filed on Aug. 20, 2008, provisional application No. 61/153,271, filed on Feb. 17, 2009, provisional application No. 61/106,472, filed on Oct. 17, 2008, provisional application No. 61/102,730, filed on Oct. 3, 2008, provisional application No. 61/090,384, filed on Aug. 20, 2008.

(56) References Cited

U.S. PATENT DOCUMENTS 2,742,555 A 4/1956 Murray
3,122,212 A 2/1964 Karlovitz
3,383,491 A 5/1968 Muncheryan
3,461,964 A 8/1969 Venghiattis
3,493,060 A 2/1970 Van Dyk
3,503,804 A 3/1970 Schneider et al.
3,539,221 A 11/1970 Gladstone
3,544,165 A 12/1970 Snedden
3,556,600 A 1/1971 Shoupp et al.
3,574,357 A 4/1971 Alexandru et al.
3,586,413 A 6/1971 Adams
3,652,447 A 3/1972 Yant
3,693,718 A 9/1972 Stout
3,699,649 A 10/1972 McWilliams
3,802,203 A 4/1974 Ichise et al.
3,820,605 A 6/1974 Barber et al.
3,821,510 A 6/1974 Muncheryan
3,823,788 A 7/1974 Garrison et al.
3,871,485 A 3/1975 Keenan, Jr.
3,882,945 A 5/1975 Keenan, Jr.
3,938,599 A 2/1976 Horn
3,960,448 A 6/1976 Schmidt et al.
3,977,478 A 8/1976 Shuck
3,992,095 A 11/1976 Jacoby et al.
3,998,281 A 12/1976 Salisbury et al.
4,019,331 A 4/1977 Rom et al.
4,025,091 A 5/1977 Zeile, Jr.
4,026,356 A 5/1977 Shuck
4,047,580 A 9/1977 Yahiro et al.
4,057,118 A 11/1977 Ford
4,061,190 A 12/1977 Bloomfield
4,066,138 A 1/1978 Salisbury et al.
4,090,572 A 5/1978 Welch
4,113,036 A 9/1978 Stout
4,125,757 A 11/1978 Ross
4,151,393 A 4/1979 Fenneman et al.
4,162,400 A 7/1979 Pitts, Jr.
4,189,705 A 2/1980 Pitts, Jr.
4,194,536 A 3/1980 Stine et al.
4,199,034 A 4/1980 Salisbury et al.
4,227,582 A 10/1980 Price
4,228,856 A 10/1980 Reale
4,243,298 A 1/1981 Kao et al.
4,249,925 A 2/1981 Kawashima et al.
4,252,015 A 2/1981 Harbon et al.
4,256,146 A 3/1981 Genini et al.
4,266,609 A 5/1981 Rom et al.
4,280,535 A 7/1981 Willis
4,281,891 A 8/1981 Shinohara et al.
4,282,940 A 8/1981 Salisbury et al.
4,332,401 A 6/1982 Stephenson et al.
4,336,415 A 6/1982 Walling
4,340,245 A 7/1982 Stalder
4,367,917 A 1/1983 Gray
4,370,886 A 2/1983 Smith, Jr. et al.
4,374,530 A 2/1983 Walling
4,375,164 A 3/1983 Dodge et al.
4,389,645 A 6/1983 Wharton
4,415,184 A 11/1983 Stephenson et al.
4,417,603 A 11/1983 Argy
4,436,177 A 3/1984 Elliston
4,444,420 A 4/1984 McStravick et al.
4,453,570 A 6/1984 Hutchison
4,459,731 A 7/1984 Hutchison
4,477,106 A 10/1984 Hutchison
4,504,112 A 3/1985 Gould et al.
4,522,464 A 6/1985 Thompson et al.
4,531,552 A 7/1985 Kim
4,565,351 A 1/1986 Conti et al.
4,662,437 A 5/1987 Renfro
4,694,865 A 9/1987 Tauschmann
4,725,116 A 2/1988 Spencer et al.
4,741,405 A 5/1988 Moeny et al.
4,744,420 A 5/1988 Patterson et al.
4,770,493 A 9/1988 Ara et al.
4,793,383 A 12/1988 Gyory et al.
4,830,113 A 5/1989 Geyer
4,860,654 A 8/1989 Chawla et al.
4,860,655 A 8/1989 Chawla
4,872,520 A 10/1989 Nelson
4,896,944 A * 1/1990 Irwin et al. ..... 359/813
4,924,870 A 5/1990 Wlodarczyk et al.
4,952,771 A 8/1990 Wrobel
4,989,236 A 1/1991 Myllymäki
4,997,250 A 3/1991 Ortiz, Jr.
5,003,144 A 3/1991 Lindroth et al.
5,004,166 A 4/1991 Sellar
5,033,545 A 7/1991 Sudol
5,049,738 A 9/1991 Gergely et al.
5,084,617 A 1/1992 Gergely
5,086,842 A 2/1992 Cholet
5,107,936 A 4/1992 Foppe
5,121,872 A 6/1992 Legget
5,125,061 A 6/1992 Marlier et al.
5,125,063 A 6/1992 Panuska et al.
5,128,882 A 7/1992 Cooper et al.
5,140,664 A 8/1992 Bosisio et al.
5,163,321 A 11/1992 Perales
5,168,940 A 12/1992 Foppe
5,172,112 A 12/1992 Jennings
5,212,755 A 5/1993 Holmberg
5,220,149 A * 6/1993 Neidhardt ..... 219/121.67
5,269,377 A 12/1993 Martin
5,285,204 A 2/1994 Sas-Jaworsky
5,348,097 A 9/1994 Giannesini et al.
5,351,533 A 10/1994 Macadam et al.
5,353,875 A 10/1994 Schultz et al.
5,355,967 A 10/1994 Mueller et al.
5,356,081 A 10/1994 Sellar
5,396,805 A 3/1995 Surjaatmadja
5,411,081 A 5/1995 Moore et al.
5,411,085 A 5/1995 Moore et al.
5,411,105 A 5/1995 Gray
5,413,045 A 5/1995 Miszewski
5,413,170 A 5/1995 Moore
5,419,188 A 5/1995 Rademaker et al.
5,423,383 A 6/1995 Pringle
5,425,420 A 6/1995 Pringle
5,435,351 A 7/1995 Head
5,435,395 A 7/1995 Connell
5,463,711 A 10/1995 Chu
5,465,793 A 11/1995 Pringle
5,469,878 A 11/1995 Pringle
5,479,860 A 1/1996 Ellis
5,483,988 A 1/1996 Pringle
5,488,992 A 2/1996 Pringle
5,500,768 A 3/1996 Doggett et al.
5,503,014 A 4/1996 Griffith
5,503,370 A 4/1996 Newman et al.
5,505,259 A 4/1996 Wittrisch et al.
5,515,926 A 5/1996 Boychuk
5,526,887 A 6/1996 Vestavik
5,561,516 A 10/1996 Noble et al.
5,566,764 A 10/1996 Elliston
5,573,225 A 11/1996 Boyle et al.
5,577,560 A 11/1996 Coronado et al.
5,586,609 A 12/1996 Schuh
5,599,004 A 2/1997 Newman et al.

(56) References Cited

U.S. PATENT DOCUMENTS 5,615,052 A 3/1997 Doggett
5,638,904 A 6/1997 Misselbrook et al.
5,655,745 A 8/1997 Morrill
5,694,408 A 12/1997 Bott et al.
5,707,939 A 1/1998 Patel
5,757,484 A 5/1998 Miles et al.
5,759,859 A 6/1998 Sausa
5,771,984 A 6/1998 Potter et al.
5,773,791 A 6/1998 Kuykendal
5,794,703 A 8/1998 Newman et al.
5,813,465 A 9/1998 Terrell et al.
5,828,003 A 10/1998 Thomeer et al.
5,832,006 A 11/1998 Rice et al.
5,833,003 A 11/1998 Longbottom et al.
5,847,825 A 12/1998 Alexander
5,862,273 A 1/1999 Pelletier
5,862,862 A 1/1999 Terrell
5,896,482 A 4/1999 Blee et al.
5,896,938 A 4/1999 Moeny et al.
5,902,499 A 5/1999 Richerzhagen
5,909,306 A 6/1999 Goldberg et al.
5,913,337 A 6/1999 Williams et al.
5,924,489 A 7/1999 Hatcher
5,929,986 A 7/1999 Slater et al.
5,933,945 A 8/1999 Thomeer et al.
5,938,954 A 8/1999 Onuma et al.
5,973,783 A 10/1999 Goldner et al.
5,986,756 A 11/1999 Slater et al.
RE36,525 E 1/2000 Pringle
6,015,015 A 1/2000 Luft et al.
6,038,363 A 3/2000 Slater et al.
6,059,037 A 5/2000 Longbottom et al.
6,060,662 A 5/2000 Rafie et al.
6,065,540 A 5/2000 Thomeer et al.
RE36,723 E 6/2000 Moore et al.
6,076,602 A 6/2000 Gano et al.
6,092,601 A 7/2000 Gano et al.
6,104,022 A 8/2000 Young et al.
RE36,880 E 9/2000 Pringle
6,116,344 A 9/2000 Longbottom et al.
6,135,206 A 10/2000 Gano et al.
6,147,754 A 11/2000 Theriault et al.
6,157,893 A 12/2000 Berger et al.
6,166,546 A 12/2000 Scheihing et al.
6,215,734 B1 4/2001 Moeny et al.
6,227,300 B1 5/2001 Cunningham et al.
6,250,391 B1 6/2001 Proudfoot
6,273,193 B1 8/2001 Hermann et al.
6,275,645 B1 8/2001 Vereecken et al.
6,281,489 B1 8/2001 Tubel et al.
6,301,423 B1 10/2001 Olson
6,309,195 B1 10/2001 Bottos et al.
6,321,839 B1 11/2001 Vereecken et al.
6,352,114 B1 3/2002 Toalson et al.
6,355,928 B1 3/2002 Skinner et al.
6,356,683 B1 3/2002 Hu et al.
6,377,591 B1 4/2002 Hollister et al.
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,494,259 B2 12/2002 Surjaatmadja
6,497,290 B1 12/2002 Misselbrook et al.
6,557,249 B1 5/2003 Pruett et al.
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,661,815 B1 12/2003 Kozlovsky et al.
6,710,720 B2 3/2004 Carstensen et al.
6,712,150 B1 3/2004 Misselbrook et al.
6,725,924 B2 4/2004 Davidson et al.
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,923,273 B2 8/2005 Terry et al.
6,957,576 B2 10/2005 Skinner et al.
6,967,322 B2 11/2005 Jones et al.
6,977,367 B2 12/2005 Tubel et al.
6,978,832 B2 12/2005 Gardner et al.
6,981,561 B2 1/2006 Krueger et al.
6,994,162 B2 2/2006 Robison
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,484 B2 8/2006 Smith, Jr.
7,087,865 B2 8/2006 Lerner
7,088,437 B2 8/2006 Blomster et al.
7,126,332 B2 10/2006 Blanz et al.
7,134,488 B2 11/2006 Tudor et al.
7,134,514 B2 11/2006 Riel et al.
7,140,435 B2 11/2006 Defretin et al.
7,147,064 B2 12/2006 Batarseh et al.
7,152,700 B2 12/2006 Church et al.
7,163,875 B2 1/2007 Richerzhagen
7,172,026 B2 2/2007 Misselbrook
7,172,038 B2 2/2007 Terry et al.
7,174,067 B2 2/2007 Murshid et al.
7,188,687 B2 3/2007 Rudd et al.
7,195,731 B2 3/2007 Jones
7,196,786 B2 3/2007 DiFoggio
7,199,869 B2 4/2007 MacDougall
7,201,222 B2 4/2007 Kanady et al.
7,210,343 B2 5/2007 Shammai et al.
7,212,283 B2 5/2007 Hother et al.
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 2/2008 Smith, Jr.
7,337,660 B2 3/2008 Ibrahim et al.
7,362,422 B2 4/2008 DiFoggio et al.
7,372,230 B2 5/2008 McKay
7,394,064 B2 7/2008 Marsh
7,395,696 B2 7/2008 Bissonnette et al.
7,416,032 B2 * 8/2008 Moeny et al. ..... 175/16
7,416,258 B2 8/2008 Reed et al.
7,424,190 B2 9/2008 Dowd et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,515,782 B2 4/2009 Zhang et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 de Montmorillon et al.
7,600,564 B2 10/2009 Shampine et al.
7,603,011 B2 10/2009 Varkey et al.
7,617,873 B2 11/2009 Lovell et al.
7,624,743 B2 12/2009 Sarkar et al.
7,628,227 B2 12/2009 Marsh

(56) References Cited

U.S. PATENT DOCUMENTS 7,646,953 B2 1/2010 Dowd et al.
7,647,948 B2 1/2010 Quigley et al.
7,671,983 B2 3/2010 Shammai et al.
7,715,664 B1 5/2010 Shou et al.
7,720,323 B2 5/2010 Yamate et al.
7,769,260 B2 8/2010 Hansen et al.
7,802,384 B2 9/2010 Kobayashi et al.
7,834,777 B2 11/2010 Gold
7,848,368 B2 12/2010 Gapontsev et al.
7,900,699 B2 3/2011 Ramos et al.
7,938,175 B2 5/2011 Skinner et al.
8,011,454 B2 9/2011 Castillo
8,074,332 B2 12/2011 Keatch et al.
8,082,996 B2 12/2011 Kocis et al.
8,091,638 B2 1/2012 Dusterhoft et al.
8,109,345 B2 2/2012 Jeffryes
8,175,433 B2 5/2012 Caldwell et al.
2002/0007945 A1 1/2002 Neuroth et al.
2002/0039465 A1 4/2002 Skinner
2002/0189806 A1 12/2002 Davidson et al.
2003/0000741 A1 1/2003 Rosa
2003/0053783 A1 3/2003 Shirasaki
2003/0056990 A1 3/2003 Oglesby
2003/0085040 A1 5/2003 Hemphill et al.
2003/0094281 A1 5/2003 Tubel
2003/0132029 A1 7/2003 Parker
2003/0145991 A1 8/2003 Olsen
2003/0159283 A1 8/2003 White
2003/0160164 A1 8/2003 Jones et al.
2003/0226826 A1* 12/2003 Kobayashi et al. ..... 219/121.7
2004/0006429 A1 1/2004 Brown
2004/0016295 A1 1/2004 Skinner et al.
2004/0020643 A1 2/2004 Thomeer et al.
2004/0026382 A1 2/2004 Richerzhagen
2004/0033017 A1 2/2004 Kringlebotn et al.
2004/0074979 A1 4/2004 McGuire
2004/0093950 A1 5/2004 Bohnert
2004/0112642 A1 6/2004 Krueger et al.
2004/0119471 A1 6/2004 Blanz et al.
2004/0129418 A1 7/2004 Jee et al.
2004/0195003 A1* 10/2004 Batarseh ..... 175/16
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0007583 A1 1/2005 DiFoggio
2005/0012244 A1 1/2005 Jones
2005/0034857 A1 2/2005 Defretin et al.
2005/0094129 A1 5/2005 MacDougall
2005/0099618 A1 5/2005 DiFoggio et al.
2005/0115741 A1 6/2005 Terry et al.
2005/0121235 A1 6/2005 Larsen et al.
2005/0189146 A1 9/2005 Oglesby
2005/0201652 A1 9/2005 Ellwood, Jr.
2005/0230107 A1 10/2005 McDaniel et al.
2005/0252286 A1 11/2005 Ibrahim et al.
2005/0263281 A1 12/2005 Lovell et al.
2005/0268704 A1 12/2005 Bissonnette et al.
2005/0269132 A1* 12/2005 Batarseh et al. ..... 175/40
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0049345 A1 3/2006 Rao et al.
2006/0065815 A1 3/2006 Jurca
2006/0070770 A1 4/2006 Marsh
2006/0102343 A1 5/2006 Skinner et al.
2006/0118303 A1 6/2006 Schultz et al.
2006/0137875 A1 6/2006 Dusterhoft et al.
2006/0185843 A1 8/2006 Smith, Jr.
2006/0191684 A1 8/2006 Smith, Jr.
2006/0204188 A1 9/2006 Clarkson et al.
2006/0207799 A1 9/2006 Yu
2006/0231257 A1 10/2006 Reed et al.
2006/0237233 A1 10/2006 Reed et al.
2006/0260832 A1 11/2006 McKay
2006/0266522 A1 11/2006 Eoff et al.
2006/0283592 A1 12/2006 Sierra et al.
2006/0289724 A1 12/2006 Skinner et al.
2007/0034409 A1 2/2007 Dale et al.
2007/0081157 A1 4/2007 Csutak et al.
2007/0125163 A1 6/2007 Dria et al.
2007/0193990 A1 8/2007 Richerzhagen et al.
2007/0217736 A1 9/2007 Zhang et al.
2007/0227741 A1 10/2007 Lovell et al.
2007/0242265 A1 10/2007 Vessereau et al.
2007/0247701 A1 10/2007 Akasaka et al.
2007/0267220 A1 11/2007 Magiawala et al.
2007/0278195 A1 12/2007 Richerzhagen et al.
2007/0280615 A1 12/2007 de Montmorillon et al.
2008/0023202 A1 1/2008 Keatch et al.
2008/0053702 A1 3/2008 Smith, Jr.
2008/0073077 A1 3/2008 Tunc et al.
2008/0093125 A1 4/2008 Potter et al.
2008/0112760 A1 5/2008 Curlett
2008/0128123 A1 6/2008 Gold
2008/0138022 A1 6/2008 Tassone
2008/0165356 A1 7/2008 DiFoggio et al.
2008/0166132 A1 7/2008 Lynde et al.
2008/0180787 A1 7/2008 DiGiovanni et al.
2008/0245568 A1* 10/2008 Jeffryes ..... 175/16
2008/0273852 A1 11/2008 Parker et al.
2009/0020333 A1 1/2009 Marsh
2009/0031870 A1 2/2009 O'Connor
2009/0033176 A1 2/2009 Huang et al.
2009/0049345 A1 2/2009 Mock et al.
2009/0050371 A1 2/2009 Moeny
2009/0078467 A1 3/2009 Castillo
2009/0105955 A1 4/2009 Castillo et al.
2009/0126235 A1 5/2009 Kobayashi et al.
2009/0133871 A1 5/2009 Skinner et al.
2009/0133929 A1 5/2009 Rodland
2009/0139768 A1 6/2009 Castillo
2009/0166042 A1 7/2009 Skinner
2009/0190887 A1 7/2009 Freeland et al.
2009/0194292 A1 8/2009 Oglesby
2009/0205675 A1 8/2009 Sarkar et al.
2009/0260834 A1 10/2009 Henson et al.
2009/0266552 A1 10/2009 Barra et al.
2009/0266562 A1 10/2009 Greenaway
2009/0272424 A1 11/2009 Ortabasi
2009/0272547 A1 11/2009 Dale et al.
2009/0279835 A1 11/2009 de Montmorillon et al.
2009/0294050 A1 12/2009 Traggis et al.
2009/0308852 A1 12/2009 Alpay et al.
2009/0324183 A1 12/2009 Bringuier et al.
2010/0000790 A1 1/2010 Moeny
2010/0001179 A1 1/2010 Kobayashi et al.
2010/0008631 A1 1/2010 Herbst
2010/0013663 A1 1/2010 Cavender et al.
2010/0018703 A1 1/2010 Lovell et al.
2010/0025032 A1 2/2010 Smith et al.
2010/0032207 A1 2/2010 Potter et al.
2010/0044102 A1 2/2010 Rinzler
2010/0044103 A1 2/2010 Moxley
2010/0044104 A1 2/2010 Zediker
2010/0044105 A1 2/2010 Faircloth
2010/0044106 A1 2/2010 Zediker
2010/0071794 A1 3/2010 Homan
2010/0078414 A1* 4/2010 Perry et al. ..... 219/121.67
2010/0084132 A1 4/2010 Noya et al.
2010/0089571 A1 4/2010 Revellat et al.
2010/0089574 A1 4/2010 Wideman et al.
2010/0089576 A1* 4/2010 Wideman et al. ..... 166/272.6
2010/0089577 A1 4/2010 Wideman et al.
2010/0155059 A1 6/2010 Ullah
2010/0170672 A1 7/2010 Schwoebel et al.
2010/0170680 A1 7/2010 McGregor et al.
2010/0187010 A1 7/2010 Abbasi et al.
2010/0197116 A1 8/2010 Shah et al.

(56) References Cited

U.S. PATENT DOCUMENTS

| | | | | |
|---|---|---|---|---|
| 2010/0197119 | A1 | 8/2010 | Lai et al. | |
| 2010/0215326 | A1 | 8/2010 | Zediker | |
| 2010/0218993 | A1* | 9/2010 | Wideman et al. | 175/17 |
| 2010/0224408 | A1 | 9/2010 | Kocis et al. | |
| 2010/0226135 | A1 | 9/2010 | Chen | |
| 2010/0236785 | A1 | 9/2010 | Collis et al. | |
| 2010/0326659 | A1 | 12/2010 | Schultz et al. | |
| 2010/0326665 | A1 | 12/2010 | Redlinger et al. | |
| 2011/0030957 | A1 | 2/2011 | Constantz et al. | |
| 2011/0035154 | A1 | 2/2011 | Kendall et al. | |
| 2011/0048743 | A1 | 3/2011 | Stafford et al. | |
| 2011/0061869 | A1 | 3/2011 | Abass et al. | |
| 2011/0079437 | A1 | 4/2011 | Hopkins et al. | |
| 2011/0127028 | A1 | 6/2011 | Strickland | |
| 2011/0139450 | A1 | 6/2011 | Vasques et al. | |
| 2011/0147013 | A1 | 6/2011 | Kilgore | |
| 2011/0162854 | A1 | 7/2011 | Bailey et al. | |
| 2011/0168443 | A1 | 7/2011 | Smolka | |
| 2011/0174537 | A1 | 7/2011 | Potter et al. | |
| 2011/0186298 | A1 | 8/2011 | Clark et al. | |
| 2011/0198075 | A1 | 8/2011 | Okada et al. | |
| 2011/0205652 | A1 | 8/2011 | Abbasi et al. | |
| 2011/0220409 | A1 | 9/2011 | Foppe | |
| 2011/0240314 | A1 | 10/2011 | Greenaway | |
| 2011/0266062 | A1 | 11/2011 | Shuman, V et al. | |
| 2011/0278070 | A1 | 11/2011 | Hopkins et al. | |
| 2011/0290563 | A1 | 12/2011 | Kocis et al. | |
| 2011/0303460 | A1 | 12/2011 | Von Rohr et al. | |
| 2012/0000646 | A1 | 1/2012 | Liotta et al. | |
| 2012/0012392 | A1 | 1/2012 | Kumar | |
| 2012/0012393 | A1 | 1/2012 | Kumar | |
| 2012/0020631 | A1 | 1/2012 | Rinzler | |
| 2012/0048550 | A1 | 3/2012 | Dusterhoft et al. | |
| 2012/0048568 | A1 | 3/2012 | Li et al. | |
| 2012/0061091 | A1 | 3/2012 | Radi | |
| 2012/0067643 | A1* | 3/2012 | DeWitt et al. | 175/15 |
| 2012/0068086 | A1 | 3/2012 | DeWitt | |
| 2012/0068523 | A1 | 3/2012 | Bowles | |
| 2012/0074110 | A1 | 3/2012 | Zediker | |
| 2012/0103693 | A1* | 5/2012 | Jeffryes | 175/61 |
| 2012/0111578 | A1 | 5/2012 | Tverlid | |
| 2012/0118568 | A1 | 5/2012 | Kleefisch et al. | |
| 2012/0118578 | A1 | 5/2012 | Skinner | |
| 2012/0217015 | A1 | 8/2012 | Zediker | |
| 2012/0217017 | A1 | 8/2012 | Zediker | |
| 2012/0217018 | A1 | 8/2012 | Zediker | |
| 2012/0217019 | A1 | 8/2012 | Zediker | |
| 2012/0248078 | A1 | 10/2012 | Zediker | |
| 2012/0255774 | A1 | 10/2012 | Grubb et al. | |
| 2012/0255933 | A1 | 10/2012 | McKay | |
| 2012/0261188 | A1 | 10/2012 | Zediker | |
| 2012/0266803 | A1 | 10/2012 | Zediker | |
| 2012/0267168 | A1* | 10/2012 | Grubb et al. | 175/16 |
| 2012/0273269 | A1 | 11/2012 | Rinzler | |
| 2012/0273470 | A1 | 11/2012 | Zediker | |
| 2012/0275159 | A1 | 11/2012 | Fraze | |
| 2013/0011102 | A1* | 1/2013 | Rinzler et al. | 385/89 |
| 2013/0175090 | A1 | 7/2013 | Zediker | |
| 2013/0192893 | A1 | 8/2013 | Zediker | |
| 2013/0192894 | A1 | 8/2013 | Zediker | |
| 2013/0220626 | A1 | 8/2013 | Zediker | |
| 2013/0228372 | A1 | 9/2013 | Linyaev | |
| 2013/0228557 | A1 | 9/2013 | Zediker | |
| 2013/0266031 | A1 | 10/2013 | Norton | |
| 2013/0319984 | A1 | 12/2013 | Linyaev | |
| 2014/0000902 | A1 | 1/2014 | Wolfe | |
| 2014/0060802 | A1 | 3/2014 | Zediker | |
| 2014/0060930 | A1 | 3/2014 | Zediker | |
| 2014/0069896 | A1 | 3/2014 | Deutch | |
| 2014/0090846 | A1 | 4/2014 | Deutch | |
| 2014/0190949 | A1 | 7/2014 | Zediker | |
| 2014/0231085 | A1 | 8/2014 | Zediker | |
| 2014/0231398 | A1 | 8/2014 | Land | |
| 2014/0248025 | A1 | 9/2014 | Rinzler | |
| 2014/0299375 | A1* | 10/2014 | Bozso et al. | 175/17 |
| 2014/0326509 | A1* | 11/2014 | Hay et al. | 175/57 |
| 2014/0345872 | A1 | 11/2014 | Zediker | |

FOREIGN PATENT DOCUMENTS

| | | | |
|---|---|---|---|
| EP | 0 565 287 | A1 | 10/1993 |
| EP | 0 950 170 | B1 | 9/2002 |
| FR | 2 716 924 | A1 | 9/1995 |
| GB | 1 284 454 | | 8/1972 |
| GB | 2420358 | B | 5/2006 |
| JP | 09072738 | A | 3/1997 |
| JP | 09-242453 | A | 9/1997 |
| JP | 2000-334590 | A | 12/2000 |
| JP | 2004-108132 | A | 4/2004 |
| JP | 2006-307481 | A | 11/2006 |
| JP | 2007-120048 | A | 5/2007 |
| WO | WO 95/32834 | A1 | 12/1995 |
| WO | WO 97/49893 | A1 | 12/1997 |
| WO | WO 98/50673 | A1 | 11/1998 |
| WO | WO 98/56534 | A1 | 12/1998 |
| WO | WO 02/057805 | A2 | 7/2002 |
| WO | WO 03/027433 | A1 | 4/2003 |
| WO | WO 03/060286 | A1 | 7/2003 |
| WO | WO 2004/009958 | A1 | 1/2004 |
| WO | WO 2004/094786 | A1 | 11/2004 |
| WO | WO 2005/001232 | A2 | 1/2005 |
| WO | WO 2005/001239 | A1 | 1/2005 |
| WO | WO 2006/008155 | A1 | 1/2006 |
| WO | WO 2006/041565 | A1 | 4/2006 |
| WO | WO 2006/054079 | A1 | 5/2006 |
| WO | WO 2007/002064 | A1 | 1/2007 |
| WO | WO 2007/112387 | A2 | 10/2007 |
| WO | WO 2007/136485 | A2 | 11/2007 |
| WO | WO 2008/016852 | A1 | 2/2008 |
| WO | WO 2008/070509 | A2 | 6/2008 |
| WO | WO 2008/085675 | A1 | 7/2008 |
| WO | WO 2009/042774 | A2 | 4/2009 |
| WO | WO 2009/042781 | A2 | 4/2009 |
| WO | WO 2009/042785 | A2 | 4/2009 |
| WO | WO 2009/131584 | A1 | 10/2009 |
| WO | WO 2010/036318 | A1 | 4/2010 |
| WO | WO 2010/060177 | A1 | 6/2010 |
| WO | WO 2010/087944 | A1 | 8/2010 |
| WO | WO 2011/008544 | A2 | 1/2011 |
| WO | WO 2011/032083 | A1 | 3/2011 |
| WO | WO 2011/041390 | A2 | 4/2011 |
| WO | WO 2011/075247 | A2 | 6/2011 |
| WO | WO 2011/106078 | A2 | 9/2011 |
| WO | WO 2012/003146 | A2 | 1/2012 |
| WO | WO 2012/012006 | A1 | 1/2012 |
| WO | WO 2012/027699 | A1 | 3/2012 |
| WO | WO 2012/064356 | A1 | 5/2012 |
| WO | WO 2012/116189 | A2 | 8/2012 |

OTHER PUBLICATIONS

U.S. Appl. No. 12/544,094, filed Aug. 19, 2009, Faircloth et al.
U.S. Appl. No. 12/543,968, filed Aug. 19, 2009, Rinzler et al.
U.S. Appl. No. 12/544,136, filed Aug. 19, 2009, Zediker et al.
U.S. Appl. No. 12/544,038, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, filed Oct. 1, 2010, Underwood et al.
U.S. Appl. No. 13/034,017, filed Feb. 24, 2011, Zediker et al.
U.S. Appl. No. 13/034,037, filed Feb. 24, 2011, Zediker et al.
U.S. Appl. No. 13/034,175, filed Feb. 24, 2011, Zediker et al.
U.S. Appl. No. 13/034,183, filed Feb. 24, 2011, Zediker et al.
U.S. Appl. No. 13/210,581, filed Aug. 16, 2011, DeWitt et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/403,509, filed Feb. 23, 2012, Fraze et al.
U.S. Appl. No. 13/403,287, filed Feb. 23, 2012, Grubb et al.
U.S. Appl. No. 13/403,132, filed Feb. 23, 2012, Zediker et al.
U.S. Appl. No. 13/366,882, filed Feb. 6, 2012, McKay et al.

(56) References Cited

OTHER PUBLICATIONS

U.S. Appl. No. 13/403,692, filed Feb. 23, 2012, Zediker et al.
U.S. Appl. No. 13/403,723, filed Feb. 23, 2012, Rinzler et al.
U.S. Appl. No. 13/403,741, filed Feb. 23, 2012, Zediker et al.
U.S. Appl. No. 13/486,795, filed Feb. 23, 2012, Rinzler et al.
U.S. Appl. No. 13/565,345, filed Feb. 23, 2012, Zediker et al.
U.S. Appl. No. 13/768,149, filed Feb. 15, 2013, Zediker et al.
U.S. Appl. No. 13/777,650, filed Feb. 26, 2013, Zediker et al.
U.S. Appl. No. 13/782,869, filed Mar. 1, 2013, Linyaev et al.
U.S. Appl. No. 13/782,942, filed Mar. 1, 2013, Norton et al.
U.S. Appl. No. 13/800,559, filed Mar. 13, 2013, Zediker et al.
U.S. Appl. No. 13/800,820, filed Mar. 13, 2013, Zediker et al.
U.S. Appl. No. 13/800,879, filed Mar. 13, 2013, Zediker et al.
U.S. Appl. No. 13/800,933, filed Mar. 13, 2013, Zediker et al.
U.S. Appl. No. 13/849,831, filed Mar. 25, 2013, Zediker et al.
U.S. Appl. No. 13/852,719, filed Mar. 28, 2013, Faircloth et al.
International Search Report and Written Opinion for PCT App. No. PCT/US10/24368, dated Nov. 2, 2010, 16 pgs.
International Search Report for PCT Application No. PCT/US09/54295, dated Apr. 26, 2010, 16 pgs.
International Search Report for PCT Application No. PCT/US2011/044548, dated Jan. 24, 2012, 17 pgs.
International Search Report for PCT Application No. PCT/US2011/047902, dated Jan. 17, 2012, 9 pgs.
International Search Report for PCT Application No. PCT/US2011/050044 dated Feb. 1, 2012, 26 pgs.
International Search Report for PCT Application No. PCT/US2012/026277, dated May 30, 2012, 11 pgs.
International Search Report for PCT Application No. PCT/US2012/026265, dated May 30, 2012, 14 pgs.
International Search Report for PCT Application No. PCT/US2012/026280, dated May 30, 2012, 12 pgs.
International Search Report for PCT Application No. PCT/US2012/026337, dated Jun. 7, 2012, 21 pgs.
International Search Report for PCT Application No. PCT/US2012/026471, dated May 30, 2012, 13 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
International Search Report for PCT Application No. PCT/US2012/026494, dated May 31, 2012, 12 pgs.
International Search Report for PCT Application No. PCT/US2012/020789, dated Jun. 29, 2012, 9 pgs.
International Search Report for PCT Application No. PCT/US2012/040490, dated Oct. 22, 2012, 14 pgs.
International Search Report for PCT Application No. PCT/US2012/049338, dated Jan. 22, 2013, 14 pgs.
Abdulagatova, Z. et al., "Effect of Temperature and Pressure on the Thermal Conductivity of Sandstone", *International Journal of Rock Mechanics & Mining Sciences*, vol. 46, 2009, pp. 1055-1071.
Abousleiman, Y. et al., "Poroelastic Solution of an Inclined Borehole in a Transversely Isotropic Medium", *Rock Mechanics*, Daemen & Schultz (eds), 1995, pp. 313-318.
Ackay, H. et al., Paper titled "Orthonormal Basis Functions for Continuous-Time Systems and Lp Convergence", date unknown but prior to Aug. 19, 2009, pp. 1-12.
Acosta, A. et al., paper from X Brazilian MRS meeting titled "Drilling Granite With Laser Light", X Encontro da SBPMat Granado-RS, Sep. 2011, 4 pages including pp. 56 and 59.
Agrawal Dinesh et al., "Microstructural by TEM of WC/Co composites Prepared by Conventional and Microwave Processes", Materials Research Lab, The Pennsylvania State University, *15th International Plansee Seminar*, vol. 2, , 2001, pp. 677-684.
Agrawal Dinesh et al., Report on "Development of Advanced Drill Components for BHA Using Mircowave Technology Incorporating Carbide Diamond Composites and Functionally Graded Materials", Microwave Processing and Engineering Center, Material Research Institute, The Pennsylvania State University, 2003, 10 pgs.
Agrawal Dinesh et al., Report on "Graded Steele-Tungsten Cardide/Cobalt-Diamond Systems Using Microwave Heating", Material Research Institute, Penn State University, *Proceedings of the 2002 International Conference on Functionally Graded Materials*, 2002, pp. 50-58.
Agrawal, Govind P., "Nonlinear Fiber Optics", Chap. 9, Fourth Edition, Academic Press copyright 2007, pp. 334-337.
Ahmadi, M. et al., "The Effect of Interaction Time and Saturation of Rock on Specific Energy in ND:YAG Laser Perforating", *Optics and Laser Technology*, vol. 43, 2011, pp. 226-231.
Ai, H.A. et al., "Simulation of dynamic response of granite: A numerical approach of shock-induced damage beneath impact craters", *International Journal of Impact Engineering*, vol. 33, 2006, pp. 1-10.
Akhatov, I. et al., "Collapse and Rebound of a Laser-Induced Cavitation Bubble", *Physics of Fluids*, vol. 13, No. 10, Oct. 2001, pp. 2805-2819.
Albertson, M. L. et al., "Diffusion of Submerged Jets", a paper for the *American Society of Civil Engineers*, Nov. 5, 1852, pp. 1571-1596.
Al-Harthi, A. A. et al., "The Porosity and Engineering Properties of Vesicular Basalt in Saudi Arabia", *Engineering Geology*, vol. 54, 1999, pp. 313-320.
Anand, U. et al., "Prevention of Nozzle Wear in Abrasive Water Suspension Jets (AWSJ) Using PoroLubricated Nozzles", *Transactions of the ASME*, vol. 125, Jan. 2003, pp. 168-181.
Andersson, J. C. et al., "The Aspo Pillar Stability Experiment: Part II—Rock Mass Response to Coupled Excavation-Induced and Thermal-Induced Stresses", *International Journal of Rock Mechanics & Mining Sciences*, vol. 46, 2009, pp. 879-895.
Anovitz, L. M. et al., "A New Approach to Quantification of Metamorphism Using Ultra-Small and Small Angle Neutron Scattering", *Geochimica et Cosmochimica Acta*, vol. 73, 2009, pp. 7303-7324.
Anton, Richard J. et al., "Dynamic Vickers indentation of brittle materials", *Wear*, vol. 239, 2000, pp. 27-35.
Antonucci, V. et al., "Numerical and Experimental Study of a Concentrated Indentation Force on Polymer Matrix Composites", an excerpt from the *Proceedings of the COMSOL Conference*, 2009, 4 pages.
Aptukov, V. N., "Two Stages of Spallation", publisher unknown, while the date of the publication is unknown, it is believed to be prior to Aug. 19, 2009, 6 pages.
Ashby, M. F. et al., "The Failure of Brittle Solids Containing Small Cracks Under Compressive Stress States", *Acta Metall.*, vol. 34, No. 3,1986, pp. 497-510.
ASTM International, "Standard Test Method for Thermal Conductivity of Solids by Means of the Guarded-Comparative-Longitudinal Heat Flow Technique", Standard under the fixed Designation E1225-09, 2009, pp. 1-9.
Atkinson, B. K., "Introduction to Fracture Mechanics and Its Geophysical Applications", *Fracture Mechanics of Rock*, 1987, pp. 1-26.
Aubertin, M. et al., "A Multiaxial Stress Criterion for Short- and Long-Term Strength of Isotropic Rock Media", *International Journal of Rock Mechanics & Mining Sciences*, vol. 37, 2000, pp. 1169-1193.
Author unknown, by RIO Technical Services, "Sub-Task 1: Current Capabilities of Hydraulic Motors, Air/Nitrogen Motors, and Electric Downhole Motors", a final report for Department of Energy National Petroleum Technology Office for the Contract Task 03NT30429, Jan. 30, 2004, 26 pages.
Avar, B. B. et al., "Porosity Dependence of the Elastic Modulof Lithophysae-rich Tuff: Numerical and Experimental Investigations", *International Journal of Rock Mechanics & Mining Sciences*, vol. 40, 2003, pp. 919-928.
Aydin, A. et al., "The Schmidt hammer in rock material characterization", *Engineering Geology*, vol. 81, 2005, pp. 1-14.
Backers, T. et al., "Tensile Fracture Propagation and Acoustic Emission Activity in Sandstone: The Effect of Loading Rate", *International Journal of Rock Mechanics & Mining Sciences*, vol. 42, 2005, pp. 1094-1101.

(56) References Cited

OTHER PUBLICATIONS

Baek, S. Y. et al., "Simulation of the Coupled Thermal/Optical Effects for Liquid Immersion Micro-/Nanolithography", source unknown, believed to be publically available prior to 2012,13 pages.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bagatur, T. et al., "Air-entrainment Characteristics in a Plunging Water Jet System Using Rectangular Nozzles with Rounded Ends", *Water SA*, vol. 29, No. 1, Jan. 2003, pp. 35-38.
Bailo, El Tahir et al., "Spectral signatures and optic coefficients of surface and reservoir shales and limestones at COIL, $CO_2$ and Nd:YAG laser wavelengths", *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, J. A. et al., "Analyzing the Dynamic Behavior of Downhole Equipment During Drilling", government Sandia Report, SAND-84-0758C, DE84 008840, 7 pages.
Baird, Jerold et al., Phase 1 Theoretical Description, A Geological Formation Drill String Dynamic Interaction Finite Element Program (GEODYN), *Sandia National Laboratories*, Report No. Sand-84-7101, 1984, 196 pgs.
Batarseh, S. I. et al, "Innovation in Wellbore Perforation Using High-Power Laser", *International Petroleum Technology Conference*, IPTC N0. 10981, Nov. 2005, 7 pages.
Batarseh, S. et al. "Well Perforation Using High-Power Lasers", *Society of Petroleum Engineers*, SPE 84418, 2003, pp. 1-10.
Batarseh, S. et al., "Well Perforation Using High-Power Lasers", a paper prepared for presentation at the SPE (Society of Petroleum Engineers) Annual Technical Conference and Exhibition, SPE No. 84418, Oct. 2003, 10 pages.
Baykasoglu, A. et al., "Prediction of Compressive and Tensile Strength of Limestone via Genetic Programming", *Expert Systems with Applications*, vol. 35, 2008, pp. 111-123.
BDM Corporation, Geothermal Completion Technology Life-Cycle Cost Model (GEOCOM), *Sandia National Laboratories*, for the U.S. Dept. of Energy, vols. 1 and 2, 1982, 222 pgs.
Bechtel SAIC Company LLC, "Heat Capacity Analysis", a report prepared for Department of Energy, Nov. 2004, 100 pages.
Belushi, F. et al., "Demonstration of the Power of Inter-Disciplinary Integration to Beat Field Development Challenges in Complex Brown Field-South Oman", *Society of Petroleum Engineers*, a paper prepared for presentation at the Abu Dhabi International Petroleum Exhibition & Conference, SPE No. 137154, Nov. 2010, 18 pages.
Belyaev, V. V., "Spall Damage Modelling and Dynamic Fracture Specificities of Ceramics", *Journal of Materials Processing Technology*, vol. 32, 1992, pp. 135-144.
Benavente, D. et al., "The Combined Influence of Mineralogical, Hygric and Thermal Properties on the Durability of PoroBuilding Stones", *Eur. J. Mineral*, vol. 20, Aug. 2008, pp. 673-685.
Beste, U. et al., "Micro-scratch evaluation of rock types—a means to comprehend rock drill wear", *Tribology International*, vol. 37, 2004, pp. 203-210.
Bieniawski, Z. T., "Mechanism of Brittle Fracture of Rock: Part I—Theory of the Fracture Process", *Int. J. Rock Mech. Min. Sci.*, vol. 4, 1967, pp. 395-406.
Bilotsky, Y. et al., "Modelling Multilayers Systems with Time-Depended Heaviside and New Transition Functions", excerpt from the Proceedings of the 2006 Nordic COMSOL Conference, 2006, 4 pages.
Birkholzer, J. T. et al., "The Impact of Fracture—Matrix Interaction on Thermal—Hydrological Conditions in Heated Fractured Rock", an origial research paper published online http://vzy.scijournals.org/cgi/content/full/5/2/657, May 26, 2006, 27 pages.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Blackwell, D. D. et al., "Geothermal Resources in Sedimentary Basins", a presentation for the Geothermal Energy Generation in Oil and Gas Settings, Mar. 13, 2006, 28 pages.
Blair, S. C. et al., "Analysis of Compressive Fracture in Rock Using Statistical Techniques: Part I. A Non-linear Rule-based Model", *Int. J. Rock Mech. Min. Sci.*, vol. 35 No. 7, 1998, pp. 837-848.
Blomqvist, M. et al., "All-in-Quartz Optics for Low Focal Shifts", *SPIE Photonics West Conference in San Francisco*, Jan. 2011, 12 pages.
Boechat, A. A. P. et al., "Bend Loss in Large Core Multimode Optical Fiber Beam Delivery Systems", *Applied Optics.*, vol. 30 No. 3, Jan. 20, 1991, pp. 321-327.
Bolme, C. A., "Ultrafast Dynamic Ellipsometry of Laser Driven Shock Waves", a dissertation for the degree of Doctor of Philosophy in Physical Chemistry at Massachusetts Institute of Technology, Sep. 2008, pp. 1-229.
Britz, Dieter, "Digital Simulation in Electrochemistry", *Lect. Notes Phys.*, vol. 666, 2005, pp. 103-117.
Brown, G., "Development, Testing and Track Record of Fiber-Optic, Wet-Mate, Connectors", *IEEE*, 2003, pp. 83-88.
Browning, J. A. et al., "Recent Advances in Flame Jet Working of Minerals", *7th Symposium on Rock Mechanics*, Pennsylvania State Univ., 1965, pp. 281-313.
Brujan, E. A. et al., "Dynamics of Laser-Induced Cavitation Bubbles Near an Elastic Boundar", *J. Fluid Mech.*, vol. 433, 2001, pp. 251-281.
Burdine, N. T., "Rock Failure Under Dynamic Loading Conditions", Society of Petroleum Engineers Journal, Mar. 1963, pp. 1-8.
Bybee, K., "Modeling Laser-Spallation Rock Drilling", *JPT*, an SPE available at www.spe.org/jpt, Feb. 2006, 2 pages 62-63.
Bybee, Karen, highlight of "Drilling a Hole in Granite Submerged in Water by Use of CO2 Laser", an SPE available at www.spe.org/jpt, *JPT*, Feb. 2010, pp. 48, 50 and 51.
Cai, W. et al., "Strength of Glass from Hertzian Line Contact", *Optomechanics 2011: Innovations and Solutions*, 2011, 5 pages.
Capetta, I. S. et al., "Fatigue Damage Evaluation on Mechanical Components Under Multiaxial Loadings", European Comsol Conference, University of Ferrara, Oct. 16, 2009, 25 pages.
Cardenas, R., "Protected Polycrystalline Diamond Compact Bits for Hard Rock Drilling", Report No. DOE-99049-1381, *U.S. Department of Energy*, 2000, pp. 1-79.
Carstens, J. P. et al., "Rock Cutting by Laser", a paper of *Society of Petroleum Engineers of AIME*, 1971, 11 pages.
Carstens, Jeffrey et al., "Heat-Assisted Tunnel Boring Machines", *Federal Railroad Administration and Urban Mass Transportation Administration*, U.S. Dept. of Transportation, Report No. FRA-RT-71-63, 1970, 340 pgs.
Caruso, C. et al., "Dynamic Crack Propagation in Fiber Reinforced Composites", Excerpt from the Proceedings of the COMSOL Conference, 2009, 5 pages.
Chastain, T. et al., "Deepwater Drilling Riser System", *SPE Drilling Engineering*, Aug. 1986, pp. 325-328.
Chen, H. Y. et al., "Characterization of the Austin Chalk Producing Trend", *SPE*, a paper prepared for presentation at the 61st Annual Technical Conference and Exhibition of the Society of Petroleum Engineers, SPE No. 15533, Oct. 1986, pp. 1-12.
Chen, K., paper titled "Analysis of Oil Film Interferometry Implementation in Non-Ideal Conditions", source unknown, Jan. 7, 2010, pp. 1-18.
Chraplyvy, A. R., "Limitations on Lightwave Communications Imposed by Optical-Fiber Nonlinearities", *Journal of Lightwave Technology*, vol. 8 No. 10, Oct. 1990, pp. 1548-1557.
Churcher, P. L. et al., "Rock Properties of Berea Sandstone, Baker Dolomite, and Indiana Limestone", a paper prepared for presentation at the SPE International Symposium on Oilfield Chemistry), *SPE*, SPE No. 21044, Feb. 1991, pp. 431-446 and 3 additional pages.
Cimetiere, A. et al., "A Damage Model for Concrete Beams in Compression", *Mechanics Research Communications*, vol. 34, 2007, pp. 91-96.
Clegg, John et al., "Improved Optimisation of Bit Selection Using Mathematically Modelled Bit-Performance Indices", *IADC/SPE International 102287*, 2006, pp. 1-10.

(56) References Cited

OTHER PUBLICATIONS

Close, F. et al., "Successful Drilling of Basalt in a West of Shetland Deepwater Discovery", a paper prepared for presentation at Offshore Europe 2005 by SPE (Society of Petroleum Engineers) Program Committee, SPE No. 96575, Sep. 2005, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cohen, J. H., "High-Power Slim-Hole Drilling System", a paper presented at the conference entitled Natural Gas RD&D Contractors Review Meeting, Office of Scientific and Technical Information, Apr. 1995, 10 pages.
Cone, C., "Case History of the University Block 9 (Wolfcamp) Field—Gas-Water Injection Secondary Recovery Project", *Journal of Petroleum Technology*, Dec. 1970, pp. 1485-1491.
Contreras, E. et al., "Effects of Temperature and Stress on the Compressibilities, Thermal Expansivities, and Porosities of Cerro Prieto and Berea Sandstones to 9000 PSI and 208 degrees Celsius", Proceedings Eighth Workshop Geothermal Reservoir Engineering, Leland Stanford Junior University, Dec. 1982, pp. 197-203.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Cooper, R., "Coiled Tubing Deployed ESPs Utilizing Internally Installed Power Cable—A Project Update", a paper prepared by SPE (Society of Petroleum Engineers) Program Committee for presentation at the 2nd North American Coiled Tubing Roundtable, SPE 38406, Apr. 1997, pp. 1-6.
Coray, P. S. et al., "Measurements on 5:1 Scale Abrasive Water Jet Cutting Head Models", source unknown, available prior to 2012, 15 pages.
Cruden, D. M., "The Static Fatigue of Brittle Rock Under Uniaxial Compression", *Int. J. Rock Mech. Min. Sci. & Geomech. Abstr.*, vol. 11, 1974, pp. 67-73.
da Silva, B. M. G., "Modeling of Crack Initiation, Propagation and Coalescence in Rocks", a thesis for the degree of Master of Science in Civil and Environmental Engineering at the Massachusetts Institute of Technology, Sep. 2009, pp. 1-356.
Dahl, F. et al., "Development of a New Direct Test Method for Estimating Cutter Life, Based on the Sievers' J Miniature Drill Test", *Tunnelling and Underground Space Technology*, vol. 22, 2007, pp. 106-116.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", *Journal of Materials Science Letters*, vol. 10, 1991, pp. 173-175.
de Castro Lima, J. J. et al., "Linear Thermal Expansion of Granitic Rocks: Influence of Apparent Porosity, Grain Size and Quartz Content", *Bull Eng Geol Env.*, 2004, vol. 63, pp. 215-220.
De Guire, Mark R., "Thermal Expansion Coefficient (start)", *EMSE 201—Introduction to Materials Science & Engineering*, 2003, pp. 15.1-15.15.
Degallaix, J. et al., "Simulation of Bulk-Absorption Thermal Lensing in Transmissive Optics of Gravitational Waves Detector", *Appl. Phys.*, B77, 2003, pp. 409-414.
Dey, T. N. et al., "Some Mechanisms of Microcrack Growth and Interaction in Compressive Rock Failure", *Int. J. Rock Mech. Min. Sci. & Geomech. Abstr.*, vol. 18, 1981, pp. 199-209.
Diamond-Cutter Drill Bits, by Geothermal Energy Program, Office of Geothermal and Wind Technologies, 2000, 2 pgs.
Dimotakis, P. E. et al., "Flow Structure and Optical Beam Propagation in High-Reynolds-Number Gas-Phase Shear Layers and Jets", *J. Fluid Mech.*, vol. 433, 2001, pp. 105-134.
Dincer, Ismail et al., "Correlation between Schmidt hardness, uniaxial compressive strength and Young's modulfor andesites, basalts and tuffs", *Bull Eng Geol Env*, vol. 63, 2004, pp. 141-148.
Dole, L. et al., "Cost-Effective CementitioMaterial Compatible with Yucca Mountain Repository Geochemistry", a paper prepared by Oak Ridge National Laboratory for the Department of Energy, No. ORNL/TM-2004/296, Dec. 2004, 128 pages.
Dumans, C. F. F. et al., "PDC Bit Selection Method Through the Analysis of Past Bit Performances", a paper prepared for presentation at the *SPE* (Society of Petroleum Engineers—Latin American Petroleum Engineering Conference), Oct. 1990, pp. 1-6.
Dunn, James C., "Geothermal Technology Development at Sandia", *Geothermal Research Division, Sandia National Laboratories*, 1987, pp. 1-6.
Dutton, S. P. et al., "Evolution of Porosity and Permeability in the Lower CretaceoTravis Peak Formation, East Texas", *The American Association of Petroleum Geologists Bulletin*, vol. 76, No. 2, Feb. 1992, pp. 252-269.
Dyskin, A. V. et al., "Asymptotic Analysis of Crack Interaction with Free Boundary", *International Journal of Solids and Structure*, vol. 37, 2000, pp. 857-886.
Eckel, J. R. et al., "Nozzle Design and its Effect on Drilling Rate and Pump Operation", a paper presented at the spring meeting of the Southwestern District, Division of Production, Beaumont, Texas, Mar. 1951, pp. 28-46.
Ehrenberg, S. N. et al., "Porosity-Permeability Relationship in Interlayered Limestone-Dolostone Reservoir", *The American Association of Petroleum Geologists Bulletin*, vol. 90, No. 1, Jan. 2006, pp. 91-114.
Eichler, H.J. et al., "Stimulated Brillouin Scattering in Multimode Fibers for Optical Phase Conjugation", *Optics Communications*, vol. 208, 2002, pp. 427-431.
Eighmy, T. T. et al., "Microfracture Surface Charaterizations: Implications for In Situ Remedial Methods in Fractured Rock", *Bedrock Bioremediation Center, Final Report, National Risk Management Research Laboratory, Office of Research and Development, U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept., University of Southwestern Louisiana and Sandia National Laboratories*, 2000, pp. 1-10.
Ersoy, a., "Wear Characteristics of PDC Pin and Hybrid Core Bits in Rock Drilling", *Wear*, vol. 188, 1995, pp. 150-165.
Extreme Coil Drilling, by Extreme Drilling Corporation, 2009, 10 pgs.
Falcao, J. L. et al., "PDC Bit Selection Through Cost Prediction Estimates Using Crossplots and Sonic Log Data", *SPE*, a paper prepared for presentation at the 1993 SPE/IADC Drilling Conference, Feb. 1993, pp. 525-535.
Falconer, I. G. et al., "Separating Bit and Lithology Effects from Drilling Mechanics Data", *SPE*, a paper prepared for presentation at the 1988 IADC/SPE Drilling Conference, Feb./Mar. 1988, pp. 123-136.
Farra, G., "Experimental Observations of Rock Failure Due to Laser Radiation", a thesis for the degree of Master of Science at Massachusetts Institute of Technology, Jan. 1969, 128 pages.
Farrow, R. L. et al., "Peak-Power Limits on Fiber Amplifiers Imposed by Self-Focusing", *Optics Letters*, vol. 31, No. 23, Dec. 1, 2006, pp. 3423-3425.
Ferro, D. et al., "Vickers and Knoop hardness of electron beam deposited ZrC and HfC thin films on titanium", *Surface & Coatings Technology*, vol. 200, 2006, pp. 4701-4707.

(56) References Cited

OTHER PUBLICATIONS

Fertl, W. H. et al., "Spectral Gamma-Ray Logging in the Texas Austin Chalk Trend", *SPE of AIME*, a paper for Journal of Petroleum Technology, Mar. 1980, pp. 481-488.
Field, F. A., "A Simple Crack-Extension Criterion for Time-Dependent Spallation", *J. Mech. Phys. Solids*, vol. 19, 1971, pp. 61-70.
Figueroa, H. et al., "Rock removal using high power lasers for petroleum exploitation purposes", *Gas Technology Institute, Colorado School of Mines, Halliburton Energy Services, Argonne National Laboratory*, 2002, pp. 1-13.
Finger, J. T. et al., "PDC Bit Research at Sandia National Laboratories", Sandia Report No. SAND89-0079-UC-253, a report prepared for Department of Energy, Jun. 1989, 88 pages.
Finger, John T. et al., "PDC Bit Research at Sandia National Laboratories", Sandia Report, *Geothermal Research Division 6252, Sandia National Laboratories*, SAND89-0079-UC-253, 1989, pp. 1-88.
Freeman, T. T. et al., "THM Modeling for Reservoir Geomechanical Applications", presented at the COMSOL Conference, Oct. 2008, 22 pages.
Friant, J. E. et al., "Disc Cutter Technology Applied to Drill Bits", a paper prepared by Exacavation Engineering Associates, Inc. for the Department of Energy's Natural Gas Conference, Mar. 1997, pp. 1-16.
Fuerschbach, P. W. et al., "Understanding Metal Vaporization from Laser Welding", Sandia Report No. SAND-2003-3490, a report prepared for DOE, Sep. 2003, pp. 1-70.
Gahan, B. C. et al., "Analysis of Efficient High-Power Fiber Lasers for Well Perforation", *SPE*, No. 90661, a paper prepared for presentation at the SPE Annual Technical Conference and Exhibition, Sep. 2004, 9 pages.
Gahan, B. C. et al., "Effect of Downhole Pressure Conditions on High-Power Laser Perforation", *SPE*, No. 97093, a paper prepared for the 2005 SPE (Society of Petroleum Engineers) Annual Technical Conference and Exhibition, Oct. 12, 2005, 7 pages.
Gahan, B. C. et al., "Laser Drilling: Drilling with the Power of Light, Phase 1: Feasibility Study", a Topical Report by the *Gas Technology Institute*, for the Government under Cooperative Agreement No. DE-FC26-00NT40917, Sep. 30, 2001, 107 pages.
Gahan, B. C. et al., "Laser Drilling: Determination of Energy Required to Remove Rock", *Society of Petroleum Engineers* International, SPE 71466, 2001, pp. 1-11.
Gahan, B. C., et al., "Laser Drilling—Drilling with the Power of Light: High Energy Laser Perforation and Completion Techniques", Annual Technical Progress Report by the *Gas Technology Institute*, to the Department of Energy, Nov. 2006, 94 pages.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Efficient of Downhole Pressure Conditions on High-Power Laser Perforation", *Society of Petroleum Engineers*, SPE 97093, 2005, pp. 1-7.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Gale, J. F. W. et al., "Natural Fractures in the Barnett Shale and Their Importance for Hydraulic Fracture Treatments", The American Assoction of Petroleum Geologists, *AAPG Bulletin*, vol. 91, No. 4, Apr. 2007, pp. 603-622.
Gardner, R. D. et al., "Flourescent Dye Penetrants Applied to Rock Fractures", *Int. J. Rock Mech. Min. Sci.*, vol. 5, 1968, pp. 155-158 with 2 additional pages.
Gelman, A., "Multi-level (hierarchical) modeling: what it can and can't do", source unknown, Jun. 1, 2005, pp. 1-6.
Gerbaud, L. et al., "PDC Bits: All Comes From the Cutter/Rock Interaction", SPE, No. IADC/SPE 98988, a paper presented at the IADC/SPE Drilling Conference, Feb. 2006, pp. 1-9.
Glowka, David A. et al., "Program Plan for the Development of Advanced Synthetic-Diamond Drill Bits for Hard-Rock Drilling", *Sandia National Laboratories*, SAND 93/1953, 1993, pp. 1-50.
Glowka, David A. et al., "Progress in the Advanced Synthetic-Diamond Drill Bit Program", *Sandia National Laboratories*, SAND95-2617C, 1994, pp. 1-9.
Glowka, David A., "Design Considerations for a Hard-Rock PDC Drill Bit", *Geothermal Technology Development Division 6241, Sandia National Laboratories*, SAND-85-0666C, DE85 008313, 1985, pp. 1-23.
Glowka, David A., "Development of a Method for Predicting the Performance and Wear of PDC Drill Bits", *Sandia National Laboratories*, SAND86-1745-UC-66c, 1987, pp. 1-206.
Glowka, David A., "The Use of Single—Cutter Data in the Analysis of PDC Bit Designs", *61st Annual Technical Conference and Exhibition of Society of Petroleum Engineers*, 1986, pp. 1-37.
Gonthier, F. "High-power All-Fiber® components: The missing link for high power fiber fasers", source unknown, 11 pages.
Graves, R. M. et al., "Comparison of Specific Energy Between Drilling With High Power Lasers and Other Drilling Methods", *SPE*, No. SPE 77627, a paper presented at the SPE (Society of Petroleum Engineers) Annual Technical Conference and Exhibiton, Sep. 2002, pp. 1-8.
Graves, R. M. et al., "Spectral signatures and optic coeffecients of surface and reservoir rocks at COIL, CO2 and Nd:YAG laser wavelenghts", source unknown, 13 pages.
Graves, R. M. et al., "StarWars Laser Technology Applied to Drilling and Completing Gas Wells", *SPE*, No. 49259, a paper prepared for presentation at the 1998 SPE Annual Technical Conference and Exhibition, 1998, pp. 761-770.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, *Petroleum Engineering Department, Colorado School of Mines*, 2001, pp. 1-157.
Green, D. J. et al., "Crack Arrest and Multiple Crackling in Glass Through the Use of Designed Residual Stress Profiles", *Science*, vol. 283, No. 1295, 1999, pp. 1295-1297.
Grigoryan, V., "InhomogeneoBoundary Value Problems", a lecture for Math 124B, Jan. 26, 2010, pp. 1-5.
Grigoryan, V., "Separathion of variables: Neumann Condition", a lecture for Math 124A, Dec. 1, 2009, pp. 1-3.
Gunn, D. A. et al., "Laboratory Measurement and Correction of Thermal Properties for Application to the Rock Mass", *Geotechnical and Geological Engineering*, vol. 23, 2005, pp. 773-791.
Guo, B. et al., "Chebyshev Rational Spectral and Pseudospectral Methods on a Semi-infinite Interval", *Int. J. Numer. Meth. Engng*, vol. 53, 2002, pp. 65-84.
Gurarie, V. N., "Stress Resistance Parameters of Brittle Solids Under Laser/Plasma Pulse Heating", *Materials Science and Engineering*, vol. A288, 2000, pp. 168-172.
Habib, P. et al., "The Influence of Residual Stresses on Rock Hardness", *Rock Mechanics*, vol. 6, 1974, pp. 15-24.
Hagan, P. C., "The Cuttability of Rock Using a High Pressure Water Jet", University of New South Wales, Sydney, Australia, obtained form the Internet on Sep. 7, 2010, at: http://www.mining.unsw.edu.au/Publications/publications_staff/Paper_Hagan_WASM.htm, 16 pages.
Hall, K. et al., "Rock Albedo and Monitoring of Thermal Conditions in Respect of Weathering: Some Expected and Some Unexpected Results", *Earth Surface Processes and Landforms*, vol. 30, 2005, pp. 801-811.
Hall, Kevin, "The role of thermal stress fatigue in the breakdown of rock in cold regions", *Geomorphology*, vol. 31, 1999, pp. 47-63.
Hammer, D. X. et al., "Shielding Properties of Laser-Induced Breakdown in Water for Pulse Durations from 5 ns to 125 fs", *Applied Optics*, vol. 36, No. 22, Aug. 1, 1997, pp. 5630-5640.
Han, Wei, "Computational and experimental investigations of laser drilling and welding for microelectronic packaging", *Dorchester Polytechnic Institute*, A Dissertation submitted in May 2004, 242 pgs.
Hancock, M. J., "The 1-D Heat Equation: 18.303 Linear Partial Differential Equations", source unknown, 2004, pp. 1-41.

(56) References Cited

OTHER PUBLICATIONS

Hareland, G. et al., "Drag—Bit Model Including Wear", *SPE*, No. 26957, a paper prepared for presentation at the Latin American/Caribbean Petroleum Engineering Conference, Apr. 1994, pp. 657-667.
Hareland, G. et al., "Cutting Efficiency of a Single PDC Cutter on Hard Rock", *Journal of Canadian Petroleum Technology*, vol. 48, No. 6, 2009, pp. 1-6.
Hareland, G., et al., "A Drilling Rate Model for Roller Cone Bits and Its Application", *SPE*, No. 129592, a paper prepared for presentation at the CPS/SPE International Oil and Gas Conference and Exhibition, Jun. 2010, pp. 1-7.
Harrison, C. W. III et al., "Reservoir Characterization of the Frontier Tight Gas Sand, Green River Basin, Wyoming", *SPE*, No. 21879, a paper prepared for presentation at the Rocky Mountain Regional Meeting and Low-Permeability Reservoirs Symposium, Apr. 1991, pp. 717-725.
Hashida, T. et al., "Numerical Simulation with Experimental Verification of the Fracture Behavior in Granite Under Confining Pressures based on the Tension-Softening Model", *International Journal of Fracture*, vol. 59, 1993, pp. 227-244.
Hasting, M. A. et al., "Evaluation of the Environmental Impacts of Induced Seismicity at the Naknek Geothermal Energy Project, Naknek, Alaska", a final report prepared for ASRC Energy Services Alaska Inc., May 2010, pp. 1-33.
Head, P. et al., "Electric Coiled Tubing Drilling (E-CTD) Project Update", *SPE*, No. 68441, a paper prepared for presentation at the SPE/CoTA Coiled Tubing Roundtable, Mar. 2001, pp. 1-9.
Healy, Thomas E., "Fatigue Crack Growth in Lithium Hydride", *Lawrence Livermore National Laboratory*, 1993, pp. 1-32.
Hettema, M. H. H. et al., "The Influence of Steam Pressure on Thermal Spelling of Sedimentary Rock: Theory and Experiments", *Int. J. Rock Mech. Min. Sci.*, vol. 35, No. 1, 1998, pp. 3-15.
Hibbs, Louis E. et al., "Wear Machanisms for Polycrystalline-Diamond Compacts as Utilized fro Drilling in Geothermal Environments", *Sandia National Laboratories*, for The United States Government, Report No. SAND-82-7213, 1983, 287 pgs.
Hoek, E., "Fracture of Anisotropic Rock", *Journal of the South African Institute of Mining and Metallurgy*, vol. 64, No. 10, 1964, pp. 501-523.
Hood, M., "Waterjet-Assisted Rock Cutting Systems—The Present State of the Art", *International Journal of Mining Engineering*, vol. 3, 1985, pp. 91-111.
Hoover, Ed R. et al., "Failure Mechanisms of Polycrystalline-Diamond Compact Drill Bits in Geothermal Environments", Sandia Report, *Sandia National Laboratories*, SAND81-1404, 1981, pp. 1-35.
Howard, A. D. et al., "VOLAN Interpretation and Application in the Bone Spring Formation (Leonard Series) in Southeastern New Mexico", *SPE*, No. 13397, a paper presented at the 1984 SPE Production Technology Symposium, Nov. 1984, 10 pages.
Howells, G., "Super-Water [R] Jetting Applications from 1974 to 1999", paper presented st the Proceedings of the 10$^{th}$ American Waterjet Confeence in Houston, Texas, 1999, 25 pages.
Hu, H. et al., "SimultaneoVelocity and Concentration Measurements of a Turbulent Jet Mixing Flow", *Ann. N.Y. Acad. Sci.*, vol. 972, 2002, pp. 254-259.
Huang, C. et al., "A Dynamic Damage Growth Model for Uniaxial Compressive Response of Rock Aggregates", *Mechanics of Materials*, vol. 34, 2002, pp. 267-277.
Huang, H. et al., "Intrinsic Length Scales in Tool-Rock Interaction", *International Journal of Geomechanics*, Jan./Feb. 2008, pp. 39-44.
Huenges, E. et al., "The Stimulation of a Sedimentary Geothermal Reservoir in the North German Basin: Case Study Grob Schonebeck", *Proceedings, Twenty-Ninth Workshop on Geothermal Reservoir Engineering*, Stanford University, Stanford, California, Jan. 26-28, 2004, 4 pages.
Huff, C. F. et al., "Recent Developments in Polycrystalline Diamond-Drill-Bit Design", *Drilling Technology Division—4741, Sandia National Laboratories*, 1980, pp. 1-29.
Hutchinson, J. W., "Mixed Mode Cracking in Layered Materials", *Advances in Applied Mechanics*, vol. 29, 1992, pp. 63-191.
IADC Dull Grading System for Fixed Cutter Bits, by Hughes Christensen, 1996, 14 pgs.
Imbt, W. C. et al., "Porosity in Limestone and Dolomite Petroleum Reservoirs", paper presented at the Mid Continent District, Division of Production, Oklahoma City, Oklahoma, Jun. 1946, pp. 364-372.
Jackson, M. K. et al., "Nozzle Design for Coherent Water Jet Production", source unknown, believed to be published prior to 2012, pp. 53-89.
Jadoun, R. S., "Study on Rock-Drilling Using PDC Bits for the Prediction of Torque and Rate of Penetration", *Int. J. Manufacturing Technology and Management*, vol. 17, No. 4, 2009, pp. 408-418.
Jain, R. K. et al., "Development of Underwater Laser Cutting Technique for Steel and Zircaloy for Nuclear Applications", *Journal of Physics for Indian Academy of Sciences*, vol. 75 No. 6, Dec. 2010, pp. 1253-1258.
Jen, C. K. et al., "Leaky Modes in Weakly Guiding Fiber Acoustic Waveguides", *IEEE Transactions on Ultrasonic Ferroelectrics and Frequency Control*, vol. UFFC-33 No. 6, Nov. 1986, pp. 634-643.
Jimeno, Carlos Lopez et al., Drilling and Blasting of Rocks, *a. a. Balkema* Publishers, 1995, 30 pgs.
Judzis, A. et al., "Investigation of Smaller Footprint Drilling System; Ultra-High Rotary Speed Diamond Drilling Has Potential for Reduced Energy Requirements", IADC/SPE No. 99020, 33 pages.
Jurewicz, B. R., "Rock Excavation with Laser Assistance", *Int. J. Rock Mech. Min. Sci. & Geomech. Abstr.*, vol. 13, 1976, pp. 207-219.
Kahraman, S. et al., "Dominant rock properties affecting the penetration rate of percussive drills", *International Journal of Rock Mechanics and Mining Sciences*, 2003, vol. 40, pp. 711-723.
Karakas, M., "Semianalytical Productivity Models for Perforated Completions", *SPE*, No. 18247, a paper for SPE (Society of Petroleum Engineers) Production Engineering, Feb. 1991, pp. 73-82.
Karasawa, H. et al., "Development of PDC Bits for Downhole Motors", *Proceedings 17th NZ Geothermal Workshop*, 1995, pp. 145-150.
Kelsey, James R., "Drilling Technology/GDO", *Sandia National Laboratories*, SAND-85-1866c, DE85 017231, 1985, pp. 1-7.
Kemeny, J. M., "A Model for Non-linear Rock Deformation Under Compression Due to Sub-critical Crack Growth", *Int. J. Rock Mech. Min. Sci. & Geomech. Abstr.*, vol. 28 No. 6, 1991, pp. 459-467.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Khandelwal, M., "Prediction of Thermal Conductivity of Rocks by Soft Computing", *Int. J. Earth Sci.* (*Geol. Rundsch*), May 11, 2010, 7 pages.
Kim, C. B. et al., "Measurement of the Refractive Index of Liquids at 1.3 and 1.5 Micron Using a Fibre Optic Fresnel Ratio Meter", *Meas. Sci. Technol.*,vol. 5, 2004, pp. 1683-1686.
Kim, K. R. et al., "$CO_2$ laser-plume interaction in materials processing", *Journal of Applied Physics*, vol. 89, No. 1, 2001, pp. 681-688.
Kiwata, T. et al., "Flow Visualization and Characteristics of a Coaxial Jet with a Tabbed Annular Nozzle", *JSME International Journal Series B*, vol. 49, No. 4, 2006, pp. 906-913.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, T. et al., "Drilling a 2-inch in Diameter Hole in Granites Submerged in Water by CO2 Lasers", *SPE*, No. 119914, a paper prepared for presentation at the SPE/IADC Drilling Conference and Exhibition, Mar. 2009, 6 pages.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.

(56) References Cited

OTHER PUBLICATIONS

Kobyakov, A. et al., "Design Concept for Optical Fibers with Enhanced SBS Threshold", *Optics Express*, vol. 13, No. 14, Jul. 11, 2005, pp. 5338-5346.
Kolari, K., "Damage Mechanics Model for Brittle Failure of Transversely Isotropic Solids (Finite Element Implementation)", *VTT Publications 628*, 2007, 210 pages.
Kolle, J. J., "A Comparison of Water Jet, Abrasive Jet and Rotary Diamond Drilling in Hard Rock", *Tempress Technologies Inc.*, 1999, pp. 1-8.
Kolle, J. J., "HydroPulse Drilling", a Final Report for Department of Energy under Cooperative Development Agreement No. DE-FC26-FT34367, Apr. 2004, 28 pages.
Kovalev, V. I. et al., "Observation of Hole Burning in Spectrum in SBS in Optical Fibres Under CW Monochromatic Laser Excitation", *IEEE*, Jun. 3, 2010, pp. 56-57.
Koyamada, Y. et al., "Simulating and Designing Brillouin Gain Spectrum in Single-Mode Fibers", *Journal of Lightwave Technology*, vol. 22, No. 2, Feb. 2004, pp. 631-639.
Krajcinovic, D. et al., "A Micromechanical Damage Model for Concrete", *Engineering Fracture Mechanics*, vol. 25, No. 5/6, 1986, pp. 585-596.
Kranz, R. L., "Microcracks in Rocks: A Review", *Tectonophysics*, vol. 100, 1983, pp. 449-480.
Kubacki, Emily et al., "Optics for Fiber Laser Applications", *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Experiments with Rock: Remarks on Strength and Stability Issues", *International Journal of Rock Mechanics & Mining Science*, vol. 44, 2007, pp. 525-537.
Labuz, J. F. et al., "Size Effects in Fracture of Rock", *Rock Mechanics for Industry*, Amadei, Kranz, Scott & Smeallie (eds), 1999, pp. 1137-1143.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", Thesis, submitted to Virginia Polytechnic Institute and State University, Blacksburg, Virginia, 2006, 92 pgs.
Langeveld, C. J., "PDC Bit Dynamics", a paper prepared for presentation at the 1992 IADC/SPE Drilling Conference, Feb. 1992, pp. 227-241.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Lee, S. H. et al., "Themo-Poroelastic Analysis of Injection-Induced Rock Deformation and Damage Evolution", *Proceedings Thirty-Fifth Workshop on Geothermal Reservoir Engineering*, Feb. 2010, 9 pages.
Lee, Y. W. et al., "High-Power Yb3+ Doped Phosphate Fiber Amplifier", *IEEE Journal of Selected Topics in Quantum Electronics*, vol. 15, No. 1, Jan./Feb. 2009, pp. 93-102.
Legarth, B. et al., "Hydraulic Fracturing in a Sedimentary Geothermal Reservoir: Results and Implications", *International Journal of Rock Mechanics & Mining Sciences*, vol. 42 , 2005, pp. 1028-1041.
Lehnhoff, T. F. et al., "The Influence of Temperature Dependent Properties on Thermal Rock Fragmentation", *Int. J. Rock Mech. Min. Sci. & Geomech. Abstr.*, vol. 12, 1975, pp. 255-260.
Leong, K. H. et al., "Lasers and Beam Delivery for Rock Drilling", *Argonne National Laboratory*, ANL/TD/TM03-01, 2003, pp. 1-35.
Leong, K. H., "Modeling Laser Beam-Rock Interaction", a report prepared for Department of Energy (http://www.doe.gov/bridge), 8 pages.
Leung, M. et al., "Theoretical study of heat transfer with moving phase-change interface in thawing of frozen food", *Journal of Physics D: Applied Physics*, vol. 38, 2005, pp. 477-482.
Li, Q. et al., "Experimental Research on Crack Propagation and Failure in Rock-type Materials under Compression", *EJGE*, vol. 13, Bund. D, 2008, p. 1-13.
Li, X. B. et al., "Experimental Investigation in the Breakage of Hard Rock by the PDC Cutters with Combined Action Modes", *Tunnelling and Underground Space Technology*, vol. 16., 2001, pp. 107-114.
Liddle, D. et al., "Cross Sector Decommissioning Workshop", presentation, Mar. 23, 2011, 14 pages.
Lima, R. S. et al., "Elastic ModulMeasurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", *Sandia National Laboratories*, SAND-81-1470C, 1981, pp. 1-6.
Lindholm, U. S. et al., "The Dynamic Strength and Fracture Properties of Dresser Basalt", *Int. J. Rock Mech. Min. Sci. & Geomech. Abstr.*, vol. 11, 1974, pp. 181-191.
Loland, K. E., "ContinuoDamage Model for Load-Response Estimation of Concrete", *Cement and Concrete Research*, vol. 10, 1980, pp. 395-402.
Lomov, I. N. et al., "Explosion in the Granite Field: Hardening and Softening Behavior in Rocks", *U.S. Department of Energy, Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lorenzana, H. E. et al., "Metastability of Molecular Phases of Nitrogen: Implications to the Phase Diagram", a manuscript submitted to the European Hight Pressure Research Group 39 Conference, Advances on High Pressure, Sep. 21, 2001, 18 pages.
Lubarda, V. A. et al., "Damage Model for Brittle Elastic Solids with Unequal Tensile and Compressive Strengths", *Engineering Fracture Mechanics*, vol. 29, No. 5, 1994, pp. 681-692.
Lucia, F. J. et al., "Characterization of Diagenetically Altered Carbonate Reservoirs, South Cowden Grayburg Reservoir, West Texas", a paper prepared for presentation at the 1996 SPE Annual Technical Conference and Exhibition, Oct. 1996, pp. 883-893.
Luffel, D. L. et al., "Travis Peak Core Permeability and Porosity Relationships at Reservoir Stress", *SPE Formation Evaluation*, Sep. 1991, pp. 310-318.
Luft, H. B. et al., "Development and Operation of a New Insulated Concentric Coiled Tubing String for ContinuoSteam Injection in Heavy Oil Production", Conference Paper published by Society of Petroleum Engineers on the Internet at: (http://www.onepetro.org/mslib/servlet/onepetropreview?id=00030322), on Aug. 8, 2012, 1 page.
Lund, M. et al., "Specific Ion Binding to Macromolecules: Effect of Hydrophobicity and Ion Pairing", *Langmuir*, 2008 vol. 24, 2008, pp. 3387-3391.
Lyons, K. David et al., "NETL Extreme Drilling Laboratory Studies High Pressure High Temperature Drilling Phenomena", *U.S. Department of Energy, National Energy Technology Laboratory*, 2007, pp. 1-6.
Manrique, E. J. et al., "EOR Field Experiences in Carbonate Reservoirs in the United States", *SPE Reservoir Evaluation & Engineering*, Dec. 2007, pp. 667-686.
Maqsood, A. et al., "Thermophysical Properties of PoroSandstones: Measurement and Comparative Study of Some Representative Thermal Conductivity Models", *International Journal of Thermophysics*, vol. 26, No. 5, Sep. 2005, pp. 1617-1632.
Marcuse, D., "Curvature Loss Formula for Optical Fibers", *J. Opt. Soc. Am.*, vol. 66, No. 3, 1976, pp. 216-220.
Marshall, David B. et al., "Indentation of Brittle Materials", *Microindentation Techniques in Materials Science and Engineering, ASTM STP 889; American Society for Testing and Materials*, 1986, pp. 26-46.

(56) References Cited

OTHER PUBLICATIONS

Martin, C. D., "Seventeenth Canadian Geotechnical Colloquium: The Effect of Cohesion Loss and Stress Path on Brittle Rock Strength", *Canadian Geotechnical Journal*, vol. 34, 1997, pp. 698-725.
Martins, A. et al., "Modeling of Bend Losses in Single-Mode Optical Fibers", Institutu de Telecomunicacoes, Portugal, 3 pages.
Maurer, W. C. et al., "Laboratory Testing of High-Pressure, High-Speed PDC Bits", a paper prepared for presentation at the 61st Annual Technical Conference and Exhibition of the Society of Petroleum Engineers, Oct. 1986, pp. 1-8.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
McKenna, T. E. et al., "Thermal Conductivity of Wilcox and Frio Sandstones in South Texas (Gulf of Mexico Basin)", *AAPG Bulletin*, vol. 80, No. 8, Aug. 1996, pp. 1203-1215.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Meister, S. et al., "Glass Fibers for Stimulated Brillouin Scattering and Phase Conjugation", *Laser and Particle Beams*, vol. 25, 2007, pp. 15-21.
Mejia-Rodriguez, G. et al., "Multi-Scale Material Modeling of Fracture and Crack Propagation", Final Project Report in Multi-Scale Methods in Applied Mathematics, while the date of the publication is unknown, it is believed to be prior to Aug. 19, 2009, pp. 1-9.
Mensa-Wilmot, G. et al., "New PDC Bit Technology, Improved Drillability Analysis, and Operational Practices Improve Drilling Performance in Hard and Highly HeterogeneoApplications", a paper prepared for the 2004 SPE (Society of Petroleum Engineers) Eastern Regional Meeting, Sep. 2004, pp. 1-14.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Messica, A. et al., "Theory of Fiber-Optic Evanescent-Wave Spectroscopy and Sensor", *Applied Optics*, vol. 35, No. 13, May 1, 1996, pp. 2274-2284.
Mills, W. R. et al., "Pulsed Neutron Porosity Logging", SPWLA Twenty-Ninth Annual Logging Symposium, Jun. 1988, pp. 1-21.
Mirkovich, V. V., "Experimental Study Relating Thermal Conductivity to Thermal Piercing of Rocks", *Int. J. Rock Mech. Min. Sci.*, vol. 5, 1968, pp. 205-218.
Mittelstaedt, E. et al., "A Noninvasive Method for Measuring the Velocity of Diffuse Hydrothermal Flow by Tracking Moving Refractive Index Anomalies", *Geochemistry Geophysics Geosystems*, vol. 11, No. 10, Oct. 8, 2010, pp. 1-18.
Moavenzadeh, F. et al., "Thin Disk Technique for Analyzing Fock Fractures Induced by Laser Irradiation", a report prepared for the Department of Transportation under Contract C-85-65, May 1968, 91 pages.
Mocofanescu, A. et al., "SBS threshold for single mode and multimode GRIN fibers in an all fiber configuration", *Optics Express*, vol. 13, No. 6, 2005, pp. 2019-2024.
Montross, C. S. et al., "Laser-Induced Shock Wave Generation and Shock Wave Enhancement in Basalt", *International Journal of Rock Mechanics and Mining Sciences*, 1999, pp. 849-855.
Moradian, Z. A. et al., "Predicting the Uniaxial Compressive Strength and Static Young's Modulof Intact Sedimentary Rocks Using the Ultrasonic Test", *International Journal of Geomechanics*, vol. 9, No. 1, 2009, pp. 14-19.
Morozumi, Y. et al., "Growth and Structures of Surface Disturbances of a Round Liquid Jet in a Coaxial Airflow", *Fluid Dynamics Research*, vol. 34, 2004, pp. 217-231.
Morse, J. W. et al., "Experimental and Analytic Studies to Model Reaction Kinetics and Mass Transport of Carbon Dioxide Sequestration in Depleted Carbonate Reservoirs", a Final Scientific/Technical Report for DOE, while the date of the publication is unknown, it is believed to be prior to Aug. 19, 2009, 158 pages.
Moshier, S. O., "Microporosity in Micritic Limestones: A Review", *Sedimentary Geology*, vol. 63, 1989, pp. 191-213.
Mostafa, M. S. et al., "Investigation of Thermal Properties of Some Basalt Samples in Egypt", *Journal of Thermal Analysis and Calorimetry*, vol. 75, 2004, pp. 178-188.
Mukhin, I. B. et al., "Experimental Study of Kilowatt-Average-Power Faraday Isolators", OSA/ASSP, 2007, 3 pages.
Multari, R. A. et al., "Effect of Sampling Geometry on Elemental Emissions in Laser-Induced Breakdown Spectroscopy", *Applied Spectroscopy*, vol. 50, No. 12, 1996, pp. 1483-1499.
Munro, R. G., "Effective Medium Theory of the Porosity Dependence of Bulk Moduli", *Communications of American Ceramic Society*, vol. 84, No. 5, 2001, pp. 1190-1192.
Murphy, H. D., "Thermal Stress Cracking and Enhancement of Heat Extraction from Fractured Geothermal Reservoirs", a paper submitted to the Geothermal Resource Council for its 1978 Annual Meeting, Jul. 1978, 7 pages.
Murrell, S. A. F. et al., "The Effect of Temperature on the Strength at High Confining Pressure of Granodiorite Containing Free and Chemically-Bound Water", *Mineralogy and Petrology*, vol. 55, 1976, pp. 317-330.
Muto, Shigeki et al., "Laser cutting for thick concrete by multi-pass technique", *Chinese Optics Letters*, vol. 5 Supplement, 2007, pp. S39-S41.
Myung, I. J., "Tutorial on Maximum Likelihood Estimation", *Journal of Mathematical Psychology*, vol. 47, 2003, pp. 90-100.
Nakano, A. et al., "Visualization for Heat and Mass Transport Phenomena in Supercritical Artificial Air", *Cryogenics*, vol. 45, 2005, pp. 557-565.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Study of Subcritical Crack Growth in Andesite Using the Double Torsion Test", *International Journal of Rock Mechanics & Mining Sciences*, vol. 42, 2005, pp. 521-530.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
Nicklaus, K. et al., "Optical Isolator for Unpolarized Laser Radiation at Multi-Kilowatt Average Power", *Optical Society of America*, 2005, 3 pages.
Nikles, M. et al., "Brillouin Gain Spectrum Characterization in Single-Mode Optical Fibers", *Journal of Lightwave Technology*, vol. 15, No. 10, Oct. 1997, pp. 1842-1851.
Nilsen, B. et al., "Recent Developments in Site Investigation and Testing for Hard Rock TBM Projects", *1999 RETC Proceedings*, 1999, pp. 715-731.
Nimick, F. B., "Empirical Relationships Between Porosity and the Mechanical Properties of Tuff", *Key Questions in Rock Mechanics*, Cundall et al. (eds), 1988, pp. 741-742.
Nolen-Hoeksema, R., "Fracture Development and Mechnical Stratigraphy of Austin Chalk, Texas: Discussion", a discussion for The American Association of Petroleum Geologists Bulletin, vol. 73, No. 6, Jun. 1989, pp. 792-793.
O'Hare, Jim et al., "Design Index: A Systematic Method of PDC Drill-Bit Selection", *Society of Petroleum Engineers International*, IADC/SPE Drilling Conference, 2000, pp. 1-15.

(56) References Cited

OTHER PUBLICATIONS

Oglesby, K. et al., "Advanced Ultra High Speed Motor for Drilling", a project update by Impact Technologies LLC for the Department of Energy, Sep. 12, 2005, 36 pages.
Okon, P. et al., "Laser Welding of Aluminium Alloy 5083", *21st International Congress on Applications of Lasers and Electro-Optics*, 2002, pp. 1-9.
Olsen, F. O., "Fundamental Mechanisms of Cutting Front Formation in Laser Cutting", *SPIE*, vol. 2207, pp. 402-413.
Ortega, Alfonso et al., "Frictional Heating and Convective Cooling of Polycrystalline Diamond Drag Tools During Rock Cutting", Report No. SAND 82-0675c, *Sandia National Laboratories*, 1982, 23 pgs.
Ortega, Alfonso et al., "Studies of the Frictional Heating of Polycrystalline Diamond Compact Drag Tools During Rock Cutting", *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/Society of Petroleum Engineers Inc.*, 1996, pp. 379-389.
Ouyang, L. B. et al., "General Single Phase Wellbore Flow Model", a report prepared for the COE/PETC, May 2, 1997, 51 pages.
Palashchenko, Yuri A., "Pure Rolling of Bit Cones Doubles Performance", *I & Gas Journal*, vol. 106, 2008, 8 pgs.
Palchaev, D. K. et al., "Thermal Expansion of Silicon Carbide Materials", *Journal of Engineering Physics and Thermophysics*, vol. 66, No. 6, 1994, 3 pages.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, R. et al., "Drilling Large Diameter Holes in Rocks Using Multiple Laser Beams (504)", while the date of the publication is unknown, it is believed to be prior to Aug. 19, 2009, 6 pages.
Parker, Richard A. et al., "Laser Drilling Effects of Beam Application Methods on Improving Rock Removal", *Society of Petroleum Engineers*, SPE 84353, 2003, pp. 1-7.
Patricio, M. et al., "Crack Propagation Analysis", while the date of the publication is unknown, it is believed to be prior to Aug. 19, 2009, 24 pages.
Pavlina, E. J. et al., "Correlation of Yield Strength and Tensile Strength with Hardness for Steels", *Journals of Materials Engineering and Performance*, vol. 17, No. 6, 2008, pp. 888-893.
Peebler, R. P. et al., "Formation Evaluation with Logs in the Deep Anadarko Basin", *SPE of AIME*, 1972, 15 pages.
Pepper, D. W. et al., "Benchmarking COMSOL Multiphysics 3.5a—CFD Problems", a presentation, Oct. 10, 2009, 54 pages.
Percussion Drilling Manual, by Smith Tools, 2002, 67 pgs.
Pettitt, R. et al., "Evolution of a Hybrid Roller Cone/PDC Core Bit", a paper prepared for Geothermal Resources Council 1980 Annual Meeting, Sep. 1980, 7 pages.
Phani, K. K. et al., "Porosity Dependence of Ultrasonic Velocity and Elastic Modulin Sintered Uranium Dioxide—a discussion", *Journal of Materials Science Letters*, vol. 5, 1986, pp. 427-430.
Ping, Cao et al., "Testing study of subcritical crack growth rate and fracture toughness in different rocks", *Transactions of NonferroMetals Society of China*, vol. 16, 2006, pp. 709-714.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert* (*ed.*), VGE, 2004, pp. 1-6.
Plinninger, R. J. et al., "Wear Prediction in Hardrock Excavation Using the CERCHAR Abrasiveness Index (CAI)", EUROCK 2004 & 53rd Geomechanics Colloquium, 2004, 6 pages.
Plinninger, Ralf J. et al., "Predicting Tool Wear in Drill and Blast", *Tunnels & Tunneling International Magazine*, 2002, pp. 1-5.
Plumb, R. A. et al., "Influence of Composition and Texture on Compressive Strength Variations in the Travis Peak Formation", a paper prepared for presentation at the 67th Annual Technical Conference and Exhibition of the Society of Petroleum Engineers, Oct. 1992, pp. 985-998.
Polsky, Yarom et al., "Enhanced Geothermal Systems (EGS) Well Construction Technology Evaluation Report", *Sandia National Laboratories*, Sandia Report, SAND2008-7866, 2008, pp. 1-108.
Pooniwala, S. et al., "Lasers: The Next Bit", a paper prepared for the presentation at the 2006 SPE (Society of Petroleum Engineers) Eastern Regional Meeting, Oct. 2006, pp. 1-10.
Pooniwala, Shahvir, "Lasers: The Next Bit", *Society of Petroleum Engineers*, No. SPE 104223, 2006, 10 pgs.
Porter, J. A. et al., "Cutting Thin Sheet Metal with a Water Jet Guided Laser Using VarioCutting Distances, Feed Speeds and Angles of Incidence", *Int. J. Adv. Manuf. Technol.*, vol. 33, 2007, pp. 961-967.
Potyondy, D. O. et al., "A Bonded-particle model for rock", *International Journal of Rock Mechanics and Mining Sciences*, vol. 41, 2004, pp. 1329-1364.
Potyondy, D. O., "Simulating Stress Corrosion with a Bonded-Particle Model for Rock", *International Journal of Rock Mechanics & Mining Sciences*, vol. 44, 2007, pp. 677-691.
Potyondy, D., "Internal Technical Memorandum—Molecular Dynamics with PFC", a Technical Memorandum to PFC Development Files and Itasca Website, *Molecular Dynamics with PFC*, Jan. 6, 2010, 35 pages.
Powell, M. et al., "Optimization of UHP Waterjet Cutting Head, The Orifice", Flow International, while the date of the publication is unknown, it is believed to be prior to Aug. 19, 2009, 19 pages.
Price, R. H. et al., "Analysis of the Elastic and Strength Properties of Yuccs Mountain tuff, Nevada", 26th Symposium on Rock Mechanics, Jun. 1985, pp. 89-96.
Qixian, Luo et al., "Using compression wave ultrasonic transducers to measure the velocity of surface waves and hence determine dynamic modulof elasticity for concrete", *Construction and Building Materials*, vol. 10, No. 4, 1996, pp. 237-242.
Quinn, R. D. et al., "A Method for Calculating Transient Surface Temperatures and Surface Heating Rates for High-Speed Aircraft", NASA, Dec. 2000, 35 pages.
Radkte, Robert, "New High Strength and faster Drilling TSP Diamond Cutters", Report by *Technology International, Inc.*, DOE Award No. DE-FC26-97FT34368, 2006, 97 pgs.
Ramadan, K. et al., "On the Analysis of Short-Pulse Laser Heating of Metals Using the Dual Phase Lag Heat Conduction Model", *Journal of Heat Transfer*, vol. 131, Nov. 2009, pp. 111301-1 to 111301-7.
Rao, M. V. M. S. et al., "A Study of Progressive Failure of Rock Under Cyclic Loading by Ultrasonic and AE Monitoring Techniques", *Rock Mechanics and Rock Engineering*, vol. 25, No. 4, 1992, pp. 237-251.
Rauenzahn, R. M. et al., "Rock Failure Mechanisms of Flame-Jet Thermal Spallation Drilling—Theory and Experimental Testing", *Int. J. Rock Mech. Min. Sci. & Geomech. Abstr.*, vol. 26, No. 5, 1989, pp. 381-399.
Rauenzahn, R. M., "Analysis of Rock Mechanics and Gas Dynamics of Flame-Jet Thermal Spallation Drilling", a dissertation for the degree of Doctor of Philosophy at Massachusettes Institute of Technology, Sep. 1986, pp. 1-524.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Rauenzahn, R. M., "Analysis of Rock Mechanics and Gas Dynamics of Flame-Jet Thermal Spallation Drilling", *Massachusetts Institute of Technology*, submitted in partial fulfillment of doctorate degree, 1986 583 pgs.
Ravishankar, M. K., "Some Results on Search Complexity vs Accuracy", DARPA Spoken Systems Technology Workshop, Feb. 1997, 4 pages.
Raymond, David W., "PDC Bit Testing at Sandia Reveals Influence of Chatter in Hard-Rock Drilling", *Geothermal Resources Council Monthly Bulletin*, SAND99-2655J, 1999, 7 pgs.

(56) References Cited

OTHER PUBLICATIONS

Ream, S. et al., "Zinc Sulfide Optics for High Power Laser Applications", Paper 1609, while the date of the publication is unknown, it is believed to be prior to Aug. 19, 2009, 7 pages.
Rice, J. R., "On the Stability of Dilatant Hardening for Saturated Rock Masses", *Journal of Geophysical Research*, vol. 80, No. 11, Apr. 10, 1975, pp. 1531-1536.
Richter, D. et al., "Thermal Expansion Behavior of IgneoRocks", *Int. J. Rock Mech. Min. Sci. & Geomech. Abstr.*, vol. 11, 1974, pp. 403-411.
Rietman, N. D. et al., "Comparative Economics of Deep Drilling in Anadarka Basin", a paper presented at the 1979 Society of Petroleum Engineers of AIME Deep Drilling and Production Symposium, Apr. 1979, 5 pages.
Rijken, P. et al., "Predicting Fracture Attributes in the Travis Peak Formation Using Quantitative Mechanical Modeling and Stractural Diagenesis", Gulf Coast Association of Geological Societies Transactions vol. 52, 2002, pp. 837-847.
Rijken, P. et al., "Role of Shale Thickness on Vertical Connectivity of Fractures: Application of Crack-Bridging Theory to the Austin Chalk, Texas", *Tectonophysics*, vol. 337 ,2001, pp. 117-133.
Rosier, M., "Generalized Hermite Polynomials and the Heat Equation for Dunk! Operators", a paper, while the date of the publication is unknown, it is believed to be prior to Aug. 19, 2009, pp. 1-24.
Rossmanith, H. P. et al., "Fracture Mechanics Applications to Drilling and Blasting", *Fatigue & Fracture Engineering Materials & Structures*, vol. 20, No. 11, 1997, pp. 1617-1636.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Rubin, A. M. et al., "Dynamic Tensile-Failure-Induced Velocity Deficits in Rock", *Geophysical Research Letters*, vol. 18, No. 2, Feb. 1991, pp. 219-222.
Sachpazis, C. I, M. Sc., Ph. D., "Correlating Schmidt Hardness With Compressive Strength and Young's ModulOf Carbonate Rocks", *International Association of Engineering Geology*, Bulletin, No. 42, 1990, pp. 75-83.
Salehi, I. A. et al., "Laser Drilling—Drilling with the Power Light", a final report a contract with DOE with award No. DE-FC26-00NT40917, May 2007, in parts 1-4 totaling 318 pages.
Sandler, I. S. et al., "An Algorithm and a Modular Subroutine for the Cap Model", *International Journal for Numerical and Analytical Methods in Geomechanics*, vol. 3, 1979, pp. 173-186.
Sano, Osam et al., "Acoustic Emission During Slow Crack Growth", *Department Mining and Mineral Engineering, NII-Electronic Library Service*, 1980, pp. 381-388.
Santarelli, F. J. et al., "Formation Evaluation From Logging on Cuttings", *SPE Reservoir Evaluation & Engineering*, Jun. 1998, pp. 238-244.
Sattler, A. R., "Core Analysis in a Low Permeability Sandstone Reservoir: Results from the Multiwell Experiment", a report by Sandia National Laboratories for the Department of Energy, Apr. 1989, 69 pages.
Scaggs, M. et al., "Thermal Lensing Compensation Objective for High Power Lasers", published by Haas Lasers Technologies, Inc., while the date of the publication is unknown, it is believed to be prior to Aug. 19, 2009, 7 pages.
Schaff, D. P. et al., "Waveform Cross-Correlation-Based Differential Travel-Time Measurements at the Northern California Seismic Network", *Bulletin of the Seismological Society of America*, vol. 95, No. 6, Dec. 2005, pp. 2446-2461.
Schaffer, C. B. et al., "Dynamics of Femtosecond Laser-Induced Breakdown in Water from Femtoseconds to Microseconds", *Optics Express*, vol. 10, No. 3, Feb. 11, 2002, pp. 196-203.
Scholz, C. H., "Microfracturing of Rock in Compression", a dissertation for the degree of Doctor of Philosophy at Massachusettes Instutute of Trechnology, Sep. 1967, 177 pages.
Schormair, Nik et al., "The influence of anisotropy on hard rock drilling and cutting", *The Geological Society of London, IAEG*, Paper No. 491, 2006, pp. 1-11.
Schroeder, R. J. et al., "High Pressure and Temperature Sensing for the Oil Industry Using Fiber Bragg Gratings Written onto Side Hole Single Mode Fiber", publisher unknown, while the date of the publication is unknown, it is believed to be prior to Aug. 19, 2009, 4 pages.
Shannon, G. J. et al., "High power laser welding in hyperbaric gas and water environments", *Journal of Laser Applications*, vol. 9, 1997, pp. 129-136.
Shiraki, K. et al., "SBS Threshold of a Fiber with a Brillouin Frequency Shift Distribution", *Journal of Lightwave Technology*, vol. 14, No. 1, Jan. 1996, pp. 50-57.
Shuja, S. Z. et al., "Laser heating of semi-infinite solid with consecutive pulses: Influence of materaial properties on temperature field", *Optics & Laser Technology*, vol. 40, 2008, pp. 472-480.
Simple Drilling Methods, WEDC Loughborough University, United Kingdom, 1995, 4 pgs.
Singh, T. N. et al., "Prediction of Thermal Conductivity of Rock Through Physico-Mechanical Properties", *Building and Environment*, vol. 42, 2007, pp. 146-155.
Sinha, D., "Cantilever Drilling—Ushering a New Genre of Drilling", a paper prepared for presentation at the SPE/IADC Middle East Drilling Technology Conference and Exhibition, Oct. 2003, 6 pages.
Sinor, A. et al., "Drag Bit Wear Model", *SPE Drilling Engineering*, Jun. 1989, pp. 128-136.
Smith, D., "Using Coupling Variables to Solve Compressible Flow, Multiphase Flow and Plasma Processing Problems", COMSOL Users Conference 2006, 38 pages.
Smith, E., "Crack Propagation at a Constant Crack Tip Stress Intensity Factor", *Int. Journal of Fracture*, vol. 16, 1980, pp. R215-R218.
Sneider, RM et al., "Rock Types, Depositional History, and Diangenetic Effects, Ivishak reservoir Prudhoe Bay Field", *SPE Reservoir Engineering*, Feb. 1997, pp. 23-30.
Soeder, D. J. et al., "Pore Geometry in High- and Low-Permeability Sandstones, Travis Peak Formation, East Texas", *SPE Formation Evaluation*, Dec. 1990, pp. 421-430.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Somerton, W. H. et al., "Thermal Expansion of Fluid Saturated Rocks Under Stress", SPWLA Twenty-Second Annual Logging Symposium, Jun. 1981, pp. 1-8.
Sousa, L. M. O. et al., "Influence of Microfractures and Porosity on the Physico-Mechanical Properties and Weathering of Ornamental Granites", *Engineering Geology*, vol. 77, 2005, pp. 153-168.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", *Sandia National Laboratories*, SAND-85-0633C, 1985, pp. 1-20.
Stowell, J. F. W., "Characterization of Opening-Mode Fracture Systems in the Austin Chalk", *Gulf Coast Association of Geological Societies Transactions*, vol. L1, 2001, pp. 313-320.
Straka, W. A. et al., "Cavitation Inception in Quiescent and Co-Flow Nozzle Jets", 9th International Conference on Hydrodynamics, Oct. 2010, pp. 813-819.
Suarez, M. C. et al., "COMSOL in a New Tensorial Formulation of Non-Isothermal Poroelasticity", publisher unknown, while the date of the publication is unknown, it is believed to be prior to Aug. 19, 2009,2 pages.
Summers, D. A., "Water Jet Cutting Related to Jet & Rock Properties", publisher unknown, while the date of the publication is unknown, it is believed to be prior to Aug. 19, 2009, 13 pages.
Suwarno, et al., "Dielectric Properties of Mixtures Between Mineral Oil and Natural Ester from Palm Oil", *WSEAS Transactions on Power Systems*, vol. 3, Issue 2, Feb. 2008, pp. 37-46.
Takarli, Mokhfi et al., "Damage in granite under heating/cooling cycles and water freeze-thaw condition", *International Journal of Rock Mechanics and Mining Sciences*, vol. 45, 2008, pp. 1164-1175.

(56) References Cited

OTHER PUBLICATIONS

Tanaka, K. et al., "The Generalized Relationship Between the Parameters *C* and *m* of Paris' Law for Fatigue Crack Growth", *Scripta Metallurgica*, vol. 15, No. 3, 1981, pp. 259-264.
Tang, C. A. et al., "Numerical Studies of the Influence of Microstructure on Rock Failure in Uniaxial Compression—Park I: Effect of Heterogeneity", *International Journal of Rock Mechanics and Mining Sciences*, vol. 37, 2000, pp. 555-569.
Tang, C. A. et al., "Coupled analysis of flow, stress and damage (FSD) in rock failure", *International Journal of Rock Mechanics and Mining Sciences*, vol. 39, 2002, pp. 477-489.
Tao, Q. et al., "A Chemo-Poro-Thermoelastic Model for Stress/Pore Pressure Analysis around a Wellbore in Shale", a paper prepared for presentation at the Symposium on Rock Mechanics (USRMS): *Rock Mechanics for Energy*, Mineral and Infrastracture Development in the Northern Regions, Jun. 2005, 7 pages.
Terra, O. et al., "Brillouin Amplification in Phase Coherent Transfer of Optical Frequencies over 480 km Fiber", publisher unknown, while the date of the publication is unknown, it is believed to be prior to Aug. 19, 2009, 9 pages.
Terzopoulos, D. et al., "Modeling Inelastic Deformation: Viscoelasticity, Plasticity, Fracture", *SIGGRAPH '88*, Aug. 1988, pp. 269-278.
Thomas, R. P., "Heat Flow Mapping at the Geysers Geothermal Field", published by the California Department of Conservation Division of Oil and Gas, 1986, 56 pages.
Thompson, G. D., "Effects of Formation Compressive Strength on Perforator Performance", a paper presented of the Southern District API Division of Production, Mar. 1962, pp. 191-197.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy* (*ISEEE*), 2008, pp. 1-14.
Tovo, R. et al., "Fatigue Damage Evaluation on Mechanical Components Under Multiaxial Loadings", excerpt from the Proceedings of the COMSOL Conference, 2009, 8 pages.
Tuler, F. R. et al., "A Criterion for the Time Dependence of Dynamic Fracture", *The International Jopurnal of Fracture Mechanics*, vol. 4, No. 4, Dec. 1968, pp. 431-437.
Turner, D. et al., "New DC Motor for Downhole Drilling and Pumping Applications", a paper prepared for presentation at the SPE/ICoTA Coiled Tubing Roundtable, Mar. 2001, pp. 1-7.
Turner, D. R. et al., "The All Electric BHA: Recent Developments Toward an Intelligent Coiled-Tubing Drilling System", a paper prepared for presentation at the 1999 SPE/ICoTA Coiled Tubing Roundtable, May 1999, pp. 1-10.
Tutuncu, A. N. et al., "An Experimental Investigation of Factors Influencing Compressional- and Shear-Wave Velocities and Attenuations in Tight Gas Sandstones", *Geophysics*, vol. 59, No. 1, Jan. 1994, pp. 77-86.
U.S. Dept of Energy, "Chapter 6—Drilling Technology and Costs", from Report for the Future of Geothermal Energy, 2005, 53 pgs.
U.S. Appl. No. 12/840,978, filed Jul. 21, 2009, 61 pgs.
Udd, E. et al., "Fiber Optic Distributed Sensing Systems for Harsh Aerospace Environments", publisher unknown, while the date of the publication is unknown, it is believed to be prior to Aug. 19, 2009, 12 pages.
Valsangkar, A. J. et al., Stress-Strain Relationship for Empirical Equations of Creep in Rocks, *Engineering Geology*, Mar. 29, 1971, 5 pages.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wagh, A. S. et al., "Dependence of Ceramic Fracture Properties on Porosity", *Journal of Material Sience*, vol. 28, 1993, pp. 3589-3593.
Wagner, F. et al., "The Laser Microjet Technology—10 Years of Development (M401)", publisher unknown, while the date of the publication is unknown, it is believed to be prior to Aug. 19, 2009, 9 pages.
Waldron, K. et al., "The Microstructures of Perthitic Alkali Feldspars Revealed by Hydroflouric Acid Etching", *Contributions to Mineralogy and Petrology*, vol. 116, 1994, pp. 360-364.
Walker, B. H. et al., "Roller-Bit Penetration Rate Response as a Function of Rock Properties and Well Depth", a paper prepared for presentation at the 61st Annual Technical Conference and Exhibition of the Society of Petroleum Engineers, Oct. 1986, 12 pages.
Wandera, C. et al., "Characterization of the Melt Removal Rate in Laser Cutting of Thick-Section Stainless Steel", *Journal of Laser Applications*, vol. 22, No. 2, May 2010, pp. 62-70.
Wandera, C. et al., "Inert Gas Cutting of Thick-Section Stainless Steel and Medium Section Aluminun Using a High Power Fiber Laser", *Journal of Chemical Physics*, vol. 116, No. 4, Jan. 22, 2002, pp. 154-161.
Wandera, C. et al., "Laser Power Requirement for Cutting of Thick-Section Steel and Effects of Processing Parameters on Mild Steel Cut Quality", a paper accepted for publication in the Proceedings IMechE Part B, *Journal of Engineering Manufacture*, vol. 225, 2011, 23 pages.
Wandera, C. et al., "Optimization of Parameters for Fiber Laser Cutting of 10mm Stainless Steel Plate", a paper for publication in the Proceeding IMechE Part B, *Journal of Engineering Manufacture*, vol. 225, 2011, 22 pages.
Wandera, C., "Performance of High Power Fibre Laser Cutting of Thick-Section Steel and Medium-Section Aluminium", a thesis for the degree of Doctor of Science (Technology) at , Lappeenranta University of Technology, Oct. 2010, 74 pages.
Wang, C. H., "Introduction to Fractures Mechanics", published by DSTO Aeronautical and Maritime Research Laboratory, Jul. 1996, 82 pages.
Wang, G. et al., "Particle Modeling Simulation of Thermal Effects on Ore Breakage", *Computational Materials Science*, vol. 43, 2008, pp. 892-901.
Waples, D. W. et al., "A Review and Evaluation of Specific Heat Capacities of Rocks, Minerals, and Subsurface Fluids. Part 1: Minerals and NonporoRocks", *Natural Resources Research*, vol. 13, No. 2, Jun. 2004, pp. 97-122.
Waples, D. W. et al., "A Review and Evaluation of Specific Heat Capacities of Rocks, Minerals, and Subsurface Fluids. Part 2: Fluids and PoroRocks", *Natural Resources Research*, vol. 13 No. 2, Jun. 2004, pp. 123-130.
Warren, T. M. et al., "Laboratory Drilling Performance of PDC Bits", *SPE Drilling Engineering*, Jun. 1988, pp. 125-135.
Wen-gui, Cao et al., "Damage constituitive model for strain-softening rock based on normal distribution and its parameter determination", *J. Cent. South Univ. Technol.*, vol. 14, No. 5, 2007, pp. 719-724.
White, E. J. et al., "Reservoir Rock Characteristics of the Madison Limestone in the Williston Basin", *The Log Analyst*, Sep.-Oct. 1970, pp. 17-25.
White, E. J. et al., "Rock Matrix Properties of the Ratcliffe Interval (Madison Limestone) Flat Lake Field, Montana", *SPE of AIME*, Jun. 1968, 16 pages.
Wiercigroch, M., "Dynamics of ultrasonic percussive drilling of hard rocks", *Journal of Sound and Vibration*, vol. 280, 2005, pp. 739-757.
Wilkinson, M. A. et al., "Experimental Measurement of Surface Temperatures During Flame-Jet Induced Thermal Spallation", *Rock Mechanics and Rock Engineering*, 1993, pp. 29-62.
Williams, R. E. et al., "Experiments in Thermal Spallation of VarioRocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Winters, W. J. et al., "Roller Bit Model with Rock Ductility and Cone Offset", a paper prepared for presentation at 62nd Annual Technical Conference and Exhibition of the Society of Petroleum Engineers, Sep. 1987, 12 pages.
Wippich, M. et al., "Tunable Lasers and Fiber-Bragg-Grating Sensors", Obatined from the at: from the Internet website of the Industrial Physicist at: http://www.aip.org/tip/INPHFA/vol-9/iss-3/p24.html, on May 18, 2010, pp. 1-5.

(56) References Cited

OTHER PUBLICATIONS

Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", *Treme Coil Drilling Corp., Drilling Technology Without Borders*, 2009, pp. 1-18.
Wu, X. Y. et al., "The Effects of Thermal Softening and Heat Conductin on the Dynamic Growth of Voids", *International Journal of Solids and Structures*, vol. 40, 2003, pp. 4461-4478.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xiao, J. Q. et al., "Inverted S-Shaped Model for Nonlinear Fatigue Damage of Rock", *International Journal of Rock Mechanics & Mining Sciences*, vol. 46, 2009, pp. 643-648.
Xu, Z et al. "Modeling of Laser Spallation Drilling of Rocks fro gas-and Oilwell Drilling", *Society of Petroleum Engineers*, SPE 95746, 2005, pp. 1-6.
Xu, Z. et al., "Application of High Powered Lasers to Perforated Completions", *International Congress on Applications of Laser & Electro-Optics*, Oct. 2003, 6 pages.
Xu, Z. et al., "Laser Rock Drilling by a Super-Pulsed CO2 Laser Beam", a manuscript created for the Department of Energy, while the date of the publication is unknown, it is believed to be prior to Aug. 19, 2009, 9 pages.
Xu, Z. et al., "Laser Spallation of Rocks for Oil Well Drilling", Proceedings of the 23rd International Congress on Applications of Lasers and Electro-Optics, 2004, pp. 1-6.
Xu, Z. et al., "Modeling of Laser Spallation Drilling of Rocks for Gas-and Oilwell Drilling", a paper prepared for the presentation at the 2005 SPE (Society of Petroleum Engineers) Annual Technical Conference and Exhibition, Oct. 2005, 6 pages.
Xu, Z. et al., "Rock Perforation by Pulsed Nd: YAG Laser", Proceedings of the 23rd International Congress on Applications of Lasers and Electro-Optics 2004, 2004, 5 pages.
Xu, Z. et al., "Specific Energy of Pulsed Laser Rock Drilling", *Journal of Laser Applications*, vol. 15, No. 1, Feb. 2003, pp. 25-30.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Xu, Zhiyue et al., "Laser Spallation of Rocks for Oil Well Drilling", *Proceedings of the 23rd International Congress on Applications of Lasers and Electro-Optics*, 2004, pp. 1-6.
Yabe, T. et al., "The Constrained Interpolation Profile Method for Multiphase Analysis", *Journal of Computational Physics*, vol. 169, 2001, pp. 556-593.
Yamamoto, K. Y. et al., "Detection of Metals in the Environment Using a Portable Laser-Induced Breakdown Spectroscopy Instrument", *Applied Spectroscopy*, vol. 50, No. 2, 1996, pp. 222-233.
Yamashita, Y. et al., "Underwater Laser Welding by 4kW CW YAG Laser", *Journal of Nuclear Science and Technology*, vol. 38, No. 10, Oct. 2001, pp. 891-895.
Yamshchikov, V. S. et al., "An Evaluation of the Microcrack Density of Rocks by Ultrasonic Velocimetric Method", *Moscow Mining Institute. (Translated from Fiziko-Tekhnicheskie Problemy Razrabotki Poleznykh Iskopaemykh)*, 1985, pp. 363-366.
Yasar, E. et al., "Determination of the Thermal Conductivity from Physico-Mechanical Properties", *Bull Eng. Geol. Environ.*, vol. 67, 2008, pp. 219-225.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated región", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
York, J. L. et al., "The Influence of Flashing and Cavitation on Spray Formation", a progress report for UMRI Project 2815 with Delavan Manufacturing Company, Oct. 1959, 27 pages.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zamora, M. et al., "An Empirical Relationship Between Thermal Conductivity and Elastic Wave Velocities in Sandstone", *Geophysical Research Letters*, vol. 20, No. 16, Aug. 20, 1993, pp. 1679-1682.
Zehnder, A. T., "Lecture Notes on Fracture Mechanics", 2007, 227 pages.
Zeng, Z. W. et al., "Experimental Determination of Geomechanical and Petrophysical Properties of Jackfork Sandstone—A Tight Gas Formation", a paper prepared for the presentation at the 6th North American Rock Mechanics Symposium (NARMS): *Rock Mechanics Across Borders and Disciplines*, Jun. 2004, 9 pages.
Zeuch, D. H. et al., "Rock Breakage Mechanisms With a PDC Cutter", a paper prepared for presentation at the 60th Annual Technical Conference and Exhibition of the Society of Petroleum Engineers, Sep. 1985, 12 pages.
Zeuch, D.H. et al., "Rock Breakage Mechanism Wirt A PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhang, L. et al., "Energy from Abandoned Oil and Gas Reservoirs", a paper prepared for presentation at the 2008 SPE (Society of Petroleum Engineers) Asia Pacific Oil & Gas Conference and Exhibition, 2008, pp. 1-10.
Zheleznov, D. S. et al., "Faraday Rotators With Short Magneto-Optical Elements for 50-kW Laser Power", *IEEE Journal of Quantum Electronics*, vol. 43, No. 6, Jun. 2007, pp. 451-457.
Zhou, T. et al., "Analysis of Stimulated Brillouin Scattering in Multi-Mode Fiber by Numerical Solution", *Journal of Zhejiang University of Science*, vol. 4 No. 3, May-Jun. 2003, pp. 254-257.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", *National Aeronautics and Space Administration, Glenn Research Center*, NASA/TM-2000-210237, 2000, pp. 1-22.
Zhu, X. et al., "High-Power ZBLAN Glass Fiber Lasers: Review and Prospect", *Advances in OptoElectronics*, vol. 2010, pp. 1-23.
Zietz, J. et al., "Determinants of House Prices: A Quantile Regression Approach", *Department of Economics and Finance Working Paper Series*, May 2007, 27 pages.
Zuckerman, N. et al., "Jet Impingement Heat Transfer: Physics, Correlations, and Numerical Modeling", *Advances in Heat Transfer*, vol. 39, 2006, pp. 565-631.

(56) References Cited

OTHER PUBLICATIONS

A Built-for-Purpose Coiled Tubing Rig, by Schulumberger Wells, No. DE-PS26-03NT15474, 2006, 1 pg.
"Chapter I - Laser-Assisted Rock-Cutting Tests", publisher unknown, while the date of the publication is unknown, it is believed to be prior to Aug. 19, 2009, 64 pages.
"Chapter 7: Energy Conversion Systems—Options and Issues", publisher unknown, while the date of the publication is unknown, it is believed to be prior to Aug. 19, 2009, pp. 7-1 to 7-32 and table of contents page.
"Cross Process Innovations", Obtained from the Internet at: http://www.mrl.columbia.edu/ntm/CrossProcess/CrossProcessSect5.htm, on Feb. 2, 2010, 11 pages.
"Fourier Series, Generalized Functions, Laplace Transform", publisher unknown, while the date of the publication is unknown, it is believed to be prior to Aug. 19, 2009, 6 pages.
"Introduction to Optical Liquids", published by Cargille-Sacher Laboratories Inc., Obtained from the Internet at: http://www.cargille.com/opticalintro.shtml, on Dec. 23, 2008, 5 pages.
"Laser Drilling", Oil & Natural Gas Projects (Exploration & Production Technologies) Technical Paper, Dept. of Energy, Jul. 2007, 3 pages.
"Leaders in Industry Luncheon", IPAA & TIPRO, Jul. 8, 2009, 19 pages.
"Measurement and Control of Abrasive Water-Jet Velocity", publisher unknown, while the date of the publication is unknown, it is believed to be prior to Aug. 19, 2009, 8 pages.
"NonhomogeneoPDE—Heat Equation with a Forcing Term", a lecture, 2010, 6 pages.
"Performance Indicators for Geothermal Power Plants", prepared by International Geothermal Association for World Energy Council Working Group on Performance of Renewable Energy Plants, author unknown, Mar. 2011, 7 pages.
"Rock Mechanics and Rock Engineering", publisher unknown, while the date of the publication is unknown, it is believed to be prior to Aug. 19, 2009, 69 pages.
"Shock Tube", Cosmol MultiPhysics 3.5a, 2008, 5 pages.
"Silicone Fluids: Stable, Inert Media", Gelest, Inc., while the date of the publication is unknown, it is believed to be prior to Aug. 19, 2009, 27 pages.
"Stimulated Brillouin Scattering (SBS) in Optical Fibers", Centro de Pesquisa em Optica e Fotonica, Obtained from the Internet at: http://cepof.ifi.unicamp.br/index.php . . . ), on Jun. 25, 2012, 2 pages.
"Underwater Laser Cutting", TWI Ltd, May/Jun. 2011, 2 pages.
U.S. Appl. No. 13/768,149, filed Feb. 15, 2013, 27 pages.
U.S. Appl. No. 13/777,650, filed Feb. 26, 2013, 73 pages.
U.S. Appl. No. 13/782,869, filed Mar. 1, 2013, 80 pages.
U.S. Appl. No. 13/782,942, filed Mar. 1, 2013, 81 pages.
U.S. Appl. No. 13/800,559, filed Mar. 13, 2013, 73 pages.
U.S. Appl. No. 13/800,820, filed Mar. 13, 2013, 73 pages.
U.S. Appl. No. 13/800,879, filed Mar. 13, 2013, 73 pages.
U.S. Appl. No. 13/800,933, filed Mar. 13, 2013, 73 pages.
U.S. Appl. No. 13/849,831, filed Mar. 25, 2013, 83 pages.
U.S. Appl. No. 13/852,719, filed Mar. 28, 2013, 85 pages.

* cited by examiner

HIGH POWER LASER-MECHANICAL DRILLING BIT AND METHODS OF USE

This application: (i) claims, under 35 U.S.C. §119(e)(1), the benefit of the filing date of Feb. 24, 2011 of U.S. provisional application Ser. No. 61/446,043; (ii) claims, under 35 U.S.C. §119(e)(1), the benefit of the filing date of Feb. 24, 2011 of U.S. provisional application Ser. No. 61/446,312; (iii) claims, under 35 U.S.C. §119(e)(1), the benefit of the filing date of Feb. 24, 2011 of U.S. provisional application Ser. No. 61/446,040; (iv) claims, under 35 U.S.C. §119(e)(1), the benefit of the filing date of Feb. 24, 2011 of U.S. provisional application Ser. No. 61/446,041; (v) claims, under 35 U.S.C. §119(e)(1), the benefit of the filing date of Feb. 24, 2011 of U.S. provisional application Ser. No. 61/446,042; (vi) is a continuation-in-part of U.S. patent application Ser. No. 12/544,038 filed Aug. 19, 2009, now U.S. Pat. No. 8,820,434 which claims under 35 U.S.C. §119(e)(1) the benefit of the filing date of Feb. 17, 2009 of U.S. provisional application Ser. No. 61/153,271, the benefit of the filing date of Oct. 17, 2008 of U.S. provisional application Ser. No. 61/106,472, the benefit of the filing date of Oct. 3, 2008 of U.S. provisional application Ser. No. 61/102,730, and the benefit of the filing date of Aug. 20, 2008 of U.S. provisional application Ser. No. 61/090,384; (vii) is a continuation-in-part of U.S. patent application Ser. No. 12/543,968 filed Aug. 19, 2009 now U.S. Pat. No. 8,636,085; (viii) is a continuation-in-part of U.S. patent application Ser. No. 12/543,986 filed Aug. 19, 2009, now U.S. Pat. No. 8,826,973 which claims under 35 U.S.C. §119(e)(1) the benefit of the filing date of Feb. 17, 2009 of U.S. provisional application Ser. No. 61/153,271, the benefit of the filing date of Oct. 17, 2008 of U.S. provisional application Ser. No. 61/106,472, the benefit of the filing date of Oct. 3, 2008 of U.S. provisional application Ser. No. 61/102,730, and the benefit of the filing date of Aug. 20, 2008 of U.S. provisional application Ser. No. 61/090,384, the entire disclosures of each of which are incorporated herein by reference.

This invention was made with Government support under Award DE-AR0000044 awarded by the Office of ARPA-E U.S. Department of Energy. The Government has certain rights in this invention.

BACKGROUND OF THE INVENTION

Field of the Invention

The present inventions relate to drilling tools that utilize high power laser beams and mechanical members to advance a borehole. Thus, and in particular, the present inventions relate to novel laser-mechanical drilling assemblies, such as drill bits, that provide for the delivery of high power laser energy in conjunction with mechanical forces to a surface, such as the end of a borehole, to remove material from the surface.

As used herein, unless specified otherwise, the term "earth" should be given its broadest possible meaning, and includes, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

As used herein, unless specified otherwise, the term "borehole" should be given it broadest possible meaning and includes any opening that is created in a material, a work piece, a surface, the earth, a structure (e.g., building, protected military installation, nuclear plant, offshore platform, or ship), or in a structure in the ground, (e.g., foundation, roadway, airstrip, cave or subterranean structure) that is substantially longer than it is wide, such as a well, a well bore, a well hole, a micro hole, slimhole, a perforation and other terms commonly used or known in the arts to define these types of narrow long passages. Wells would further include exploratory, production, abandoned, reentered, reworked, and injection wells. Although boreholes are generally oriented substantially vertically, they may also be oriented on an angle from vertical, to and including horizontal. Thus, using a vertical line, based upon a level as a reference point, a borehole can have orientations ranging from 0° i.e., vertical, to 90°,i.e., horizontal and greater than 90° e.g., such as a heel and toe and combinations of these such as for example "U" and "Y" shapes. Boreholes may further have segments or sections that have different orientations, they may have straight sections and arcuate sections and combinations thereof; and for example may be of the shapes commonly found when directional drilling is employed. Thus, as used herein unless expressly provided otherwise, the "bottom" of a borehole, the "bottom surface" of the borehole and similar terms refer to the end of the borehole, i.e., that portion of the borehole furthest along the path of the borehole from the borehole's opening, the surface of the earth, or the borehole's beginning. The terms "side" and "wall" of a borehole should to be given their broadest possible meaning and include the longitudinal surfaces of the borehole, whether or not casing or a liner is present, as such, these terms would include the sides of an open borehole or the sides of the casing that has been positioned within a borehole. Boreholes may be made up of a single passage, multiple passages, connected passages and combinations thereof, in a situation where multiple boreholes are connected or interconnected each borehole would have a borehole bottom. Boreholes may be formed in the sea floor, under bodies of water, on land, in ice formations, or in other locations and settings.

Boreholes are generally formed and advanced by using mechanical drilling equipment having a rotating drilling tool, e.g., a bit. For example and in general, when creating a borehole in the earth, a drilling bit is extending to and into the earth and rotated to create a hole in the earth. In general, to perform the drilling operation the bit must be forced against the material to be removed with a sufficient force to exceed the shear strength, compressive strength or combinations thereof, of that material. Thus, in conventional drilling activity mechanical forces exceeding these strengths of the rock or earth must be applied. The material that is cut from the earth is generally known as cuttings, e.g., waste, which may be chips of rock, dust, rock fibers and other types of materials and structures that may be created by the bit's interactions with the earth. These cuttings are typically removed from the borehole by the use of fluids, which fluids can be liquids, foams or gases, or other materials know to the art.

As used herein, unless specified otherwise, the term "advancing" a borehole should be given its broadest possible meaning and includes increasing the length of the borehole. Thus, by advancing a borehole, provided the orientation is not horizontal, e.g., less than 90° the depth of the borehole may also be increased. The true vertical depth ("TVD") of a borehole is the distance from the top or surface of the borehole to the depth at which the bottom of the borehole is located, measured along a straight vertical line. The measured depth ("MD") of a borehole is the distance as measured along the actual path of the borehole from the top or surface to the bottom. As used herein unless specified otherwise the term depth of a borehole will refer to MD. In general, a point of reference may be used for the top of the borehole, such as the rotary table, drill floor, well head or initial opening or surface of the structure in which the borehole is placed.

As used herein, unless specified otherwise, the terms "ream", "reaming", a borehole, or similar such terms, should be given their broadest possible meaning and includes any activity performed on the sides of a borehole, such as, e.g., smoothing, increasing the diameter of the borehole, removing materials from the sides of the borehole, such as e.g., waxes or filter cakes, and under-reaming.

As used herein, unless specified otherwise, the terms "drill bit", "bit", "drilling bit" or similar such terms, should be given their broadest possible meaning and include all tools designed or intended to create a borehole in an object, a material, a work piece, a surface, the earth or a structure including structures within the earth, and would include bits used in the oil, gas and geothermal arts, such as fixed cutter and roller cone bits, as well as, other types of bits, such as, rotary shoe, drag-type, fishtail, adamantine, single and multi-toothed, cone, reaming cone, reaming, self-cleaning, disc, three-cone, rolling cutter, crossroller, jet, core, impreg and hammer bits, and combinations and variations of the these.

In general, in a fixed cutter bit there are no moving parts. In these bits drilling occurs when the entire bit is rotated by, for example, a rotating drill string, a mud motor, or other means to turn the bit. Fixed cutter bits have cutters that are attached to the bit. These cutters mechanically remove material, advancing the borehole as the bit is turned. The cutters in fixed cutter bits can be made from materials such as polycrystalline diamond compact ("PDC"), grit hot-pressed inserts ("GHI"), and other materials known to the art or later developed by the art.

In general, a roller cone bit has one, two, three or more generally conically shaped members, e.g., the roller cones, that are connected to the bit body and which can rotate with respect to the bit. Thus, as the bit is turned, and the cones contact the bottom of a borehole, the cones rotate and in effect roll around the bottom of the borehole. In general, the cones have, for example, tungsten carbide inserts ("TCI") or milled teeth ("MT"), which contact the bottom, or other surface, of the borehole to mechanically remove material and advance the borehole as the bit it turned.

In both roller cone, fixed bits, and other types of mechanical drilling the state of the art, and the teachings and direction of the art, provide that to advance a borehole great force should be used to push the bit against the bottom of the borehole as the bit is rotated. This force is referred to as weight-on-bit ("WOB"). Typically, tens of thousands of pounds WOB are used to advance a borehole using a mechanical drilling process.

Mechanical bits cut rock by applying crushing (compressive) and/or shear stresses created by rotating a cutting surface against the rock and placing a large amount of WOB. In the case of a PDC bit this action is primarily by shear stresses and in the case of roller cone bits this action is primarily by crushing (compression) and shearing stresses. For example, the WOB applied to an 8¾" PDC bit may be up to 15,000 lbs, and the WOB applied to an 8¾" roller cone bit may be up to 60,000 lbs. When mechanical bits are used for drilling hard and ultra-hard rock excessive WOB, rapid bit wear, and long tripping times result in an effective drilling rate that is essentially economically unviable. The effective drilling rate is based upon the total time necessary to complete the borehole and, for example, would include time spent tripping in and out of the borehole, as well as, the time for repairing or replacing damaged and worn bits.

As used herein, unless specified otherwise, the term "drill pipe" should be given its broadest possible meaning and includes all forms of pipe used for drilling activities; and refers to a single section or piece of pipe, as well as, multiple pipes or sections. As used herein, unless specified otherwise, the terms "stand of drill pipe," "drill pipe stand," "stand of pipe," "stand" and similar type terms should be given their broadest possible meaning and include two, three or four sections of drill pipe that have been connected, e.g., joined together, typically by joints having threaded connections. As used herein, unless specified otherwise, the terms "drill string," "string," "string of drill pipe," string of pipe" and similar type terms should be given their broadest definition and would include a stand or stands joined together for the purpose of being employed in a borehole. Thus, a drill string could include many stands and many hundreds of sections of drill pipe.

As used herein, unless specified otherwise, the term "tubular" should be given its broadest possible meaning and includes drill pipe, casing, riser, coiled tube, composite tube, vacuum insulated tubing ("VIT"), production tubing and any similar structures having at least one channel therein that are, or could be used, in the drilling industry. As used herein the term "joint" should be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of tubular is the thickness of the material between the internal diameter of the tubular and the external diameter of the tubular.

As used herein, unless specified otherwise "high power laser energy" means a laser beam having at least about 1 kW (kilowatt) of power. As used herein, unless specified otherwise "great distances" means at least about 500 m (meter). As used herein the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

SUMMARY

There has been a long standing need in the drilling arts, to increase the life of drill bits, to increase the ability of drill bits to penetrate hard and very hard rock, and to among other things increase the overall ability to create boreholes, such as for example, in the areas of hydrocarbon and geothermal exploration and production. The present inventions meet these and other needs by providing the laser-mechanical bits and methods of use set forth in these specifications. The present inventions, among other things, solve these needs by providing the articles of manufacture, devices and processes taught herein.

Thus, there is provided a flat bottom fixed cutter laser-mechanical bit having: a bottom section having a central axis, a width and a flat bottom end, in this manner the bottom end is configured to engage a borehole surface; a beam path channel defined, in part, by a plurality of beam blades, in this manner the beam path channel extends across the width of the flat bottom end of the bottom section and through the central axis; a plurality of cutter blades; and, the cutter blades and the beam blades each having a lower end; in this manner, the lower ends are configured to be essentially coplanar, thereby defining the flat bottom end; so that, the bit is capable of laser-mechanical drilling an essentially flat bottom borehole.

Additionally, there are provided laser-mechanical bits that may also include: the beam blades with a first and second pair of blades; a means for limiting the depth of cut, e.g., depth of cut limiters; the means for limiting the depth of cut, the beam blades and the cutter blades have substantially the same height; the means for limiting the depth of cut has a greater height than the beam blades and the cutter blades; the bottom section width is at least about 6 inches; and the beam blades have a height of at least about ½ inch and a width of at least about 2¾ inches; the bottom section width is at least about 4 inches; and the beam blades have a height of at least about ¼ inch and a width of at least about 1¾ inches; having a beam blade passage in fluid communication with a junk slot; the beam path channel has a beam path slot in a side surface of the bottom section; having a body section associated with the bottom section; and a beam path slot in a side surface of the bottom section and extending into a side surface of the body section; the beam path channel has a beam path slot in a side surface of the bottom section; the beam path channel has a beam path slot in a side surface of the bottom section; a beam path angle of greater than about 90 degrees; a beam path angle of from about 90 degrees to about 135 degrees; beam path angle of about 90 degrees; and a beam path angle of about 135 degrees; a beam path angle of less than about 150 degrees.

Yet further, there is provided a laser-mechanical drilling bit having: a body section associated with a bottom section, the bottom section having a bottom end and an outside surface; a bit having an axis, a length, and a width, in this manner the body section and the bottom section are associated along the axis, so that a bottom end of the bottom section defines the bit bottom end; a laser beam path extending longitudinally through the bit along the axis, extending across an entire width of the bit bottom end and though a bottom portion of the outside surface; a cutter blade having a cutter; and, the cutter blade and the beam path defining an angle from about 90 to about 135 degrees.

Moreover, there are provided laser-mechanical bits that may also include: the body section and the bottom section being unitary, or a unitary structure; the body section and the bottom section are welded together; and, the body section and the bottom section are bolted together.

Furthermore, there is provided a laser-mechanical bit that has a bit body section and bottom section, the bottom section having two beam blades, defining a portion of a beam path channel and a portion of a beam path slot and, means for boring with mechanical force.

Yet additionally, there is provided a laser-mechanical bit that has a bit body section and bottom section, the bottom section having two beam blades, defining a portion of a beam path channel and a portion of a beam path slot and, means for boring with mechanical force, in which the means for boring has a pair of blades each having a cutter; a beam blade has an inner surface and an outer surface, in this manner the inner surface defines an inner plane and outer surface defines an outer plane; in this manner the inner plane is adjacent a laser beam path and in this manner the outer plane is removed from the laser beam path; and at least a portion of the cutter is positioned within the inner plane.

Moreover, there are provided laser-mechanical bits that may also include: a fixed cutter; a PDC cutter; a roller cone; a roller cone with a domed insert; a roller cone with a conical insert; a roller cone with a milled tooth.

Additionally, there is provide a laser-mechanical drilling bit for advancing a borehole in the earth, the bit having: a body characterized by a bottom end configured for engagement with a borehole surface; a beam path channel containing a laser beam path; in this manner the beam path channel divides the bottom end into a first and a second section; the first bottom end section having a beam blade, a cutter blade, and a means for limiting the depth of cut; and, the second bottom end section having a beam blade, a cutter blade, and a means for limiting the depth of cut.

Moreover, there is provided a laser-mechanical drilling bit for advancing a borehole in the earth, the bit having: a body characterized by a bottom end configured for engagement with a borehole surface; a beam path channel; in this manner the beam path channel divides the bottom end into a first and a second section; a beam path slot having an angled end, in this manner the beam path slot is in optical and fluid communication with the beam path channel; the first bottom end section having a beam blade, a plurality of cutter blades, and a means for limiting the depth of cut; and, the second bottom end section having a beam blade, a plurality of cutter blades, and a means for limiting the depth of cut.

Still additionally, there is provided a laser-mechanical drilling bit for advancing a borehole in the earth, the bit having: a body characterized by a bottom end and a central axis of rotation, in this manner the bottom end is configured for engagement with a borehole surface; a beam path contained within a channel; in this manner the beam path divides the bottom end into a first and a second section; the first bottom end section having a beam blade, a cutter blade, and a means for limiting the depth of cut; the second bottom end section having a beam blade, a cutter blade, and a means for limiting the depth of cut; the first bottom end section cutter blade having a plurality of cutters, and the second bottom end section cutter blade having a plurality of cutters; and, the cutters positioned with respect to the central axis of rotation, so that during rotation and deliver of a laser beam through the beam path to a surface of the borehole, each cutter will contact a laser-affected surface.

Still further, there are provided laser-mechanical bits that may also include: a plurality of first bottom end section cutter blades and a plurality of second bottom end section cutter blades; at least 6 cutters; at least 10 cutters; at least 12 cutters; a first and a second set of juxtaposed blades; and a cutter positioned adjacent to the beam path channel.

Moreover, there is provided a method of advancing a borehole in hard rock formations using fixed cutters as a means for mechanically removing material, by lowering a laser-mechanical bit into a borehole in a hard rock formation; the bit having a first blade defining, in part, a beam path channel and a second blade having a cutter having a thermal degradation temperature; and, laser-mechanical drilling by delivering at least 20 kW of laser power through the beam path channel along a laser beam path to the bottom of the borehole while rotating the bit with less than about 5000 lbs weight on bit; and, maintaining the temperature of the cutter during laser mechanical drilling below the thermal degradation temperature; so that the borehole is advanced at a rate of at least about 5 ft/hr, at least about 10 ft/hr, at least about 20 ft/hr.

Yet still further, there are provided laser-mechanical drilling methods that may also include: drilling in a formation having a hardness of at least 20 ksi; drilling with weight on bit is less than about 2,000 lbs; utilizing a laser beam having a laser power is at least about 40 kW, and at least about 80 kW; and, keeping the cutter temperature maintained below about 400° C., maintained below about 200° C.

Additionally, there is provided a method of laser cooling cutters while drilling, the method including: positioning a laser-mechanical bit in a borehole, the bit having a beam path channel and a plurality of cutters; advancing the borehole by rotating the cutters against a surface of the borehole; and, cooling the temperature of the cutters though the delivery of at least about 15 kW of laser power through the beam path channel along a laser beam path.

Moreover, there is provided a method of advancing a borehole in the earth by following a laser beam with mechanical cutters, by: providing a laser beam along a laser beam path in a laser beam pattern through a laser-mechanical drill bit to a bottom surface of a borehole; moving the laser beam pattern over the bottom surface of the borehole to create a laser-affected material, following the laser beam pattern with a first and a second cutter, in this manner the first and second cutter remove essentially only laser-affected material.

Furthermore, there is provided a method of advancing a borehole in the earth by following and leading a laser beam with mechanical cutters, the method having step including: providing a laser beam through a beam path channel in a laser-mechanical drill bit to a bottom surface of a borehole; rotating the laser beam on the bottom surface of the borehole to create a laser-affected material, following a portion of the laser beam with a first cutter, leading a portion of the laser beam with a second cutter, so that the first and second cutter remove essentially only laser-affected material.

Yet further, there is provided a fixed cutter laser-mechanical bit having: a bottom section having a central axis, a width and a bottom end, in this manner the bottom end is configured to engage a borehole surface; a beam path channel defined, in part, by a plurality of beam blades, in this manner the beam path channel extends partway across the width of the bottom end of the bottom section to about the central axis; a mechanical removal device; and, a beam path angle of from about 180 degrees to about 315 degrees, which also may include having the beam path angle is from about 260 degrees to about 280 degrees.

Moreover, there is provided a laser-mechanical bit having: a plurality of beam blades configured to engage a borehole surface; a beam path channel defined, in part, by the plurality of beam blades; a plurality of cutter blades; and, the cutter blades and the beam blades each having a lower end, in this manner, the lower ends are configured to define a bottom end; and, so that, the bit is capable of laser-mechanical drilling a borehole.

Furthermore, there is provided a laser-mechanical bit having: a plurality of beam blades configured to engage a borehole surface; a beam path channel defined, in part, by the plurality of beam blades; a plurality of cutter blades; and, the cutter blades and the beam blades each having a lower end, in this manner, the lower ends are configured to define a bottom end; and, so that, the bit is capable of laser-mechanical drilling a borehole, in which the beam path channel contains a laser beam path for a high power laser beam to strike the borehole surface.

Yet still additionally, there is also provided a laser-mechanical bit having: a plurality of beam blades configured to engage a borehole surface; a beam path channel defined, in part, by the plurality of beam blades; a plurality of cutter blades; and, the cutter blades and the beam blades each having a lower end, in this manner, the lower ends are configured to define a bottom end; and, so that, the bit is capable of laser-mechanical drilling a borehole, in which the plurality of cutter blades and the beam path channel define an angle that ranges from about 90 degrees to about 150 degrees.

DESCRIPTION OF THE PREFERRED EMBODIMENTS

Figure 1A:
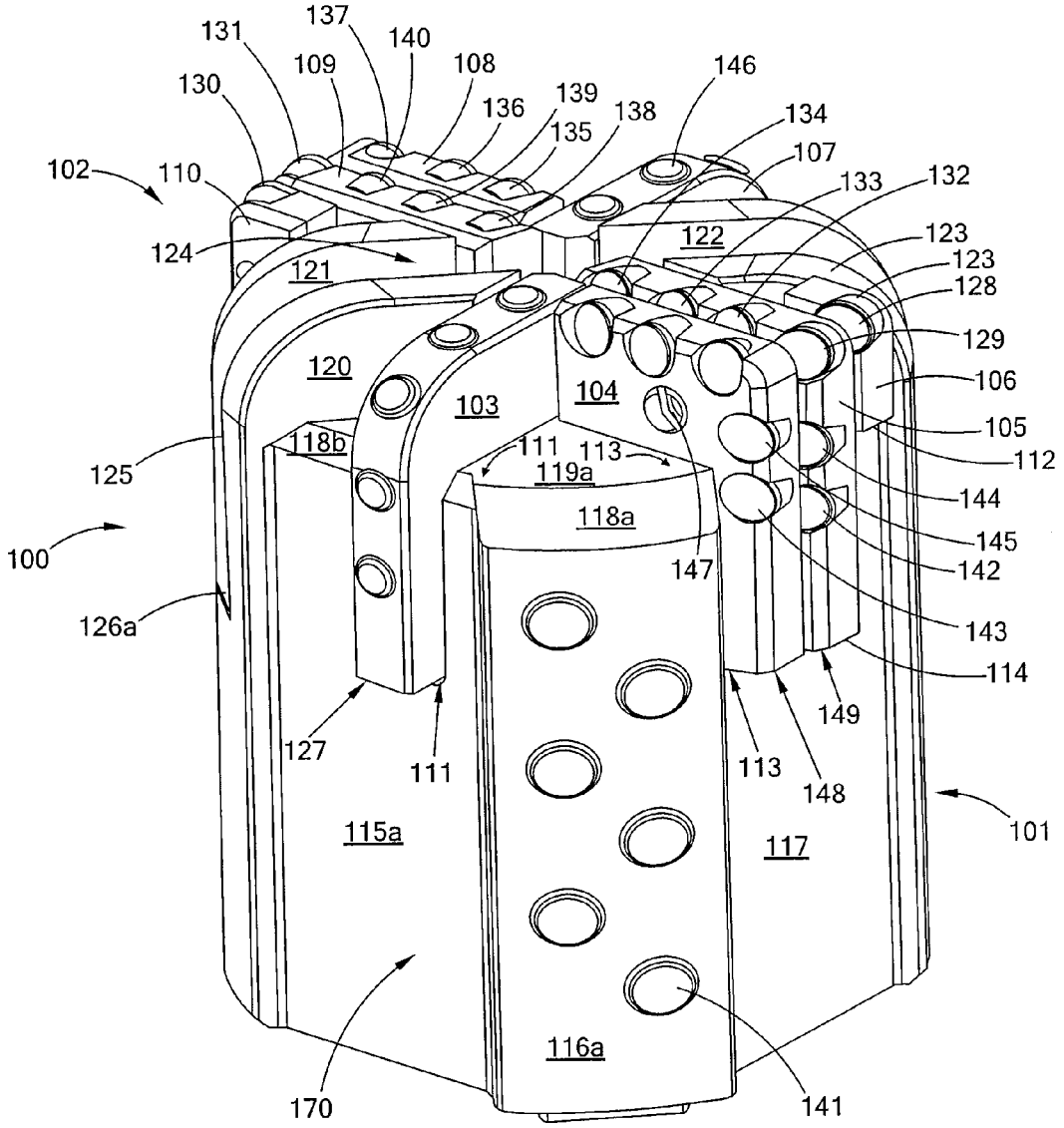
FIG. 1A is a perspective view of an embodiment of a fixed cutter laser-mechanical bit in accordance with the present invention.

The present inventions relate to laser-mechanical drill bits, which bits can be used in conjunction high power laser beams. These laser-mechanical bits may have uses in forming boreholes in many different types of materials and structures, such as metal, stone, composites, concrete, the earth and structures in the earth. In particular, these laser-mechanical bits may find preferable uses in situations and environments where advancing a borehole with conventional, e.g., non-laser, technology was difficult or impossible, because of, for example, formation hardness or other formation or rock characteristics, the remoteness of the area where the borehole was to be advanced, difficult environmental conditions or other factors that placed great, and at times insurmountable burdens on conventional drilling technology. These laser-mechanical bits also find preferable uses in situations where reduced noise and vibrations, compared to conventional technology, are desirable or a requisite.

In general, and using an earth boring application as a general illustration, a laser-mechanical bit may have a bit body section and a bottom section. The body section may be made from a single piece or it may be made from one or more pieces that are attached together, such as by bolts, welds or other fastening means known to the art. The bottom section may have, for example, blades having PDC cutters, roller cones or other structures that are used to provide a mechanical force, e.g., a compressive and/or shear force to the surface to be cut. The body section and the bottom section may be made from any hard and durable material that would meet the requirements of the intended drilling environment and conditions. Although these sections are named as individual components, it should be understood that they may be separate, removably attached, integral, one piece, or be portions of a single bit that perform the functions of such sections.

The body section of the bit may be made from any hard and durable material that meets the requirements for the particular drilling environment and conditions, such as, temperature, anticipated WOB, torque and the material properties of the substance to be removed from the borehole, such as hardness and abrasiveness of a rock layer in the earth. The body section and the bottom section may be one piece, they may be separate pieces, or they may be interconnected by other components or structures. Thus, these two sections may be affixed by way of welds, pressure fits, brazing, bearing assemblies and other manners of attachment known to those of skill in the art and which would be suitable for the type of sections and the requirements of the intended drilling environment and conditions.

The laser-mechanical drill bit may also contain, within, on, or associated with, the body section, the bottom section or both, one or more laser beam paths, one or more fluid flow outlets, one or more gauge control devices, one or more waist removal passages, or combinations of one or more of the foregoing. The laser-mechanical drill bit may also contain other structures and passages for different purposes, such as analysis of materials, monitoring of bit conditions, such as, temperature, monitoring of laser beam conditions, cooling of the bit components and other structures and purposes known to those of skill in the art.

In general, the body section of the laser-mechanical drilling bit is optically associated with a source for providing a high power laser beam and is mechanically associated with a source for providing rotational movement. In these methods, systems and applications, the laser beam, or beams, may for example have 10 kW, 20 kW, 40 kW, 80 kW or more power; and have a wavelength in the range of from about 445 nm (nanometers) to about 2100 nm, preferably in the range of from about 800 to 1900 nm, and more preferably in the ranges of from about 1530 nm to 1600 nm, from about 1060 nm to 1080 nm, and from about 1800 nm to 1900 nm. Further, the types of laser beams and sources for providing a high power laser beam may be the devices, systems, optically fibers and beam shaping and delivery optics that are disclosed and taught in the following US Patent Applications and US Patent Application Publications Publication No. U.S. 2010/0044106, Publication No. U.S. 2010/0044105, Publication No. U.S. 2010/0044103, Publication No. U.S. 2010/0044102, Publication No. U.S. 2010/0215326, Publication No. 2012/0020631, Ser. No. 13/210,581 and Ser. No. 61/493,174, the entire disclosures of each of which are incorporated herein by reference. The source for providing rotational movement may be a string of drill pipe rotated by a top drive or rotary table, a down hole mud motor, a down hole turbine, a down hole electric motor, and, in particular, may be the systems and devices disclosed in the following US Patent Applications and US Patent Application Publications: Publication No. U.S. 2010/0044106, Publication No. U.S. 2010/0044104, Publication No. U.S. 2010/0044103, Ser. No. 12/896,021, Ser. No. 61/446,042 and Ser. No. 13/211,729, the entire disclosures of each of which are incorporated herein by reference. The high power lasers for example may be fiber lasers or semiconductor lasers having 10 kW, 20 kW, 50 kW or more power and, which emit laser beams with wavelengths preferably in about the 1064 nm range, about the 1070 nm range, about the 1360 nm range, about the 1455 nm range, about the 1550 nm range, about the 1070 nm range, about the 1083 nm range, or about the 1900 nm range (wavelengths in the range of 1900 nm may be provided by Thulium lasers). Thus, by way of example, and based upon the forgoing patent applications there is contemplated the use of 4, 5, or 6 20 kW lasers to provide a laser beam in the beam path of the bit having greater than about 60 kW, greater than about 70 kW, greater than about 80 kW, greater than about 90 kW and greater than about 100 kW. One laser may also be envisioned to provide these higher laser powers.

Figure 1B:
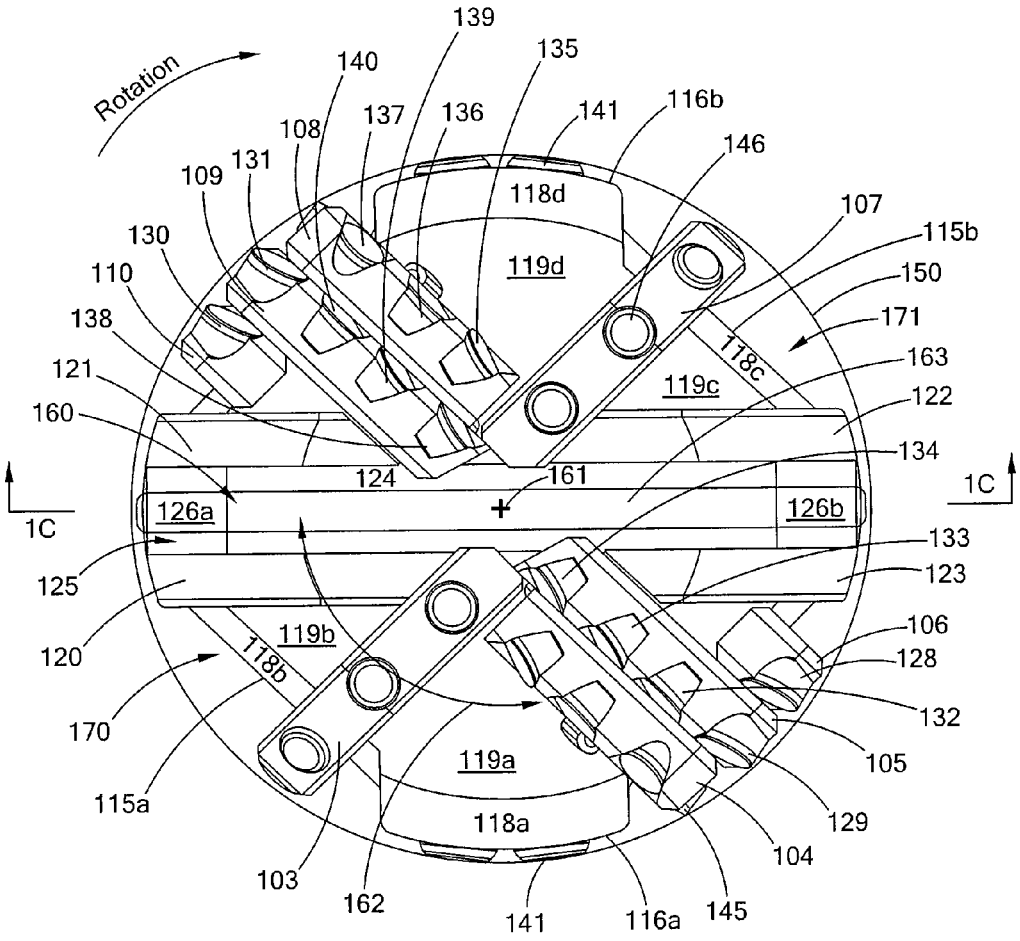
FIG. 1B is a bottom view of the bit of FIG. 1A, within a borehole.
Figure 1C:
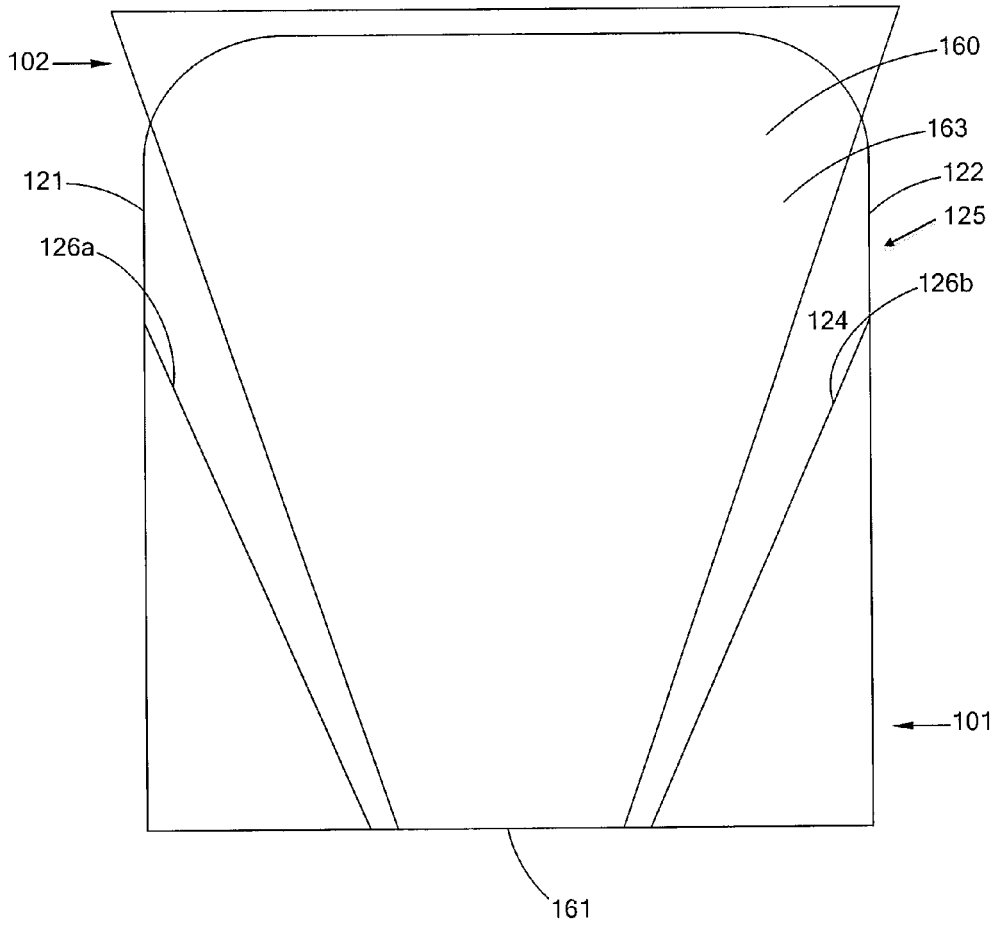
FIG. 1C is a cross section view of the bit of FIGS. 1A and 1B taken along line 1C-1C.

In FIGS. 1A, 1B and 1C there is shown views of an embodiment of a fixed cutter type laser-mechanical bit. Thus, there is provided a laser-mechanical bit 100 having a body section 101 and a bottom section 102. The bottom section 102 has mechanical blades 103, 104, 105, 106, 107, 108, 109, and 110.

The bit body 101 may have a receiving slot for each mechanical blade. For example, in FIG. 1A receiving slots, 111, 112, 113, are 114 are identified. Note that with respect to blades, of the type shown as blades 108, 109 and 110, the receiving slots may be joined or partially joined, into a unitary opening. The bit body 101 has side surfaces or areas, e.g., 115*a*, 115*b*, 117 in which the blade receiving slots are formed. The bit body 101 has surfaces or areas, e.g., 116*a*, 116*b* for supporting gauge pads, e.g., 141. The bit body 101 further has surfaces 119*a*, 119*b*, 119*c*, 119*d*, that in this embodiment are substantially normal to the surfaces 115*a*, 115*b*, 116*a*, 116*b*, which surfaces 115*a*, 115*b*, have part of the blade receiving slots formed therein. The surface 119 *a*, 119*b*, 119*c*, 119*d* are connected to surfaces 115*a*, 115*b*, 116*a*, 116*b* by angled surfaces or areas 118*a*, 118*b*, 118*c*, 118*d*.

The bit is further provided with beam blades, 120, 121, 122, 123. In this embodiment the beam blades are positioned along essentially the entirely of the width of the bit 100 and merge at the end 126 of beam path slot 125 into a unitary structure. The inner surfaces or sides of the beam blades form, in part, slot 125. The outer surfaces or sides of the beam blades also form a sidewall for the junk slots, e.g., 170. Thus, the beam blades are positioned in both the bit body section 101 and the bottom section 102. Other positions and configurations of the beam blades are contemplated. In the embodiment of FIGS. 1A and 1B the bottom of the beam blades is located at about the same level as the depth of cut limiters, e.g., 146, that are located on blades 103, 107, i.e. depth of cut blades, and slightly below the bottom of the cutters, e.g., 134. As used herein "bottom" refers to the section of the bit that is intended to engage or be closest to the bottom of a borehole, and top of the bit refers to the section furthers away from the bottom. The distance between the top and the bottom of the bit would be the bit length, or longitudinal dimension; and the width would be the dimension transverse to the length, e.g., the outside diameter of the bit, as used herein unless specified otherwise.

The longitudinal position of the bottom of the beam blades with respect to the cutters and any depth of cut limiters, e.g., the beam blades relative proximity to the bottom of the borehole, may be varied in each bit design and configuration and will depend upon factors such as the power of the laser beam, the type of rock or earth being drilled, the flow of and type of fluid used to keep the beam path clear of cuttings and debris. In general it is preferable that the longitudinal positing of the bottoms of the beam blades, any depth of cut limiter blades and the cutter blades all be relatively close, as shown in FIG. 1A, although other positions and configurations are envisioned.

The differences in the longitudinal position of the bottom of the beam blades and the cutter blades may be from about 0 inches to about 0.5 inches, about 0.1 inches to about 0.4 inches and preferably less than about 0.3 inches, about most preferably about 0.25 inches.

A beam path channel 124 is formed in the bit, and is bordered, in part, by the inner surfaces or sides of the beam blades 120, 121, 122, 123 and the inner ends of blades 103, 105, 107 and 109. The laser beam 160, having a beam pattern 163 would travel along a laser beam path, in beam path channel 124, and exit the beam path channel 124 continuing along the beam path until striking a working surface, such as a surface of a borehole. The laser beam path, and beam pattern 163, also extends from the side of the bit through slot 125. In this manner a side and/or the gauge of the borehole can be struck by the laser beam 160. In this embodiment the beam path channel 124 extends through the center axis 161 of the bit and divides the bit into two separate sections, as more clearly seen in FIG. 1B. Thus, it is preferable that the structures and their configuration on one side of the beam path channel 124, be similar, and more preferably the same, as the structures on the other side of the beam path channel 124, which is the case for this embodiment. This positioning and configuration is preferred, although other positions and configurations are contemplated. The beam path channel 124 is generally defined by the beam blades, their inner surfaces, and the beam path slot ends and potentially other inner surfaces or structures of the bit. These surfaces or structures define, or form, a channel (or at least a part of a channel), for the laser beam 160 (it its laser beam pattern 163) to travel through the bit along the laser beam path to the borehole surface. These surfaces and structures defining the beam path channel 124 should be removed from and not in the laser beam 160 and the laser beam pattern 163. The shape and size of the beam path channel may be based upon the calculated laser beam pattern that a particular set of optics may provide. Preferably, the beam path channel 124 should be close to, and as close as possible to, but not touch the laser beam and the laser beam pattern. When using high power laser energy, and in particular laser energy greater than 5 kW, 10 kW, 20 kW, 40 kW, 80 kW and greater, if the laser beam 160, which is propagated along a beam path in a beam pattern 163, contacts a blade it will melt or otherwise remove that section of the blade in the beam path (figuratively, the laser beam may cut a new beam path channel to conform with the beam path and beam pattern) and potentially damage the remaining section of the blade, bit, or other bit structure or component that is struck by the laser beam.

The beam path channel 124 in this embodiment also serves as a fluid path for a fluid, such as air, nitrogen, or a transmissive, or substantially transmissive liquid to the laser beam. This fluid is used to keep the laser beam path clear and also to remove or help remove cuttings from the borehole. Configurations, systems and methods for providing and removing such fluids in laser drilling, and for keeping the beam path clear, as well as, the removal of cuttings from the borehole, during laser drilling are provided in the following US Patent Applications and US Patent Application Publications: Publication No. U.S. 2010/0044102, Publication No. U.S. 2010/0044103, Publication No. U.S. 2010/0044104, Ser. No. 12/896,021, Ser. No. 13/211,729, Ser. No. 13/210,581 and Ser. No. 13/222,931, the entire disclosures of each of which are incorporated herein by reference.

The beam blades 120, 121, 122 and 123 form a beam path slot 125, which slot has ends, e.g., 126*a*, 126*b*. In this embodiment, although other configurations and positions are contemplated, the beam path slot 125 extends from the bottom section 102 partially into the bit body section 101. The beam path slot 125 may also have end sections 126*a*, 126*b*, these end sections 126*a*, 126*b*, are angled, such that they do not extend into the beam path. The beam pattern, e.g., the shape of the area of illumination by the laser upon the bottom of the borehole, or at any cross section of the beam as it is traveling toward the area to be cut, e.g., a borehole surface, when the bit is not in rotation, in this embodiment is preferably a narrow ellipse or rectangular type of pattern. (In FIG. 1B the laser beam 160 is shown as having a beam pattern that is substantially rectangular.) The beam path for this pattern expands from the optics, not shown, until it strikes the bottom of the borehole (see and compare, FIG. 1C showing a cross section of the laser beam 160 and the beam pattern 163, with FIG. 1B showing the bottom view of the laser beam pattern, and thus, the shape of the area of illumination of the bottom surface of the borehole by the laser beam when the beam is not rotating). It should additionally, be noted that in this embodiment the beam path is such that the area of illumination of the bottom of the borehole surface is wider, i.e., a larger diameter, than the diameter of the bit, put about the same as the outer diameter of the gauge cutters. It is contemplated that the area of illumination may be equal to the bit diameter (excluding or including gauge cutters and/or gauge reamers as forming the outer diameter of the bit), substantially the same as the bit diameter (excluding or including gauge cutters and/or gauge reamers as forming the outer diameter of the bit), greater than the bit diameter (excluding or including gauge cutters and/or gauge reamers as forming the outer diameter of the bit). Thus, for example, preferably the width of the beam, at the bottom of the borehole, is configured to be about ¼ to ⅜ inches wider than the intended diameter of the borehole. Thus for a 6 inch diameter borehole, the beam width may be from about 6¼ to about 7 inches, and preferably from about 6½ to about 6¾ inches. The bottom of the end section 126 also defines the end of the slot 125 with respect to the outer surface of the bit body. In this embodiment the end of the slot 125 is at about the same longitudinal position as the end of the blades, e.g., 127.

Figure 4A:
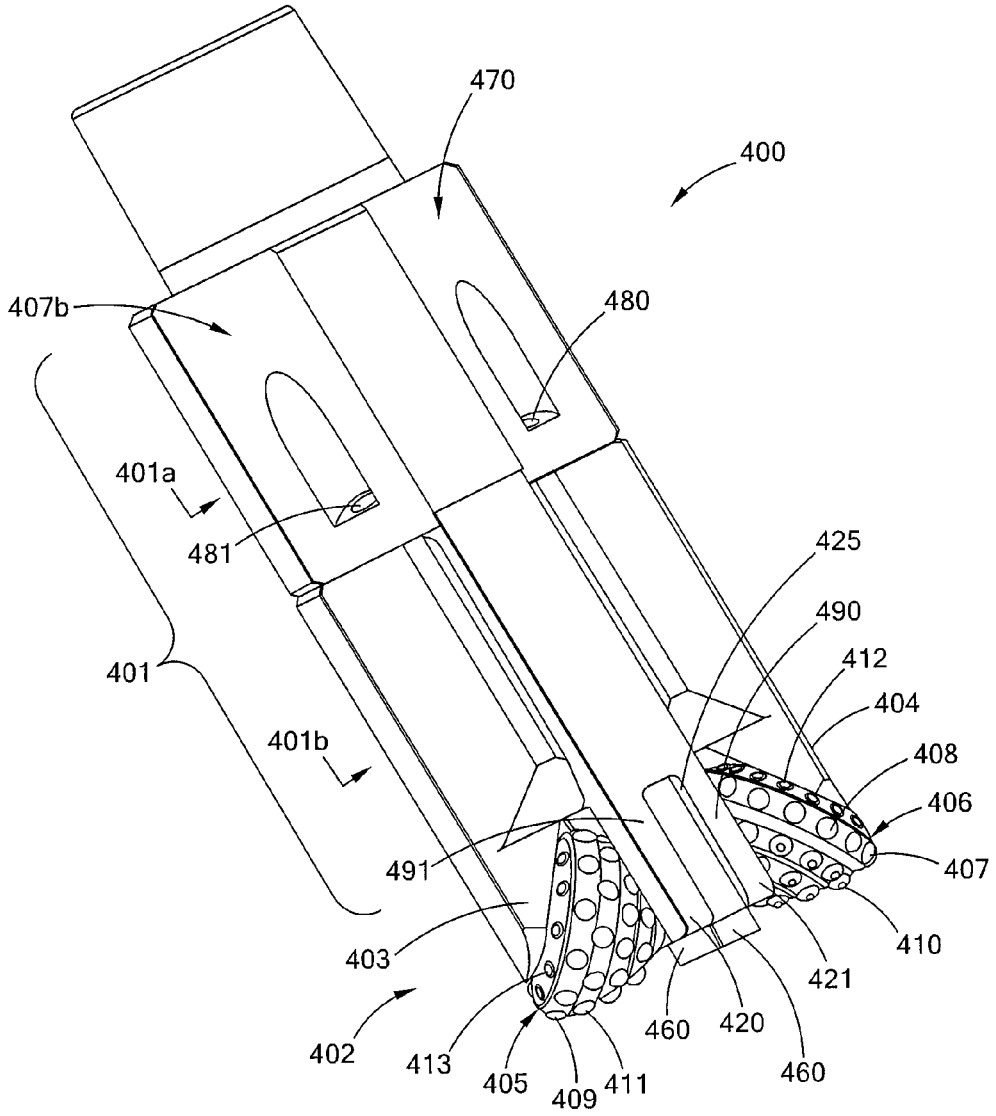
FIG. 4A is a side-on perspective view of an embodiment of a roller cone laser-mechanical bit in accordance with the present invention.
Figure 4B:
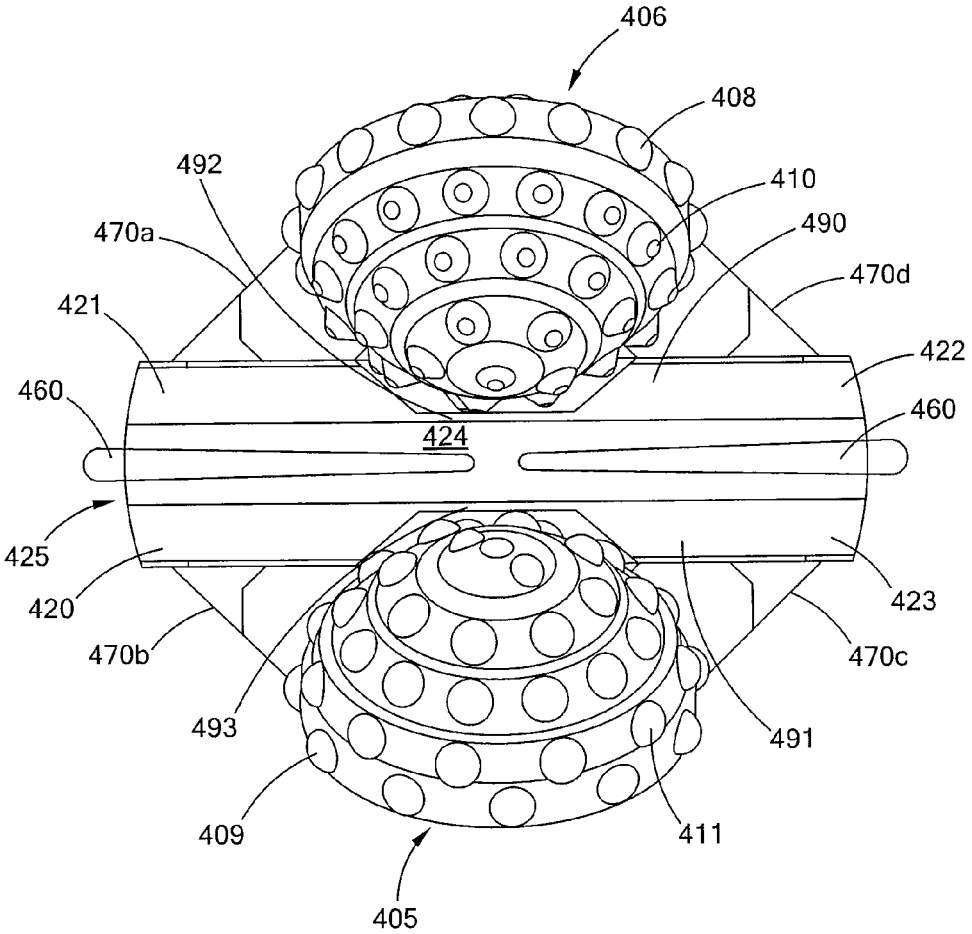
FIG. 4B is a bottom view of the bit of FIG. 4A.
Figure 4C:
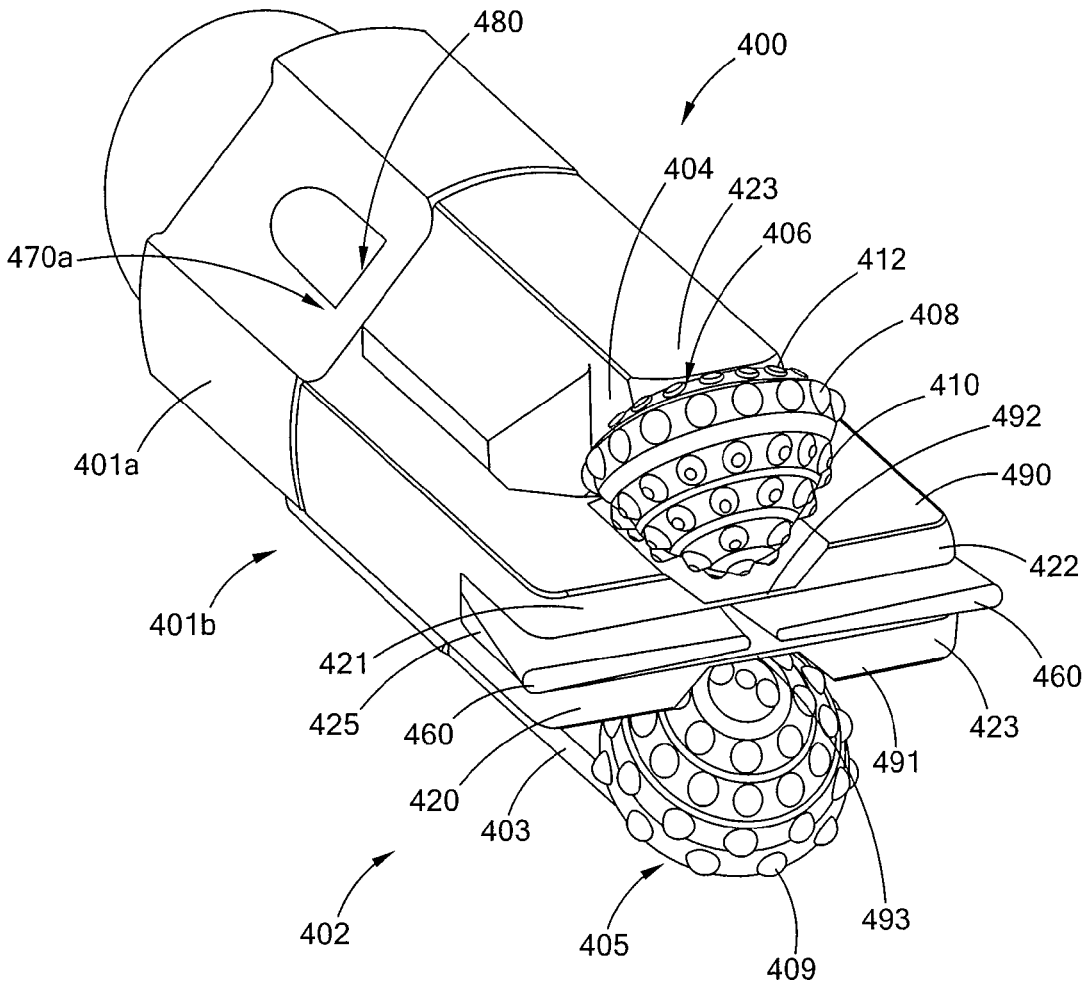
FIG. 4C is a bottom-on perspective view of the bit of FIG. 4A.

The slot, beam slot or beam path slot refers to the opening or openings, e.g., a slot, in the sides, or side walls, of the bit that permit the beam path and the laser beam to extend out of, or from the side of the bit, as illustrated, by way of example, in FIG. 1C and FIG. 4C. Thus in general the slot, beam slot, or beam path slot form an opening, or a part of an opening, in the end of the beam path channel.

In the embodiment of FIGS. 1A-C there are provided gauge cutters, 128, 129, 130, 131. The gauge cutters are located on blades 105, 106, 109 and 110. Blades 106 and 110 only support gauge cutters 128, 130. Blades 105, 109 support gauge cutters 131, 129, as well as, bottom cutters 132, 133, 134, 138, 139, 140, which cutters remove material from the bottom of the borehole, after it has been softened, or otherwise weakened, e.g., laser-affected material, by the laser beam 160. Depending upon the configuration and shape of the laser beam, the gauge cutters may also be removing laser-affected rock or material. Gauge pads, e.g., 141 are positioned in surfaces of the bit body, e.g., 116*a*. In this embodiment gauge reamers 142, 143, 144, 145 are positioned in blades 104, 105 (and also similarly positioned in blades 108, 109 although not seen in FIG. 1A). Blades 103 and 107 have depth of cut limiters, e.g., 146, which limit the depth to which the cutters can dig into the surface. The blades, and in particular the blades having cutters, may have internal passages for cooling, e.g., vents or ports, such as, e.g., 147, 148, 149 (it being noted that the actual openings for vents 148, 149, are not seen in the view of FIG. 1A).

As best illustrated in FIG. 1B, the cutters are positioned with respect to each other, such that they each take a slightly different path along the bottom of the borehole, in this way each cutter is assisting in the removal of laser-affected rock, and preferably does not encounter any rock that has not first been affected by the laser. In this embodiment the distance of travel by a cutter before it contacts laser-affected rock is shown by arc 162. Arc 162 defines an angle between the beam path channel and the plane of the blade supporting the cutters. This angle, which may be referred to as the "beam path angle," can be from about 90 degrees to about 140 degrees, about 100 degrees to about 130 degrees, and about 110 degrees to about 120 degrees. In this embodiment because the beam path channel, the laser beam path, and the laser beam are essentially coincident, this value for this angle would be essentially the same regardless of which was used a reference point for the angle's determination. Beam path angles of less than 90 degrees may be employed, but are not preferred, as they tend to not give enough time for the heat deposited by the laser to affect the rock before the cutter reaches the area of laser affected rock. (Greater angles than 140 degrees may be employed, however, at greater angles space and strength of component issues can become significant, as the blades have very little space in which to be positioned in configurations where the beam path channel extends across substantially all, or all, of the bottom of the bit.) Additionally, when multiple blades are used, each blade could have the same, substantially the same, or a different angle (although care should be taken when using different angles to make certain that the cutters and overall engagement with the borehole surface is properly balanced.) In the embodiment of FIG. 1B this angle, defined by arc 162, is 135 degrees.

This angle between the laser beam (and the beam path channel, since generally they may be essentially coincident) and the cutter position has a relationship to, and can be varied and selected to, address and maximize, efficiency based upon several factors, including for example, the laser power that is delivered to the rock, the reflectivity and absorptivity of the rock to the laser beam, the rate and depth to which the laser beam's energy is transmitted into the rock, the thermal properties of the rock, the porosity of the rock, and the speed, i.e., RPM at which the bit is rotated (further details of which are provided in U.S. patent application Ser. No. 61/446,041 and co-filed U.S. patent application Ser. No. 13/403,132 filed contemporaneously with this application, the entire disclosures of each of which are incorporated herein by reference). Thus, as the laser is fired, e.g., a laser beam is propagated through the beam path channel, along its beam path from optics to the surface of the borehole, in a beam pattern determined by the optics, a certain amount of time will pass from when the laser first contacts a particular area of the surface of the borehole until the cutter revolves around an reaches that point. This time can be referred to as soak time. Depending up the above factors, the soak time can be adjusted, and optimized to a certain extent by the selection of the cutter-laser beam angle.

The bit 100 has channels, e.g., junk slots, 170, 171 that provide a space between the bit 100 and the wall or side surface 150 of the borehole, for the passage of cuttings up the borehole. The relationship of the gauge cutters 129, 128, 131, 130 as well as other components of the bit 100 to the wall of the borehole 150 can been seen in FIG. 1B.

The blades that support the cutters, 104, 105, 106, 108, 109, 110, i.e., the cutter blades, in the embodiment of FIG. 1, are essentially right angle shaped. Thus, the bottom section of the blades, i.e., the lower end holding the cutters that engage the bottom and/or gauge of the borehole, and also the associated bottom of the cutters positioned in that end (e.g., cutters 134,133, 132,129), are along an essentially straight line that forms a right angle with the side section of the blades, i.e., the side end holding the cutters that engage the side and/or gauge of the borehole, and also the associated side of the cutters positioned in that end (e.g., cutters 142, 144, 129) form a right angle. This right angle configuration of all of the cutter blades, as shown in the embodiment of FIG. 1, is referred to as a flat bottom configuration, or a flat bottom laser-mechanical bit. Thus, the lower ends of the blades, as well as their associated cutters, are essentially co-planar and thus provide the flat bottom of the bottom section 102 of the bit 100. Accordingly, in laser mechanical-bits, having fixed cutters, it is preferable that the bottom of the bit, as primarily defined by the end of the cutter blades, and the position of the cutters in those ends, is essentially flat and more preferably flat, and as such will engage the borehole in an essentially even manner, and more preferably an even manner, and will in general provide a borehole with an essentially flat bottom and more preferably a flat bottom.

In the bit of FIGS. 1A-C the cutters, e.g., 134, 133, 132, gauge cutters, e.g., 129, and gauge reamers, e.g., 144, 142, may be made of a material such as PDC; and the gauge pads, e.g., 141, may be carbide inserts, which provides for impact resistance, enhanced wear, as well as bit stability.

Figure 2A:
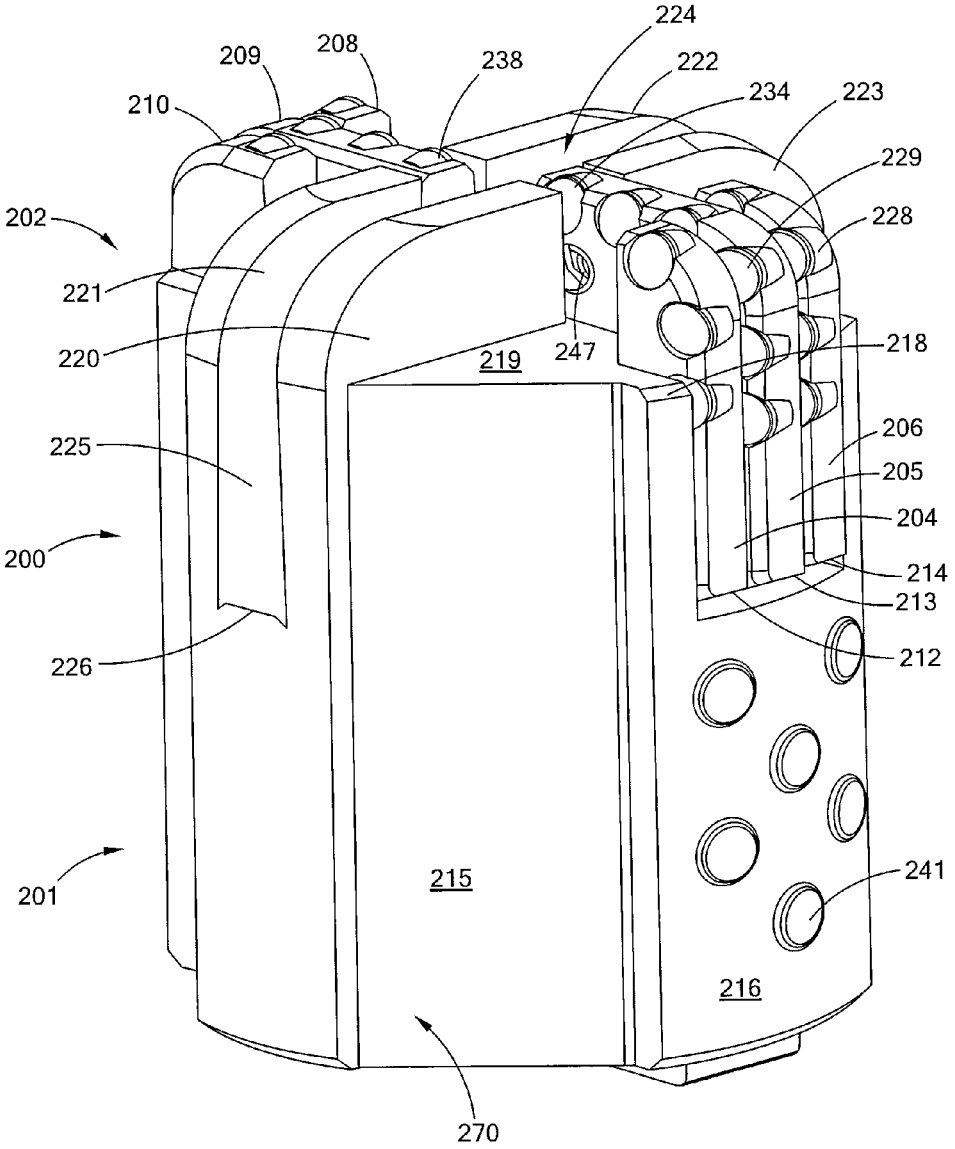
FIG. 2A is a perspective view of an embodiment of a fixed cutter laser-mechanical bit in accordance with the present invention.
Figure 2B:
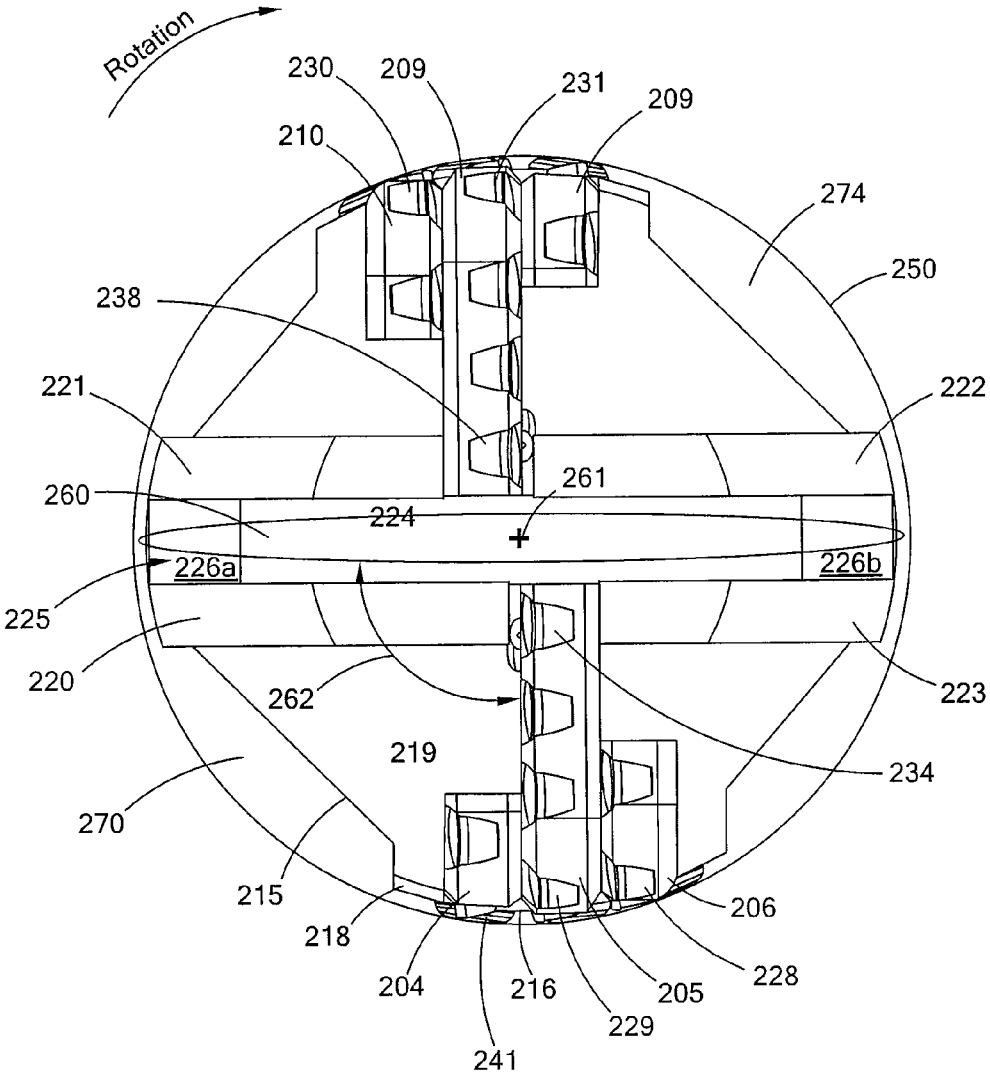
FIG. 2B is a bottom view of the bit of FIG. 2A, within a borehole.

Turning to FIGS. 2A and 2B there is illustrated an embodiment of a fixed cutter laser-mechanical drill bit that has an essentially flat bottom configuration. This embodiment is a variation of the configuration of the embodiment shown in FIGS. 1A-C and the general teachings provided above regarding that embodiment are applicable to this embodiment. Thus, in FIGS. 2A and 2B there is provided an embodiment of a laser-mechanical bit 200, having a body section 201 and a bottom section 202. The bottom section 202 has mechanical blades 204, 205, 206, 208, 209, 210.

The bit body 201 has a receiving slot for each blade. For example, in FIG. 2A receiving slots, 212, 213, 214 provide a unitary opening for blades 204, 205, 206. The bit body 201 has a surface or area, e.g., 215, in the bit in which no bit receiving slots are formed and in which no gauge pads, or other structures are positioned. The bit body 201 has a surface or area, e.g., 216 for supporting gauge pads, e.g., 241, in this embodiment this surface area, e.g., 216, also supports the blades, e.g., 204, 205, 206. The bit body 201 further has a surface 219, that in this embodiment is substantially normal to the surfaces 215, 216, which surface has part of the blade receiving slots formed therein. The surface 219 is connected to surface 215, by an edge and to surface 216 by a small angled surface or area 218.

The bit is further provided with beam blades, 220, 221, 222, 223. In this embodiment the beam blades are positioned along the entirely of the length of the bit 200 and they from a sidewall for the junk slot 270. Thus, the beam blades are positioned in both the bit body section 201 and the bottom section 202.

A beam path channel 224 is formed in the bit, and is bordered, in part, by the inner surfaces of the beam blades 220, 221, 222, 223 and the ends of blades 205, 209. In this embodiment the beam path channel 224 extends through the center axis 261 of the bit and divides the bit into two separate sections, as more clearly seen in FIG. 2B. Thus, it is preferable that the structures and their configuration on one side of the beam path channel 224, be similar, and more preferably the same, as the structures on the other side of the beam path channel 224, which is the case for this embodiment (note that although the structures are identical, they are nevertheless not mirror images in this embodiment). The laser beam path, in the beam path channel 224, should be close to, but preferably not touch bit structures or components and, in particular, not touch the beam blades or the beam blade inner surfaces. When using high power laser energy, and in particular laser energy greater than 5 kW, 10 kW, 20 kW, 40 kW, 80 kW and greater, if the laser beam 260, contacts a part of the bit, e.g., a blade, it will melt or otherwise remove that section in the beam path, and potentially damage the remaining section of the component.

Generally, the laser beam path is defined by the path and volumetric shape that the laser beam pattern is intended to fill and take as the laser beam is propagated from its launch point associated with the bit, e.g., an optic, a fiber face or a window. In particular, the laser beam path may be considered to be that volumetric shape in which 99% of the integrated laser power leaving the launch point is intended to found. Thus, in general, the laser beam path, the laser beam and the laser beam pattern will be coincident. In situations where the laser beam is diverted from its intended path the laser beam and the beam path may not be coincident.

The beam path in the FIGS. 2A-B embodiment also serves as a fluid path for a fluid, such as air, nitrogen, or a transmissive, or substantially transmissive liquid to the laser beam. This fluid is used to keep the laser beam path clear, and also, to remove or help remove cuttings from the borehole. Configurations, systems and methods for using such fluids, and for keeping the beam path clear, as well as the removal of cuttings from the borehole, are provided in the following US Patent Applications and Patent Application Publications: Publication No. U.S. 2010/0044102, Publication No. U.S. 2010/0044103, Publication No. U.S. 2010/0044104, Ser. No. 12/896,021, Ser. No. 13/211,729, Ser. No. 13/210,581 and Ser. No. 13/222,931, the entire disclosures of each of which are incorporated herein by reference.

The beam blades 220, 221, 222 and 223 form a beam path channel slot 225, which slot has an end, e.g., 226. In this embodiment, although other configurations and positions are contemplated, the beam path slot 225 extends from the bottom section 202 partially into the bit body section 201. The beam path slot 225 may also have end sections 226*a*, 226*b*, the end sections 226*a*, 226*b*, in this embodiment are angled such that they do not extend into the beam path (the laser beam in this example is in a beam pattern that is a narrow ellipse type of pattern that is expanding from the optics, not shown, until it leaves the bit and strikes the bottom of the borehole, such as the path shown in FIG. 1C). The bottom of the end sections 226*a*, 226*b* also define the ends of the slot 225 with respect to the outer surface of the bit body. In this embodiment the ends of the slot 225 are at about the same longitudinal position as the ends of the blades.

In the embodiment of FIGS. 2A-B there are provided gauge cutters, 228, 229, 230, 231. The gauge cutters are located on blades 205, 206, 209 and 210. Blades 204 and 208 do not support any gauge cutters. Blades 205, 206, 209, 210 support gauge cutters and bottom cutters. In this embodiment cutters 238, 234 are positioned within planes formed by the inner and outer surfaces of beam blades 221-222 and 220-223 respectively, and the cutter faces are transverse to the beam path slot. The cutters remove material from the bottom and sides of the borehole, after it has been softened, or otherwise weakened, e.g., laser-affected material, by the laser beam 260. Depending upon the configuration and shape of the laser beam, the gauge cutters may also be removing laser-affected rock or material. Gauge pads, e.g., 241 are positioned in surfaces of the bit body, e.g., 216. In this embodiment gauge reamers are positioned on all six blades.

As best illustrated in FIG. 2B, the cutters are positioned with respect to each other, such that they each take a slightly different path along the bottom of the borehole, in this way each cutter is assisting in the removal of laser-affected rock, and preferably does not encounter any rock that has not first been affected by the laser. In this embodiment the distance of travel by a cutter before it contacts laser-affected rock is shown by arc 262. Arc 262 further defines an angle between the beam path channel, and in this embodiment the laser beam, and the plane of the cutter's blade and in this embodiment the cutter's face. This angle preferably can be from about 90 degrees to about 140 degrees. Angles of less then 90 degrees may be employed, but are not preferred, as they tend to not give enough time for the heat deposited by the laser to affect the rock before the cutter reaches the area of laser affected rock. (Greater angles may be employed, however, at greater angles space and strength of component issues can become significant, as the blades have very little space in which to be positioned.) In the embodiment of FIG. 2B this angle is 90 degrees. The blades, 205, 209 have internal passages for cooling such as, e.g., 247.

The bit 200 has channels, e.g., junk slots, 270, 271 that provide a space between the bit 200 and the wall or side surface 250 of the borehole, for the passage of cuttings up the borehole. The relationship of the gauge cutters 229, 228, 231, 230, as well as, other components of the bit 200 to the wall of the borehole 250 can been seen in FIG. 2B.

In the embodiments of FIGS. 1A-C and 2A-B, the length of the bit body compared to its diameter (width) was only slightly larger. This "short" bit body typically would be attached to another bit body, extension, or component (either having laser optics, an optical fiber, or a beam path channel) that could then be connected to a source of rotation, or to other structures and equipment that still maintain the bit body in mechanical connection with a source of rotational movement. Additionally, and by way of example, the bits could be associated with a down hole system having, e.g., sensors, measuring devices, sampling devices, probes, steering devices, directional drilling assemblies, measuring while drilling assemblies (MWD), logging while drilling assemblies (LWD), measuring and logging while drilling assemblies (MWD/LWD) and combinations and variations of these. An example of such an extension piece for the bit body is seen in an embodiment as shown in FIG. 4A-C.

Figure 3A:
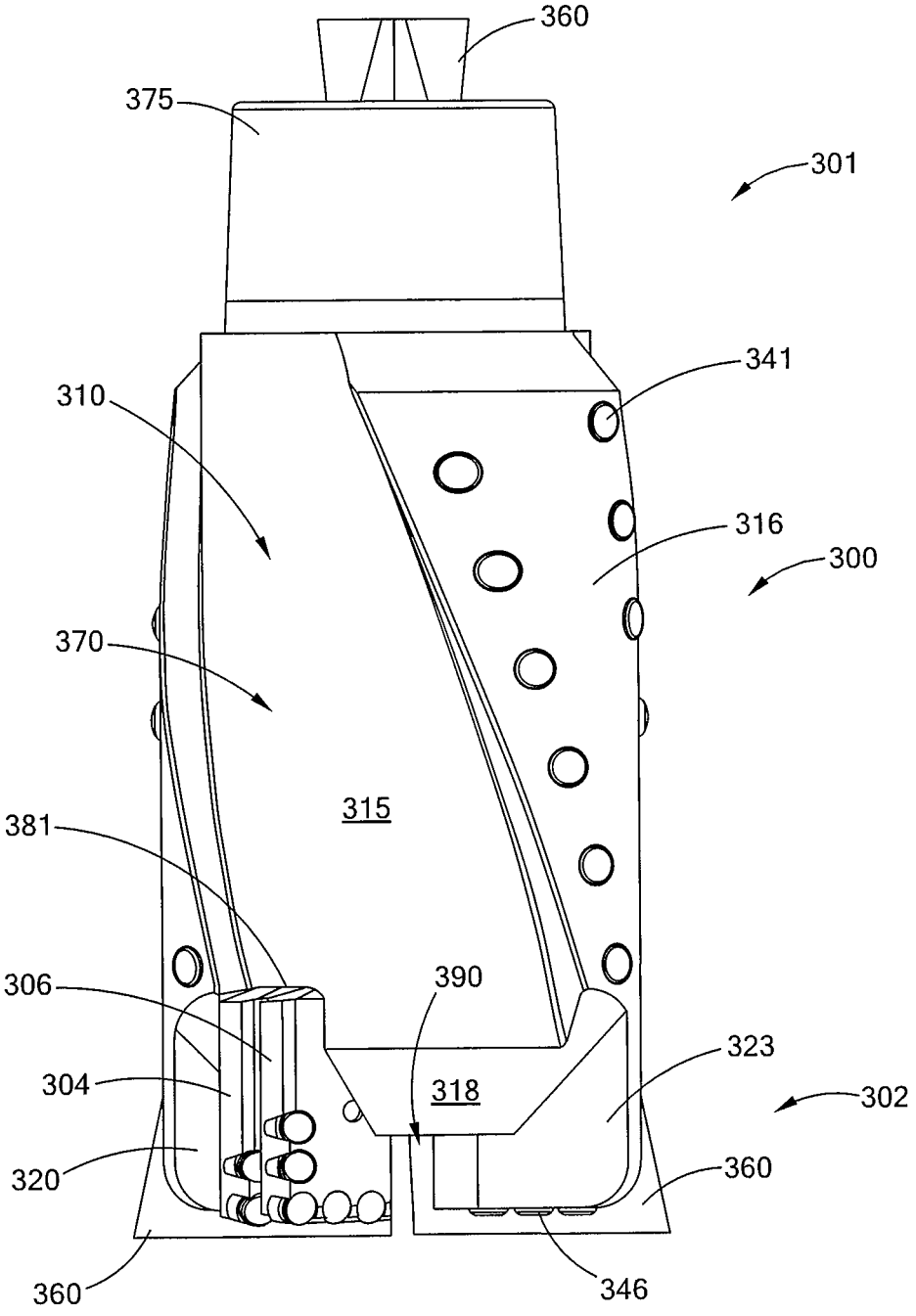
FIG. 3A is a side-on perspective view of a fixed cutter laser-mechanical bit of the present invention.
Figure 3B:
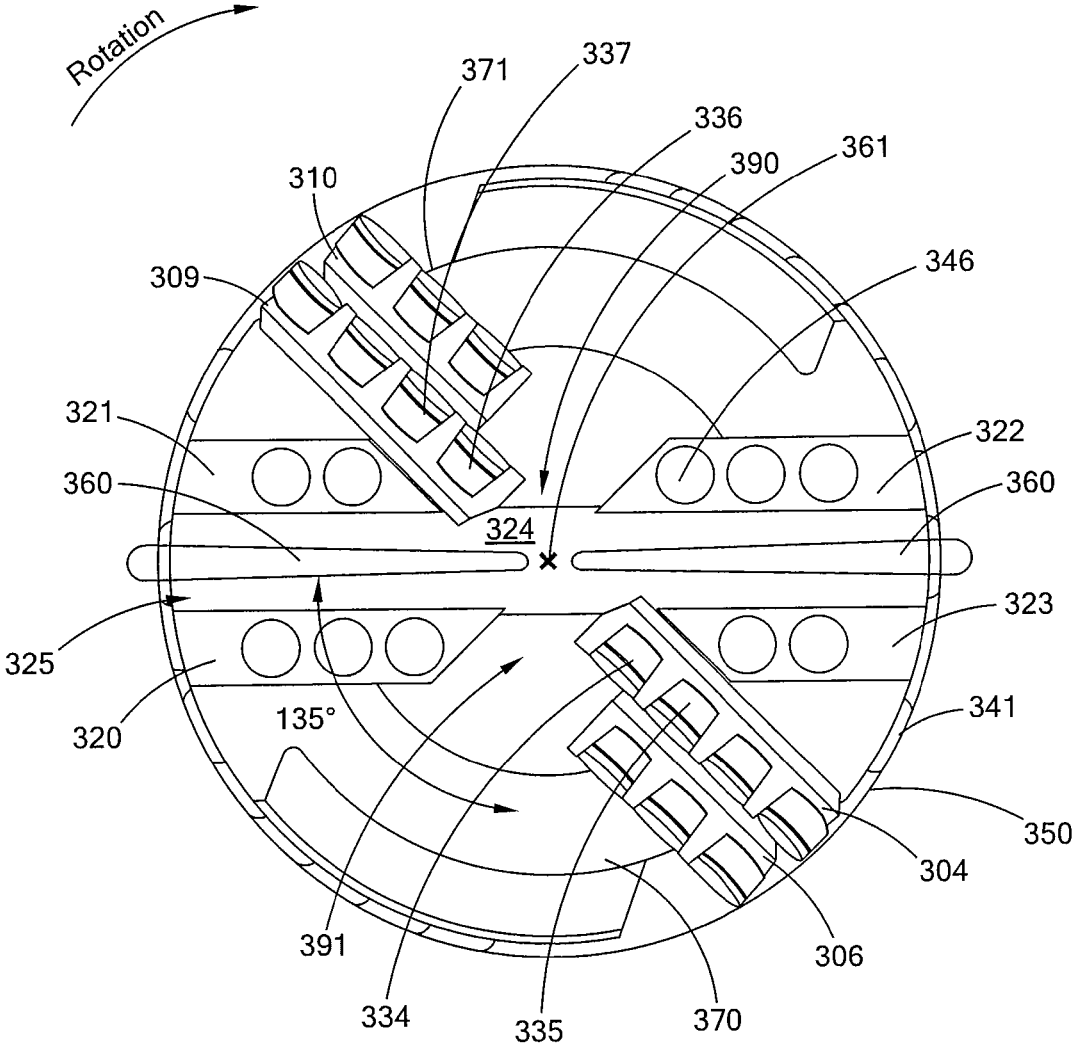
FIG. 3B is a bottom view of the bit of FIG. 3A, within a borehole.
Figure 3C:
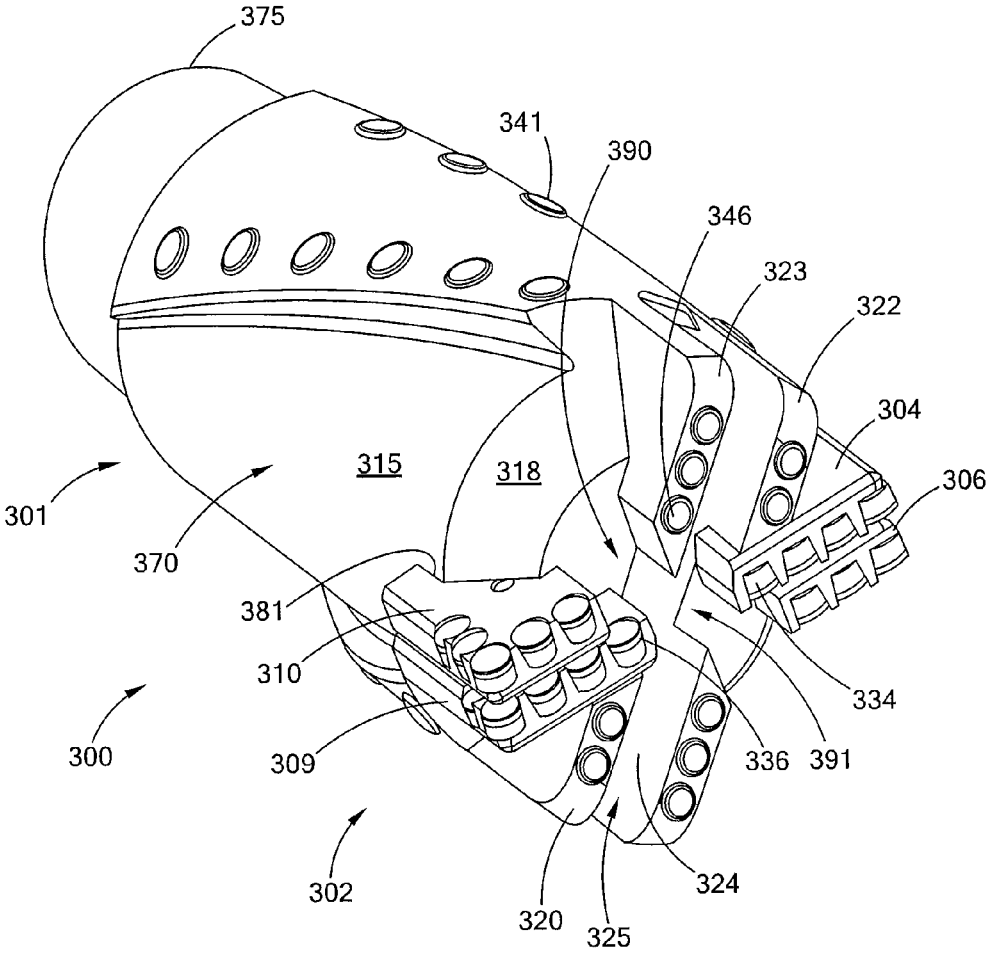
FIG. 3C is a bottom-on perspective view of the bit of FIG. 3A.

FIGS. 3A-C provide an embodiment of a fixed cutter laser-mechanical bit, having a flat bottom configuration, that has a longer bit body, than the embodiments of FIGS. 1A-C and 2A-B. The general teaching provided above regarding the above embodiments are applicable to this embodiment. Thus, there is provided a laser-mechanical bit 300 having a body section 301 and a bottom section 302. The bottom section 302 has mechanical blades 304, 306, 309, 310. Additionally, this embodiment has a tapered threaded joint 375 at its top.

The bit body 301 has receiving slots, e.g., 381, for the cutter blades, e.g., 309,310. The bit body 301 has two helical surfaces or areas, e.g., 315. These surfaces are recessed from helical surface 316, and form a portion of the junk slots, e.g., 370. (There are two surfaces, e.g., 315, and related components of the types shown in FIG. 3A that are on the opposite side of the bit and not seen in the figure.) A portion of the receiving slots 381 are formed in surface 315. No gauge pads, e.g., 341, or other structures are present on surface 315, to enable the efficient and unobstructed removal of cuttings. In this embodiment the helical surface area, e.g., 316, extends down and is also, in part, a portion of the beam blades 320, 321, 322, 323. The bit body 301 further has a partial frusto-conical surface, e.g., 318 that connects surfaces 315, and in part surface 316, to the beam blades.

The bit is further provided with beam blades, 320, 321, 322, 323. In this embodiment the beam blades are positioned entirely along the bottom section 302 of the bit 300. The beam blades are in fluid communication with the junk slots, 370, 371 by way of passages 390, 391.

A beam path channel 324 is formed in the bit, and is bordered, in part, by the inner surfaces of the beam blades 320, 321, 322, 323 and the ends of blades 304, 309. In this embodiment the beam path channel extends through the center axis 361 of the bit and divides the bit into two separate sections, as more clearly seen in FIG. 3B. Thus, it is preferable that the structures and their configuration on one side of the beam path channel 324, be similar to, and more preferably the same as, (although not a mirror image of) the structures on the other side of the beam path channel 324, which is the case for this embodiment. The laser beam path is contained within a beam path channel 324, and should be close to, but preferably not touch the beam blades or the beam blade inner surfaces. When using high power laser energy, and in particular laser energy greater than 5 kW, 10 kW, 20 kW, 40 kW, 80 kW and greater, if the laser beam 360, contacts a blade, or other bit component, it will melt or otherwise remove that section of the blade in the beam path, and potentially damage the remaining section of the blade or other bit components.

The laser beam 360 is provided in a laser beam pattern that is a split beam pattern. Thus, the laser beam is not present at the central axis 361, and is located to the sides of that axis. Further, the laser beam 360 extends beyond the sides of the laser-mechanical bit and into the side wall of the borehole.

The beam path channel in this embodiment also serves as a fluid path for a fluid, such as air, nitrogen, or a transmissive, or substantially transmissive liquid to the laser beam. This fluid is used to keep the laser beam path clear and also to remove or help remove cuttings from the borehole. Configurations, systems and methods for using such fluids, and for keeping the beam path clear, as well as the removal of cuttings from the borehole, are provided in the following US Patent Applications and US Patent Application Publicatons: Publication No. U.S. 2010/0044102, Publication No. U.S. 2010/0044103, Publication No. U.S. 2010/0044104, Ser. No. 12/896,021, Ser. No. 13/211,729, Ser. No. 13/210,581 and Ser. No. 13/222,931, the entire disclosures of each of which are incorporated herein by reference. Further, the beam path channel 324, as a fluid path, is in direct fluid communication with the junk slots, 370, 371. This provides for the efficient and enhanced removal of cutting, with less interference or obstructions from the bit structures.

The beam blades 320, 321, 322 and 323 form a beam path slot 325, which slot has ends. In this embodiment, although other configurations and positions are contemplated, the beam path slot 325 is only present in the bottom section 302.

In the embodiment of FIGS. 3A-C there are provided gauge cutters. The gauge cutters are located on cutter blades 304, 306, 309 and 310. In this embodiment cutters 334, 336 are positioned within planes formed by the inner and outer surfaces of beam blades 321-322 and 320-323, and cutters 335, 337 are partially within these planes. The cutters remove material from the bottom and sides of the borehole, after it has been softened, or otherwise weakened, e.g., laser-affected material, by the laser beam 360. Depending upon the configuration and shape of the laser beam, the gauge cutters may also be removing laser-affected rock or material. Gauge pads, e.g., 341 are positioned in surfaces of the bit body, e.g., 316. In this embodiment gauge reamers are positioned on all cutter blades.

In this embodiment the beam blades also serve a mechanical function, but providing a support for the depth of cut limiters, e.g., 346. Further the laser beam is provided in a pattern (when not rotating) that has little or no energy at the axis 361 of the bit 300, and provides two essentially elliptical shaped patterns, that are tear dropped in appearance.

As best illustrated in FIG. 3B, the cutters are positioned with respect to each other, such that they each take a slightly different path along the bottom of the borehole, in this way each cutter is assisting in the removal of laser-affected rock, and preferably does not encounter any rock that has not first been affected by the laser. In this embodiment the distance of travel by a cutter before it contacts laser-affected rock is shown by arc 362. Arc 362 further defines an angle between the plane defined by the beam path channel, and in this embodiment also defined by the laser beam, and the plane of the cutter blade. In this embodiment the angle is about 135 degrees.

The bit 300 has large channels, e.g., junk slots, 370, 371 that provide a space between the bit 300 and the wall or side surface 350 of the borehole, for the passage of cuttings up the borehole. The relationship of the gauge cutters, as well as, other components of the bit 300 to the wall of the borehole 350 can been seen in FIG. 3B.

The embodiment of FIGS. 3A-C has tungsten carbide inserts (TCIs) that are used as gage pads, e.g., 341, on the protruding helical part e.g., 316, of the body 301 for bit stabilization. The surface, 316 may also be laser hardened, or hardened by some other means in place of using gage pads. The depth of cut (DOC) limit for this bit is achieved by TCIs, e.g., 346, pressed into the bottom of the beam blades, e.g., 322. This bit also utilizes a sharp angle chamfer to minimize any blockage of cuttings during cuttings removal. This bit also provides for a substantial volume of open area with the helical shaped grooves, i.e., junk slots, and the beam path channel being in flow communication with those grooves, which further provide an uninterrupted flow of cutting.

Figure 8A:
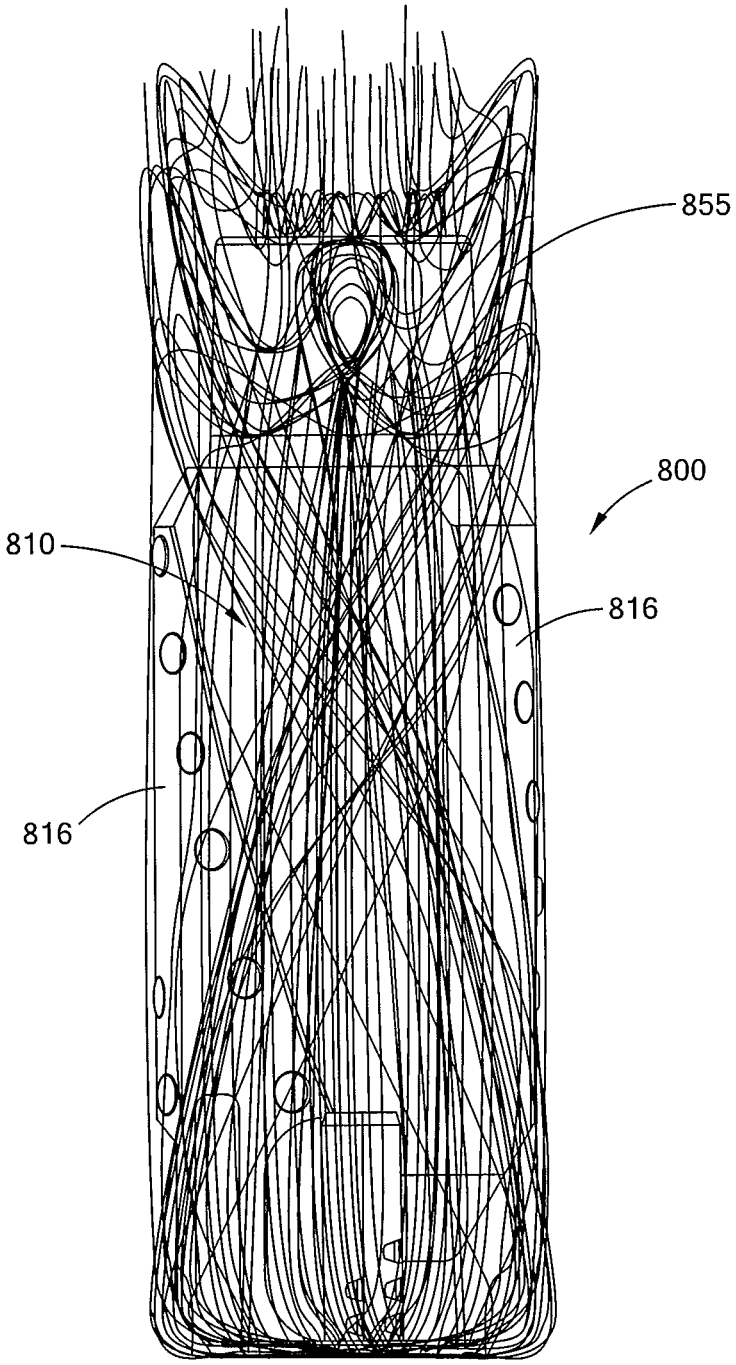
FIG. 8A is a perspective view of flow patterns for an embodiment of a laser-mechanical bit in accordance with the present invention.
Figure 8B:
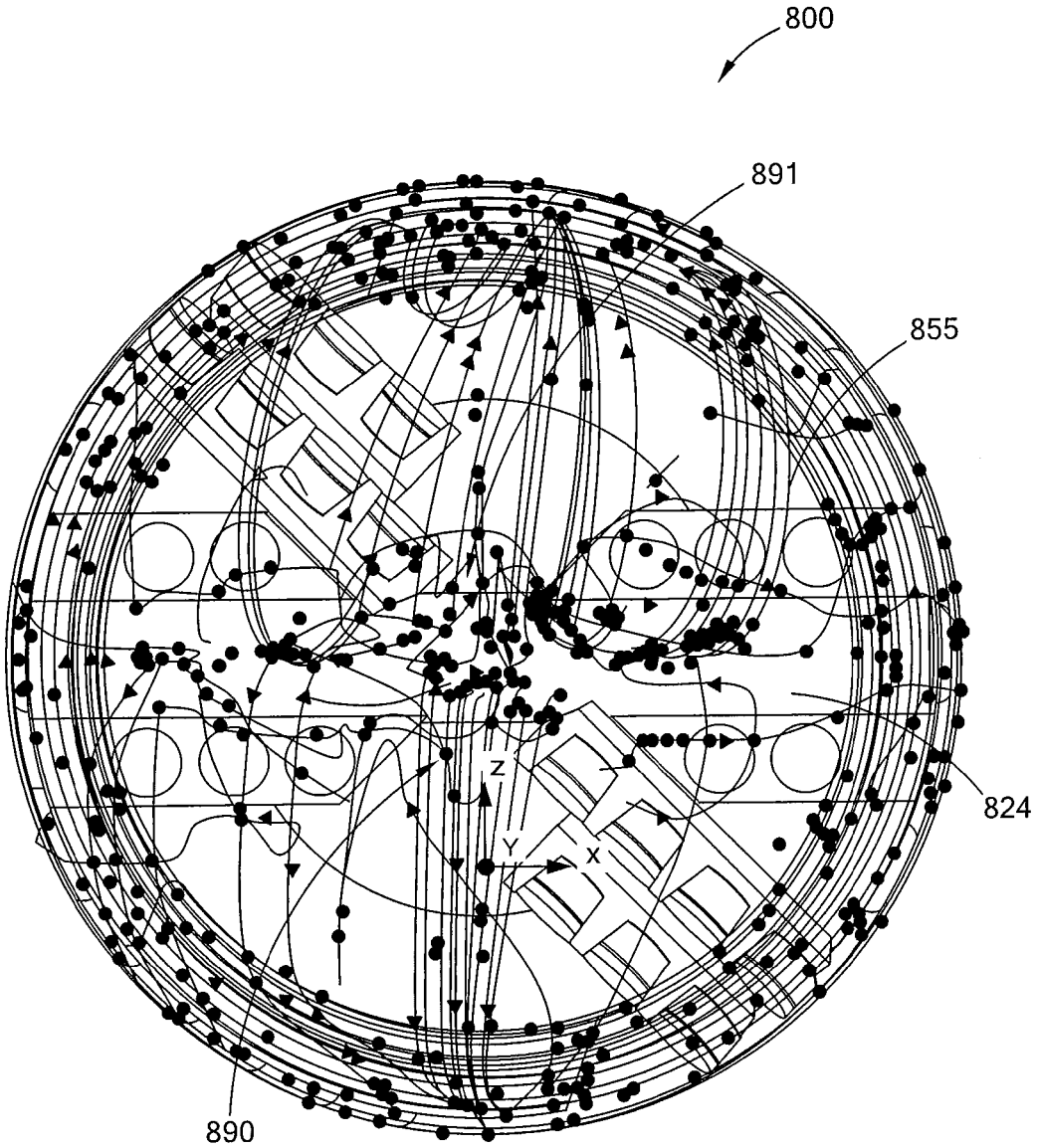
FIG. 8B is a bottom view of the flow patterns and bit of FIG. 10A.

Turning to FIGS. 8A and 8B there are illustrated computer simulations of the fluid flow paths for cuttings removal of a bit of the type shown in FIGS. 3A-C, rotating at 140 RPM. Thus, the bit 800 is shown in FIG. 8A from a side prospective view, with flow lines 855, exiting the bottom of the bit and traveling up the side of the bit 800. The majority of the flow, as shown by flow lines 855, is in the junk slot 870 and not over the surface 816, which supports the gauge pads. The flow velocity, as shown by flow lines 855, is in the range of about 1,556 to about 4,670 inches/seconds. Turning to FIG. 8B there is shown the bottom of the bit 800, with flow, as shown by flow line 855, leaving the beam path channel 824 and traveling out, e.g., radially from the center. Further, the majority of the flow from the beam path channel 824 to the outside of the bit, is through the passages 890, 891, which provide direct fluid communication between the beam path channel 824 and the junk slots 870. The velocities of the flow in FIG. 8B, are similarly in the range of about 1,556 to about 4,670 inches/seconds.

The configurations of the above fixed cutter laser-mechanical bits provides a general description and teachings of the configurations for and use of various components to convey and utilize high power laser energy in conjunction with mechanical drilling activities. The inventions herein are not limited to those specific exemplary embodiments and other arrangements of these and other components are contemplated herein and would not depart from the spirit of the inventions provided in this specification.

In FIGS. 4A-C there is provided an embodiment of roller cone laser-mechanical bit. The laser-mechanical bit 400 has a bit body 401, which has an upper extension section 401*a* and a shorter body section 401*b*, and a bottom section 402. The extension section 401*a* and the shorter body section 401*b* are joined by four threaded bolts, of which bolts 480, 481 can be seen in the view of FIG. 4A. The bottom section 402 has legs 403, 404 that support roller cones 405, 406. Bearings (not shown in the figures) are disposed between the legs and roller cones to facilitate rotation of the cones. The bearings may include journal bearings, or alternatively may include rolling element bearings. The bearings may be sealed, or may be non-sealed and be provided with a lubricant feed system. The lubricant may be dripped, forced, or carried by a portion of the air/gas stream that is diverted through the bearings.

The roller cones have a number of rows of a number of inserts, e.g., 407. Thus, the roller cones 405, 406, have a gauge row, having gauge inserts, e.g., 408, 409, a heel row having heel inserts, e.g., 412, 413. The inserts may also be conically shaped, e.g., 410 and domed shaped e.g., 411. Although not shown in this embodiment MTs may also be used.

The inserts in the roller cones crush the rock at the bottom of the borehole, preferably their mechanical crushing action is limited to laser-affect rock, but may be extended partially or further beyond the laser-affect rock into rock that has not been affected, e.g., weakened by the laser.

The bit has two beam blades 490 and 491. Beam blade 490 has two thicker sections 420, 422, which are joined by a thinner section 492, to form a single unitary beam blade. Beam blade 491 has two thicker sections, 420, 423, which are joined by thinner section 493, to form a single unitary beam blade. Beam blade 490, 491, form a beam slot 425. The beam blades merge in the general area of the bit body and continue on the entirety of the length of the extensions section 401*a*. The laser beam 460 has a split essentially rectangular pattern (when not rotating). The beam blades from a part of the junk slots, 470*a*, 470*b*, 470*c*, 470*d*.

The beam path channel 424 in this embodiment also serves as a fluid path for a fluid, such as air, nitrogen, or a transmissive, or substantially transmissive liquid to the laser beam. This fluid is used to keep the beam path channel and thus the laser beam path clear and also to remove or help remove cuttings from the borehole. Configurations, systems and methods for using such fluids, and for keeping the beam path clear, as well as the removal of cuttings from the borehole, are provided in the following US Patent Applications and US Patent Application Publications: Publication No. U.S. 2010/0044102, Publication No. U.S. 2010/0044103, Publication No. U.S. 2010/0044104, Ser. No. 12/896,021, Ser. No. 13/211,729, Ser. No. 13/210,581 and Ser. No. 13/222,931, the entire disclosures of each of which are incorporated herein by reference.

The laser beam path in the beam path channel should be close to, but preferably not touch the beam blades or the beam blade inner surfaces. When using high power laser energy, and in particular laser energy greater than 5 kW, 10 kW, 20 kW, 40 kW, 80 kW and greater, if the laser beam (not shown in FIGS. 5A-B), contacts a blade, or other bit component, it will melt or otherwise remove that section of the blade in the beam path, and potentially damage the remaining section of the blade or other components.

Figure 5A:
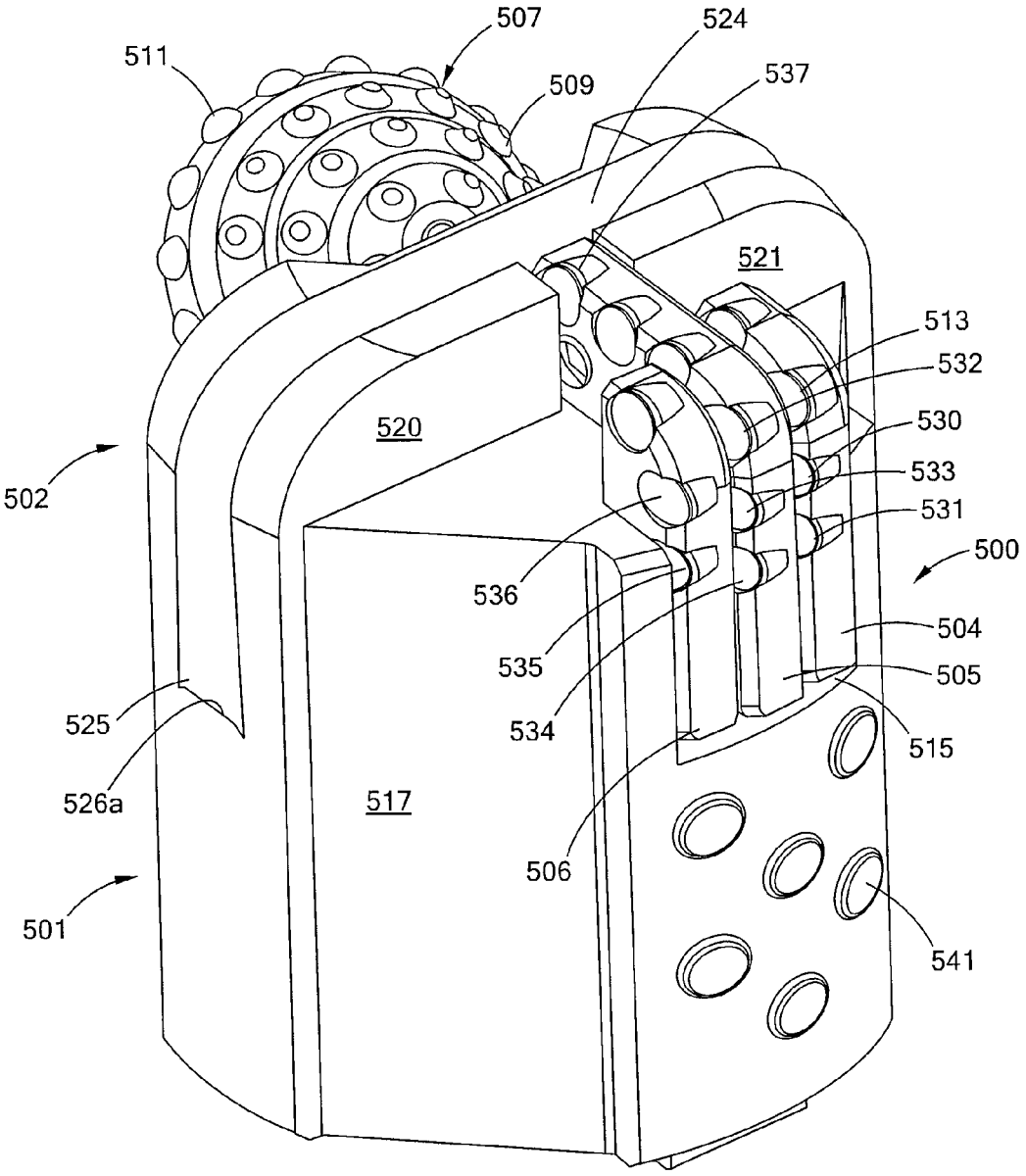
FIG. 5A is a perspective view of an embodiment of a hybrid roller cone fixed cutter laser-mechanical bit in accordance with the present invention.
Figure 5B:
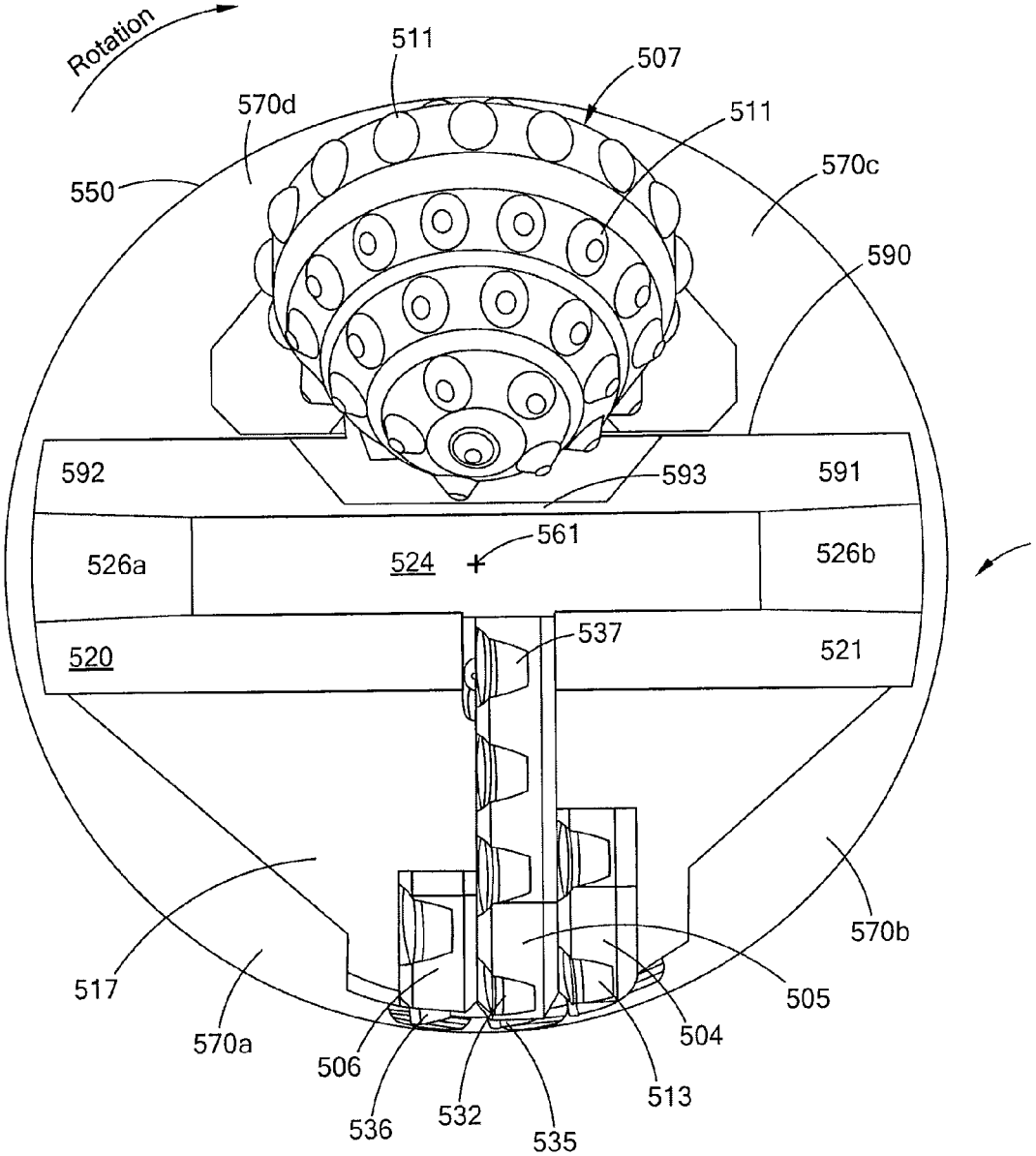
FIG. 5B is a bottom view of the bit of FIG. 5A.

FIGS. 5A and 5B show an embodiment of a hybrid roller cone fixed cutter laser-mechanical bit. As seen in these figures half of the roller cone laser-mechanical bit of FIGS. 4A-C was combined with half of the fixed cutter laser-mechanical bit of FIGS. 2A-B along beam path channel 524.

FIGS. 5A and 5B there is provided a laser-mechanical bit 500 having a body section 501 and a bottom section 502. The bottom section 502 has mechanical blades 504, 505, 506. The mechanical blades support a number of cutters, e.g., 513. The bottom section 502 has a leg (not shown) that supports roller cone 507.

Bearings (not shown in the figures) are disposed between the leg and roller cone to facilitate rotation of the cones. The bearings may include journal bearings, or alternatively may include rolling element bearings. The bearings may be sealed, or may be non-sealed and be provided with a lubricant feed system. The lubricant may be dripped, forced, or carried by a portion of the air/gas stream that is diverted through the bearings.

The roller cones have a number of rows of a number of inserts, e.g., 509. Thus, the roller cones may, have a gauge row, having gauge inserts, a heel row having heel inserts, as well as, other rows of other inserts. The inserts may also be conically shaped, e.g., 509 and domed shaped e.g., 511. Although not shown in this embodiment MTs may also be used.

The bit body 501 has a receiving slot 515 for the cutter blades 504, 505, 506. The bit body 501 has a surface or area, e.g., 517, in which no gauge pads, e.g., 541, or other structures are placed. In this embodiment this surface area, e.g., 517, also, in part, supports and forms a portion of the beam blade 520, (a similar surface not shown in FIG. 5A forms a portion of beam blade 521). Beam blade 590 has two thicker sections 591, 592, which are joined by a thinner section 593, to form a single unitary beam blade.

A beam path channel 524 is formed in the bit, and is border, in part, by the inner surfaces of the beam blades 520, 521, 590 and the end of blade 505. In this embodiment the beam path channel extends through the center axis 561 of the bit and divides the bit into two separate sections, as more clearly seen in FIG. 5B. Thus, the structures and their configuration on one side and on the other side of the beam path channel 524, are substantially different, being a fixed cutter assembly and a roller cone assembly.

The beam path, in the beam path channel 524, should be close to, but preferably not touch the beam blades or the beam blade inner surfaces. When using high power laser energy, and in particular laser energy greater than 5 kW, 10 kW, 20 kW, 40 kW, 80 kW and greater, if the beam path, and in particular the laser beam (not shown in FIG. 5), contacts a blade, or other bit component, it will melt or otherwise remove that section of the blade in the beam path, and potentially damage the remaining section of the blade or other bit components.

The beam path channel 524 in this embodiment also serves as a fluid path for a fluid, such as air, nitrogen, or a transmissive, or substantially transmissive liquid to the laser beam. This fluid is used to keep the laser beam path clear and also to remove or help remove cuttings from the borehole. Configurations, systems and methods for using such fluids, and for keeping the beam path clear, as well as the removal of cuttings from the borehole, are provided in the following US Patent Applications and US Patent Application Publications: Publication No. U.S. 2010/0044102, Publication No. U.S. 2010/0044103, Publication No. U.S. 2010/0044104, Ser. No. 12/896,021, Ser. No. 13/211,729, Ser. No. 13/210,581 and Ser. No. 13/222,931, the entire disclosures of each of which are incorporated herein by reference.

The beam blades form a beam path slot 525, which slot has ends 526*a* and 526*b*. In the embodiment of FIG. 5 there are provided gauge cutters. The gauge cutters 513, 530, 531, 532, 533, 534, 535, 536 are located on cutter blades 504, 505, 506. In this embodiment a cutters 537 is positioned within planes formed by the inner and outer surfaces of beam blades 520-521.

As best illustrated in FIG. 5B, the cutters are positioned with respect to each other, such that they each take a slightly different path along the bottom of the borehole, in this way each cutter is assisting in the removal of laser-affected rock, and preferably does not encounter any rock that has not first been affected by the laser. In this embodiment the cutter angle with respect to the beam path channel is about 90 degrees.

The inserts in the roller cones crush the rock at the bottom of the borehole, preferably their mechanical crushing action is limited to laser-affect rock, however, they can be configured and operated in a manner where they may penetrate beyond, e.g., deeper, than the laser effected rock. In this embodiment the roller cones may be positioned within the bit relative to the cutters in a manner where the inserts and the cutters remove only laser affected-material, where the cutters remove only laser-affected material and the inserts penetrate and mechanically affect material deeper than the laser-affected material and combinations and various of these relationships.

The bit 500 has large channels, e.g., junk slots, 570*a*, 570*b*, 570*c*, 570*d*, that provide a space between the bit 500 and the wall or side surface 550 of the borehole, for the passage of cuttings up the borehole. The relationship of the gauge cutters, as well as, other components of the bit 500 to the wall of the borehole 550 can been seen in FIG. 5B.

The laser-mechanical bits of FIGS. 1-5 are preferably used in conjunction with laser beam delivery patterns, e.g., the shape of the area of illumination when the bit is not rotating, that are essentially linear in shape, such as for example an elongated ellipse, an elongated rectangular area, or an area that extends across the entirety of the diameter of the bit, or borehole, at least about half-way across the diameter or at least about a third-way across the diameter. In this way as the bit is rotated all, or a substantial portion of the area of the bottom surface of the borehole is illuminated by the laser beam, and thus subjected to the laser beam's energy. The cutters, as discussed above, are positioned so that they travel behind the beam path channel and beam slot as the bit is rotated. In this manner as the bit is rotated the cutters remove the laser-affected material, exposing new material to be treated by laser beam as the beam path, in turn rotates arounds and in effect following behind the cutters. Thus, the cutters both follow and lead the laser beam pattern as the bit is rotated.

Figure 6:
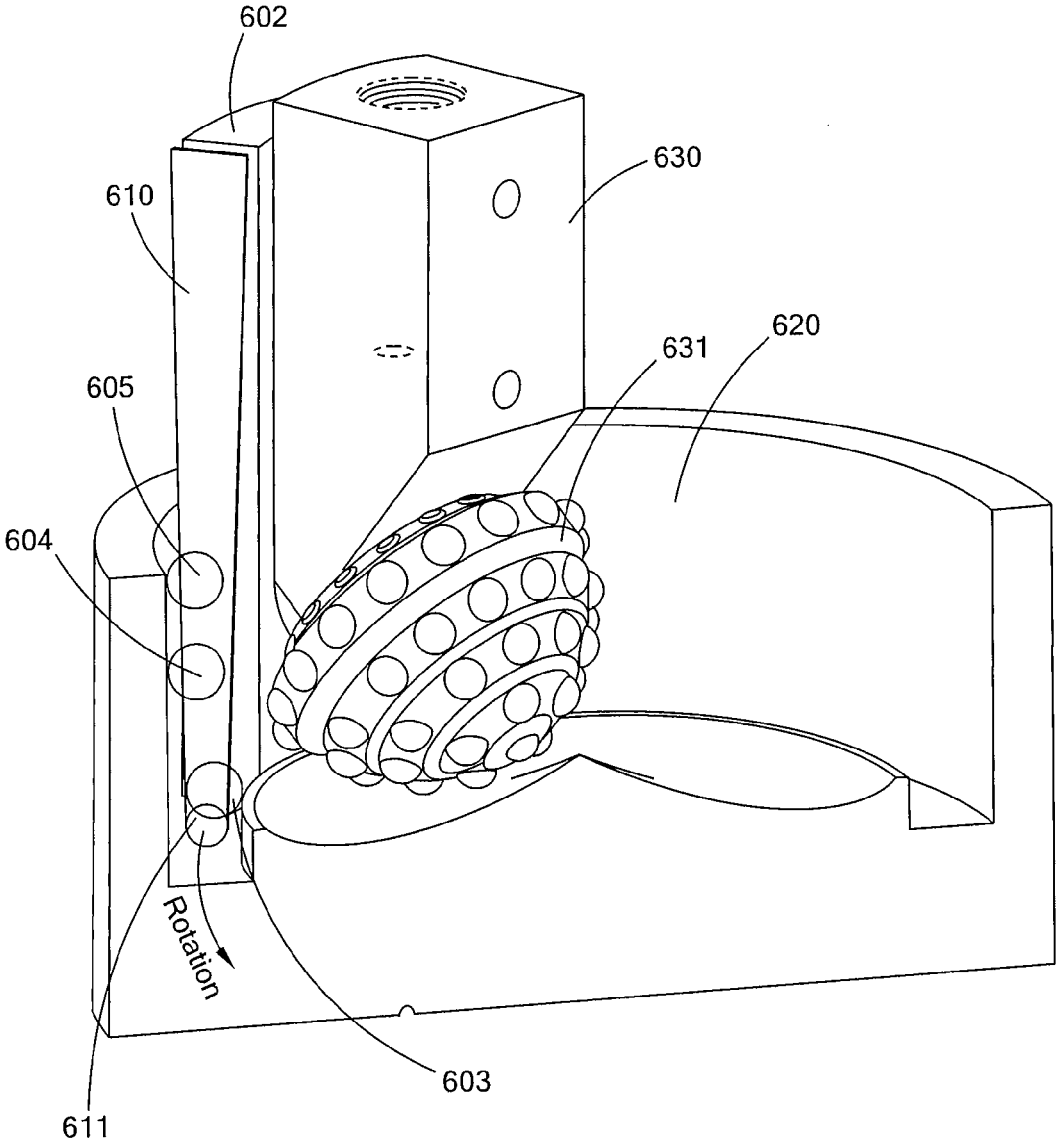
FIG. 6 is a perspective view of an embodiment of a portion of a laser kerfing bit in accordance with the present invention.
Figure 7:
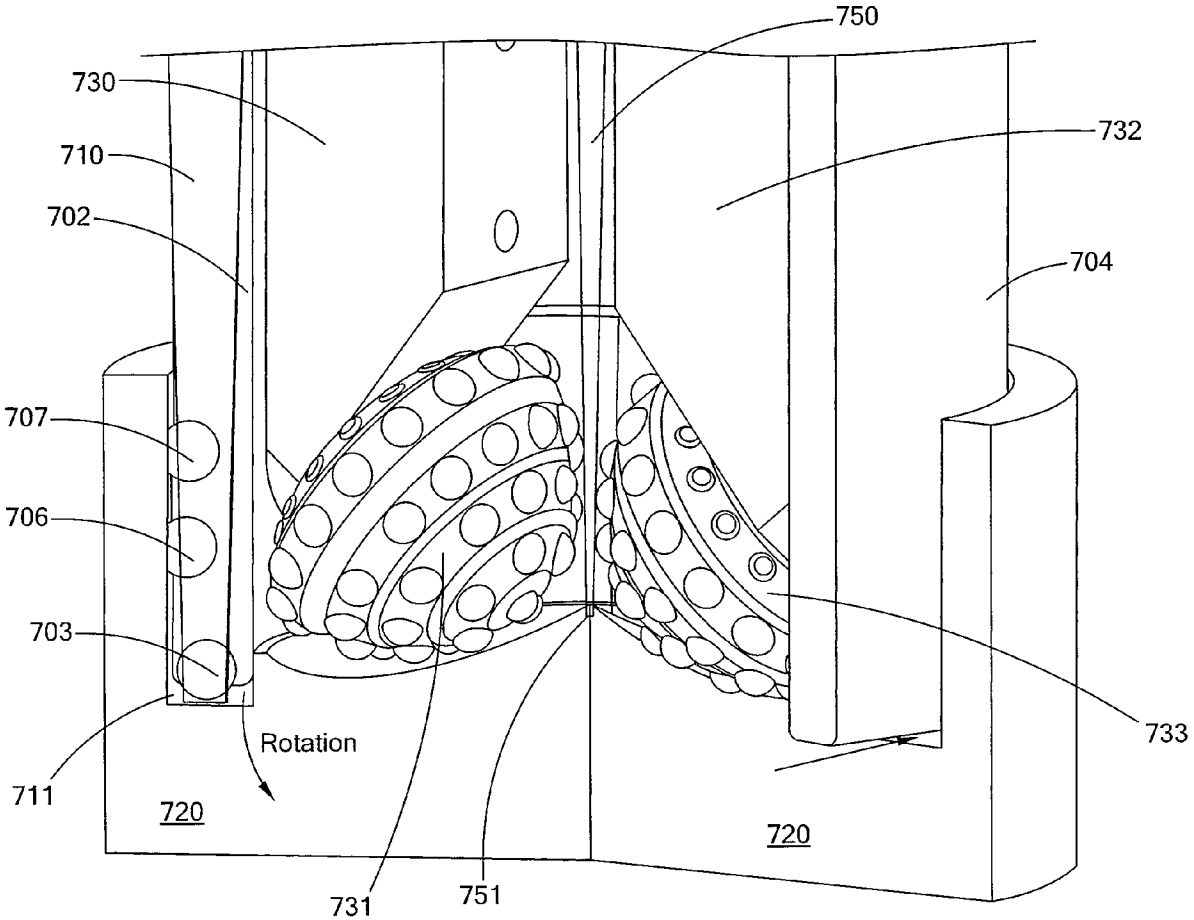
FIG. 7 is a perspective view of an embodiment of a portion of a lower bit section of a laser kerfing bit in accordance with the present invention.

The laser-mechanical bits of the embodiments of FIGS. 6 and 7 are preferably used in conjunction with laser beam delivery patterns, such as spots, rounded squares, shorter-broader linear shapes, and rounder ellipses. These patterns in general will not illuminate the entire bottom surface of the borehole as the bit is rotated.

Thus, in general and without being limited to any theory of rock mechanics or laser-rock interaction, the laser-mechanical bits of FIGS. 1-5 are configured so that the mechanical forces from the cutters or inserts are preferably provided directly to the rock or rock surface that was illuminated by the laser energy. In general, the laser-mechanical bits of FIGS. 6-7 are configured so that mechanical forces from the bit are preferably directly provided to a specific area of the rock that may or may not be directly illuminated by the laser.

In FIG. 6 there is provided an embodiment of a portion of a bottom section of a laser-mechanical bit for use in conjunction with a narrow laser beam, providing an illumination spot. The bit has a bit body and other structural components of a laser-mechanical bit as show and taught generally in this specification (which components are not shown in this figure). The bottom section of the bit has a leg 602 that has gauge cutter 603, and gauge reamers 604, 605. These structures are shown in relation to a schematic cutaway representation of the bottom of a borehole 620. The leg 602 and its respective cutter follow behind a laser beam 610, forming a laser spot 611, which is rotated around the gauge of the bottom of the borehole 620. Thus, the leg 602 follows behind the laser spot 611 and cutter 603 removes laser-affected rock. The bit bottom also has a leg 630 which support a roller cone 631. The roller cone provides mechanical force to the bottom region of the borehole that is bounded by path of the laser spot 611. The rock in this area would not be directly affected by the laser, as it was not illuminated by the laser, and is weakened or otherwise made more easily removed by the mechanical action of the roller cone. The laser beam paths and the laser beams should be close to, but preferably not touch the structures or the bits including the cutters. When using high power laser energy, and in particular laser energy greater than 5 kW, 10 kW, 20 kW, 40 kW, 80 kW and greater, if the beam path, and in particular the laser beam, contacts a leg, a cutter, or other bit component, it will melt or otherwise remove that section of the component that is in the beam path, and potentially damage the remaining sections of the bit.

In FIG. 7 there is provided an embodiment of a laser-mechanical bit for use in conjunction with a narrow laser beam, providing an illumination spot. The bit has a bit body and other structural components of a laser-mechanical bit as generally shown and taught herein (which components are not shown in this figure). The bottom section of the bit has legs 702, 704 that have gauge cutters, e.g., 703, and another gauge cutter not shown in the figure, and gauge reamers, e.g, 706, 707 and other gauge reamers not shown in the figure (the cutters for leg 704 are on the side of the leg facing into the page and thus are not seen). These structures are shown in relation to a schematic cutaway representation of the bottom of a borehole 720. The legs 702, 704, and their respective cutters follow behind a laser beam, e.g., 710, forming a laser spot 711, which is rotated around the gauge of the bottom of the borehole 720. Thus, the leg 702 follows behind the laser spot 711 and cutter 703 removes laser-affected rock. A laser beam and spot are similarly positioned and moved in front of leg 704, but are not seen in the view of FIG. 7. Additionally, a laser beam 750 provides a laser spot 751 in the center of the borehole.

The bit bottom also has a leg 730 which supports a roller cone 731 and leg 732 which support roller cone 733. The roller cones provide mechanical force to the bottom region of the borehole that is bounded by the path of the laser spots. The rock in this area would not be directly affected by the laser, as it was not illuminated by the laser, but may nevertheless be weakened, or otherwise made more easily removed by the mechanical action of the roller cone. The beam paths and the laser beams should be close to, but preferably not touch the structures or the bits including the cutters. When using high power laser energy, and in particular laser energy greater than 5 kW, 10 kW, 20 kW, 40 kW, 80 kW and greater, if the beam path, and in particular the laser beam, contacts a leg, a cutter, or other bit component, it will melt or otherwise remove that section of the component that is in the beam path, and potentially damage the remaining sections of the bit.

The configurations of the above roller cone and hybrid laser-mechanical bits provides a general description and teachings of the configurations for, and use of, various components to convey and utilize high power laser energy in conjunction with a mechanical drilling activities. The inventions herein are not limited to those specific exemplary embodiments and other arrangements of these and other components are contemplated herein and would not depart from the spirit of the inventions set forth in this specification.

The beam blades, beam path slots and beam paths of the present inventions may be used with other means for providing mechanical force to advance a borehole or to perform downhole operations. In these utilizations the laser energy should be directed and applied in a manner that: overcomes prior deficiencies with these other mechanical means; enhances the action of these other mechanical means; and combinations thereof. These other mechanical means would include apparatus found in other types of mechanical bits, such as, rotary shoe, drag-type, fishtail, adamantine, single and multi-toothed, cone, reaming cone, reaming, self-cleaning, disc, tricone, rolling cutter, crossroller, jet, core, impreg and hammer bits, and combinations and variations of the these.

The present laser-mechanical bits have an additional benefit by providing the potential advantage of increased bit life, which results in reducing the trip time while drilling. For example, during experiments performed with a six-inch laser-mechanical bit (along the line of the design in FIG. 1, e.g., having a flat bottom) drilling through hard rock formations (e.g., Basalt, Dolomite, and Sandstone), the cutter temperatures measured at the end of the test runs were recorded to be too low to cause thermal degradation of the PDC material. These low cutter temperatures obtainable with laser-mechanical drilling are a result of low WOB applied to advance the borehole in the hard rock. This low WOB reduces the friction on cutters while removing the rock and ensures longer cutter life. It is believed that the bit life is significantly lower for conventional bits than those achievable by the laser-mechanical bit drilling through very hard rock formations.

Bit life may be further enhanced and increased, by among other things, by applying an appropriate and predetermined amount of laser energy to the bottom and gauge of the borehole. By way of illustration, FIG. 9B provides a graph of possible stresses induced by a laser beam pattern on the bottom and gauge of a borehole. Thus, there is shown a stress model showing a cross section of half of the bottom and sides of a borehole 901. The borehole 901 extends radially out from the axis 961 (which would correspond to the laser-mechanical bit axis) along the bottom surface 903 to the gauge 905 and the side wall 907. In this model a von Mises stress of about $2\times10^4$ is created in area 911, a von Mises stress of about $1\times10^4$ is created in area 913, and essentially no stress is created in area 915. Thus, as shown in the model of FIG. 9B very little, if any stress is created toward the outer edges of the gauge. A laser beam pattern that provided stress along the lines seen in FIG. 9A was utilized, with the bit shown in FIG. 9A.

Figure 9A:
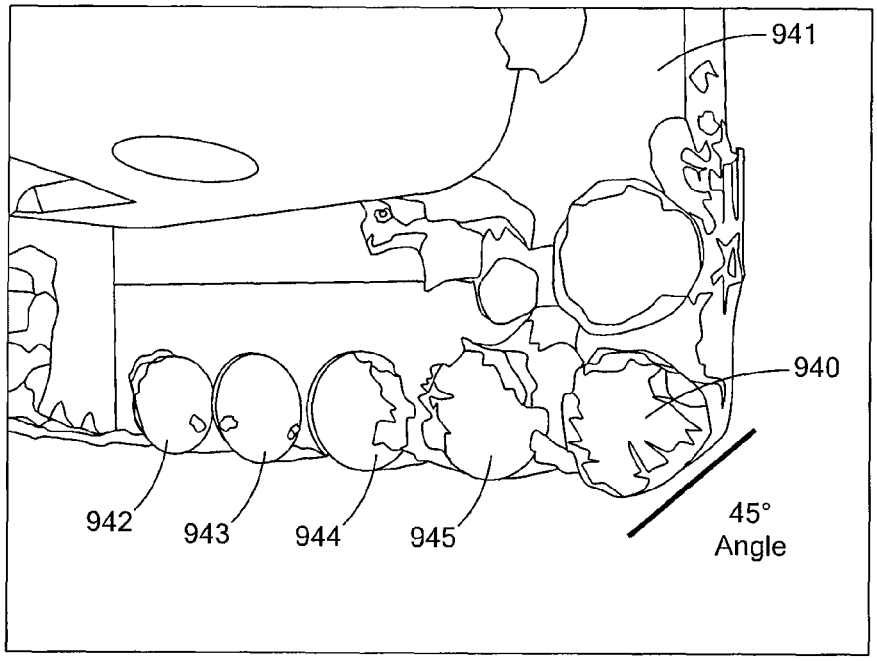
FIG. 9A is a prospective view of an embodiment of a blade and a cutter in accordance with the present invention.
Figure 9B:
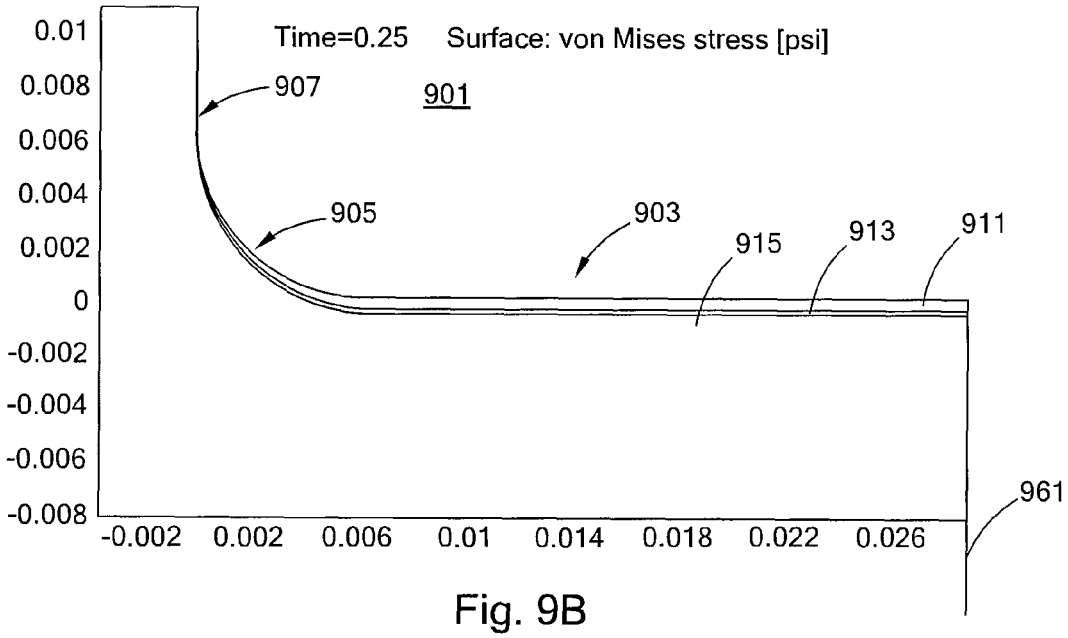
FIG. 9B is a stress analysis chart.

As provided in FIG. 9A the gauge cutter 940, on the blade 941, is worn at about a 45 degree angle, while the other cutters 942, 943, 944, 945 show little to no wear. This wear pattern provides an example of the effect on cutter life as a result of the laser induced stress and the resultant laser-affected rock. Laser-affected rock was seen and cut by cutters 942, 943, 944, 945 and resulted in essentially little to no wear; while the outer portion of gauge cutter 941, which cut or saw essentially no laser-affect rock, had considerably greater wear.

Figure 10:
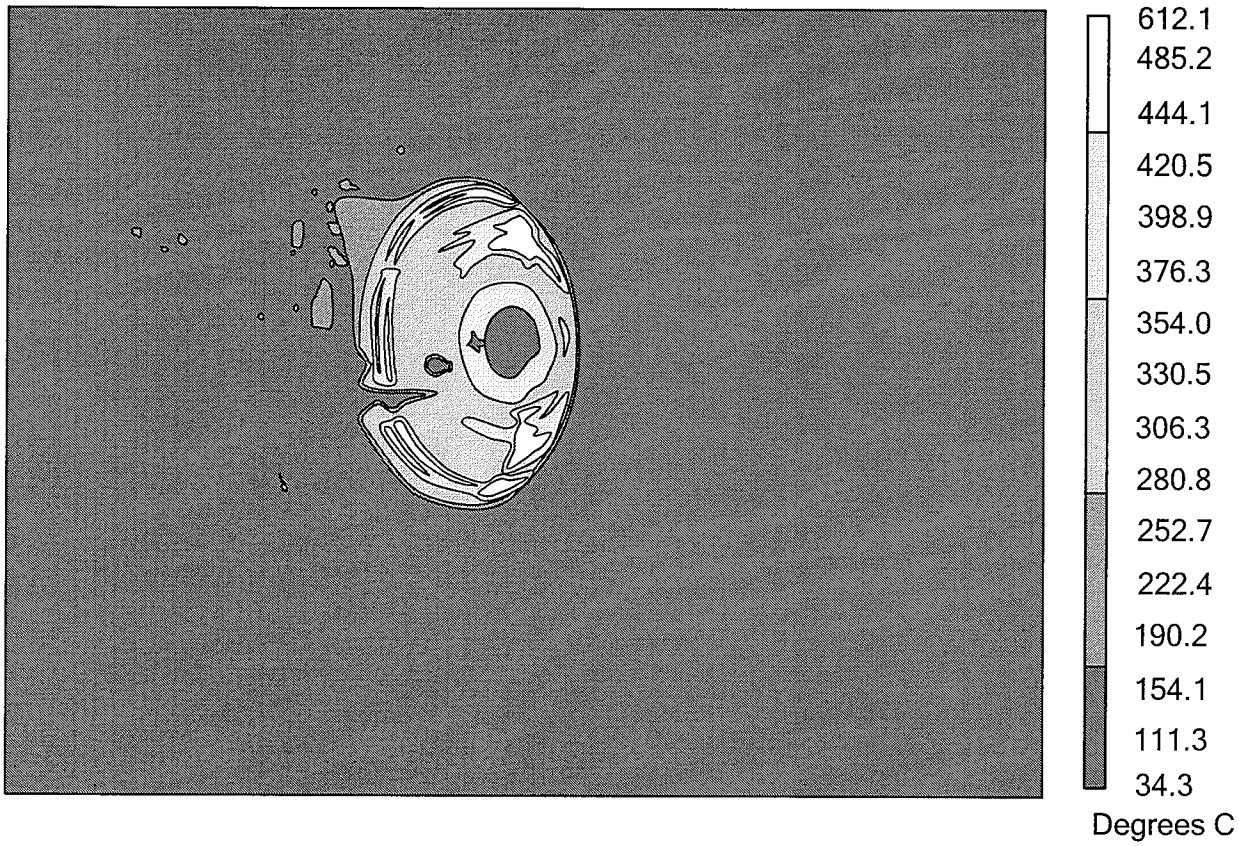
FIG. 10 is schematic of an infrared photo of a bottom of a borehole drilled with an embodiment of a laser-mechanical bit in accordance with the present invention.

Turning to FIG. 10 there is provided a schematic of a thermal image of the bottom of a borehole drilled with a laser-mechanical bit and laser-mechanical process of the present invention. The image was of basalt having a hardness of about 65 ksi. The laser-mechanical bit had fixed cutters of CBN. The drilling rate was about 30 ft/hr.

The use of the laser energy with the laser-mechanical bit, in a laser-mechanical drilling process has the ability to effectively cool the temperature of the fixed cutters, while drilling. In general, if the cutter's temperature reaches or exceeds about 600° C., the cutter material will thermally degrade and the cutter will fail. With the present laser-mechanical drilling process, for example, a borehole can be drilled in about 35 ksi rock, using about 15-20 kW of laser power, with a 6-inch diameter flat bottom fixed cutter laser-mechanical bit. Under these drilling conditions, boreholes can be advanced at a rate of about 10 ft/hr using about 100 lbs WOB. Additionally, under these drilling conditions and rates, the temperature of the fixed cutters is maintained in the range of about 180° C. When the laser is turned off, however, if the drilling rate is maintained, the temperature of the cutters almost instantaneously increases, and increases to greater than 600° C., resulting in the failure of the cutters. Thus, the use of the laser energy in the laser-mechanical drilling process has the result of cooling the cutters, or preventing the heating of the cutters, by hundreds of degrees Centigrade, and by at least about 400 degrees Centigrade. Further, the use of the laser-energy under these drilling conditions has the result of maintaining the temperature of the cutters below their thermal degradation temperature, e.g., below about 600° C.

The beam blades have a beam blade height, which is the length of the beam blades that extends below (from) the body of the bit. For example, the height of the beam blades may be about ½ inch to about 3 inches, preferable from about ¾ inches to about 2 inches, from about ¾ inch to about 1½ inches and more preferably about 1 inch. The height of the beam blades may be varied based upon the type of cutting that the drilling process is producing. Thus, for a process that produces larger chunks or pieces of material as cuttings, higher beam blade heights may be employed; and for process that produce finer, e.g., almost dust like, cuttings, shorter beam blade heights may be used.

Figure 11A:
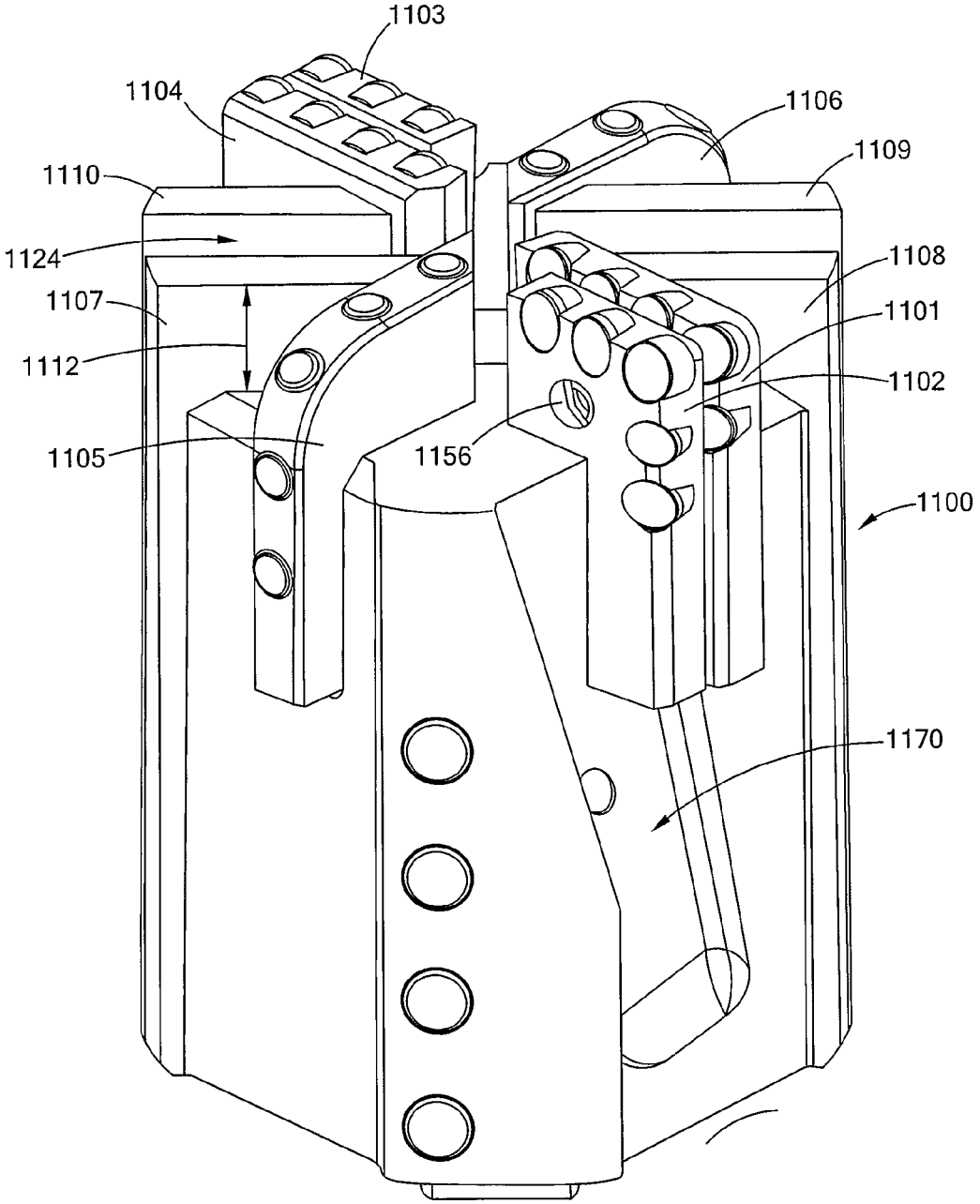
FIG. 11A is a perspective view of an embodiment of a laser-mechanical bit in accordance with the present invention.
Figure 11B:
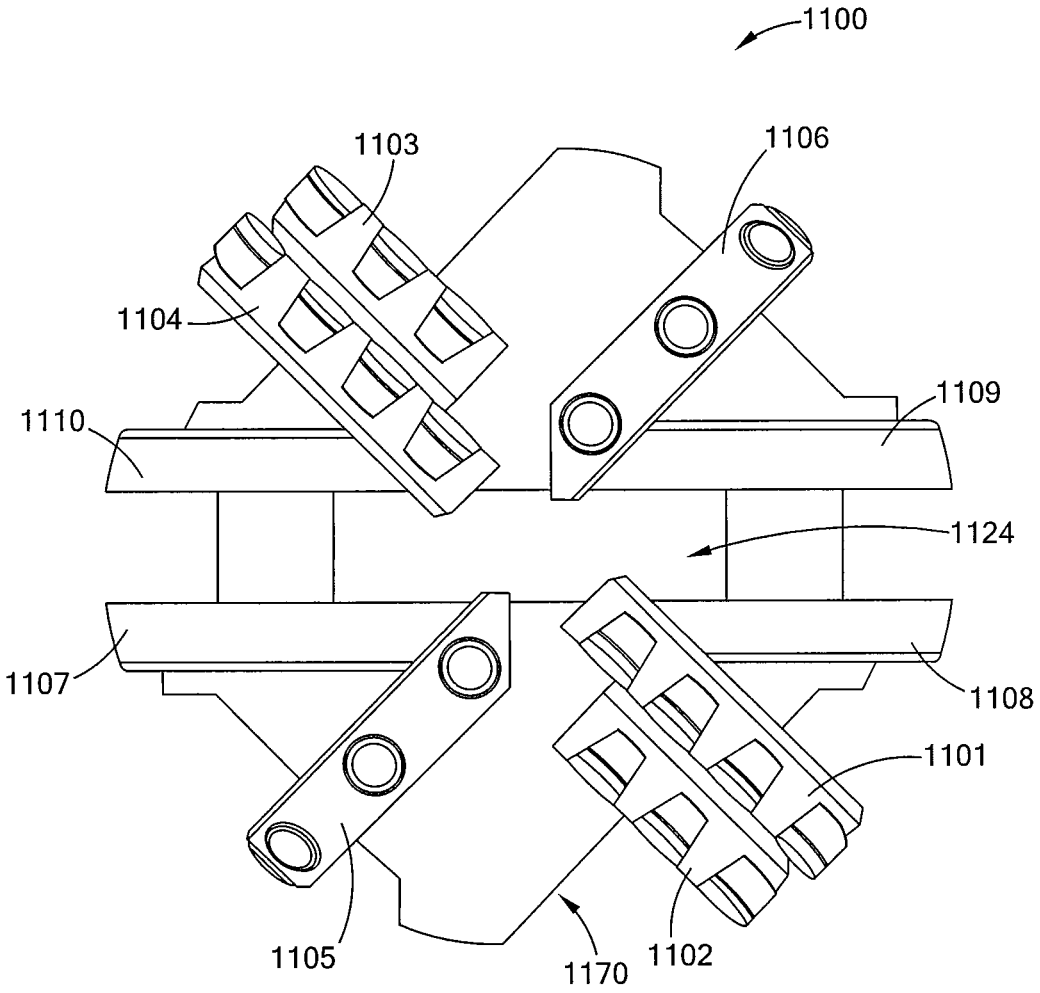
FIG. 11B is a bottom view of the bit of FIG. 11A.

Turning to FIGS. 11A and 11B there is provided an embodiment of a fixed cutter laser-mechanical bit. Thus, the bit 1100 has four cutter blades 1101, 1102,1103, 1104, two blades that control depth of cut, 1105, 1106 (and provide additional stability), and four beam blades 1107, 1108, 1109, 1110, which help to define a beam path channel 1124. The beam blades have a beam blade height indicated by arrow 1112, which in the case of this embodiment is the same as the height of the cutter blades, and the depth control blades. Generally, it is preferable for the beam blades to have a height that is essentially the same as the cutter blades heights, although it may be greater or smaller. The bit 1100 has junk slots, e.g., 1170 and vents, e.g., 1156.

In general, the components of a laser-mechanical bit may be made from materials that are know to those of skill in the art for such applications or components, or that are latter developed for such applications. For example, the bit body may be made from steel, preferably a high-strength, weldable steel, such as SAE 9310, or cemented carbide matrix material. The blades may be made from similar types of material. The blades and the bit body may be made, for example by milling, from a single piece of metal, or they may be separately made and affixed together. The cutters may be made from for example, materials such as polycrystalline diamond compact ("PDC"), grit hotpressed inserts ("GHI"), and other materials known to the art or later developed by the art. Cutters are commercially available from for example US Synthetic, MegaDiamond, and Element 6. The roller cone arms may be made from steel, such as SAE 9310. Like the blades the arms and the bit body may be made from a single piece of metal, or they may be made from separate pieces of metal and affixed together. Roller cone inserts, for example, may be made from sintered tungsten carbide (TCI) or the roller cones may be made with MTs. Roller cones, roller cone inserts, and roller cones and leg assemblies, may be obtained commercially from Varel International, while TCI may be obtained from for example Kennametal or ATI Firth Sterling. It is preferred that the inner surface of the beam path channel be made of material that does not absorb the laser energy, and thus, it is preferable that such surfaces be reflective or polished surfaces. It is also preferred that any surfaces of the bit that may be exposed to reflected laser energy, reflections, also be non-absorptive, minimally absorptive, and preferably be polished or made reflective of the laser beam.

The use of high power laser energy in advancing boreholes with laser-mechanical bit in a laser drilling system, such as that disclosed in for example, U.S. Patent Application publication number 2010/0044103, has the capability to substantially and dramatically reduce WOB, across many different rock types, without reducing the rate of penetration ("ROP"). Such laser-mechanical drilling processes, using the laser-mechanical bits of the present inventions, can provide rapid and sustained penetration of ultra-hard rock formations that are economically prohibitive, if not unviable, to drill with a mechanical drill bit alone. The following examples illustrate, in a non-limiting fashion, some of the many potential benefits and advantages of using the laser-mechanical bits of the present invention in a laser-mechanical process to advance a borehole in hard and ultra hard rock formations. Preferably, when using a PDC fixed cutter laser-mechanical bit, the process should be adjusted to avoid melting the rock with the laser.

The examples to follow are not intended to and do not limit the scope of protection to be afforded the inventions provided in this specification. Rather, they are illustrative examples, based upon experimental and modeled data, to show the drastic reduction in WOB that may be achieved with the use of a laser-mechanical fixed cutter bit. Thus, other drilling conditions and bit diameters and configurations are contemplated, including for example bits having diameters of 3⅞, 4¾, 6¼, 6½, 6¾, 7⅞, 8½, 8¾, 9⅞, 12¼, 14¾, 16, 26, 28, and 36 inches. Moreover, it is believed that at these very low WOBs, a fixed cutter mechanical bit, without the aid of the laser beam, would be incapable of advancing a borehole in rock having a hardness of 20 ksi or greater. Alternatively, if the WOB was increased for a fixed cutter mechanical bit to the point were the bore hole was advanced at rates achievable by the laser-mechanical PDC bit, the PDC cutters in the fixed cutter mechanical bit would be quickly destroyed, e.g., burned up, by the 20 ksi or greater rock. Thus, it is believed that these examples set forth never before obtained, or prior to the present inventions believed to be obtainable, drilling parameters.

Example 1

20 (ksi) Granite Formation

A laser-mechanical fixed cutter bit of the type of the embodiment shown in FIG. 3, having a 6-inch diameter, a beam path angle of about 135 degrees, and PDC cutters, advances a borehole in a granite formation having an average hardness of about 20 (ksi) (thousands pounds per square inch). The laser-mechanical bit is rotated at a rate of about 270 rpm. The WOB is less than about 500 lbs. The laser beam is in a pattern of the type shown in FIG. 2 and is about 50 kW at the face of the rock. The ROP is about 13 ft/hr.

Example 2

20 (ksi) Granite Formation

A laser-mechanical fixed cutter bit of the type of the embodiment shown in FIG. 3, having a 3¼-inch diameter, a beam path angle of about 90 degrees, and PDC cutters advances a borehole in a granite formation having an average hardness of about 20 (ksi). The laser-mechanical bit is rotated at a rate of about 500 rpm. The WOB is less than about 200 lbs. The laser beam is in a pattern of the type shown in FIG. 2 and is about 30 kW at the face of the rock. The ROP is about 23 ft/hr.

Example 3

20 (ksi) Granite Formation

A laser-mechanical fixed cutter bit of the type of the embodiment shown in FIG. 3, having an 8½-inch diameter, having a beam path angle of about 139 degrees, and PDC cutters advances a borehole in a granite formation having an average hardness of about 20 (ksi). The laser-mechanical bit is rotated at a rate of about 650 rpm. The WOB is about less than about 1500 lbs. The laser beam is in a pattern of the type shown in FIG. 2 and is about 80 kW at the face of the rock. The ROP is about 14 ft/hr.

Example 4

35 (ksi) Sandstone Formation

A laser-mechanical fixed cutter bit of the type of the embodiment shown in FIG. 3, having a 6-inch diameter, having a beam-path angle of about 135 degrees, and PDC cutters advances a borehole in a sandstone formation having an average hardness of about 35 (ksi) (kilograms per square inch). The laser-mechanical bit is rotated at a rate of about 270 rpm. The WOB is less than about 500 lbs. The laser beam is in a pattern of the type shown in FIG. 3 and is about 65 kW at the face of the rock. The ROP is about 20 ft/hr.

Example 5

35 (ksi) Sandstone Formation

A laser-mechanical fixed cutter bit of the type of the embodiment shown in FIG. 3, having a 3¼-inch diameter, having a beam-path angle of about 90 degrees, and PDC cutters advances a borehole in a sandstone formation having an average hardness of about 35 (ksi). The laser-mechanical bit is rotated at a rate of about 650 rpm. The WOB is less than about 500 lbs. The laser beam is in a pattern of the type shown in FIG. 2 and is about 40 kW at the face of the rock. The ROP is about 38 ft/hr.

Example 6

35 (ksi) Sandstone Formation

A laser-mechanical fixed cutter bit of the type of the embodiment shown in FIG. 3, having an 8½-inch diameter, and having a beam-path angle of about 139 degrees, advances a borehole in a granite formation having an average hardness of about 35 (ksi). The laser-mechanical bit is rotated at a rate of about 550 rpm. The WOB is about less than 1000 lbs. The laser beam is in a pattern of the type shown in FIG. 2 and is about 80 kW at the face of the rock. The ROP is about 14 ft/hr.

Example 7

40 (ksi) Basalt Formation

A laser-mechanical fixed cutter bit of the type of the embodiment shown in FIG. 3, having a 6-inch diameter, a beam path angle of about 135 degrees, and PDC cutters, advances a borehole in a basalt formation having an average hardness of about 40 (ksi). The laser-mechanical bit is rotated at a rate of about 1200 rpm. The WOB is less than about 800 lbs. The laser beam is in a pattern of the type shown in FIG. 2 and is about 60 kW at the face of the rock. The ROP is about 16 ft/hr.

Example 8

40 (ksi) Basalt Formation

A laser-mechanical fixed cutter bit of the type of the embodiment shown in FIG. 3, having a 3¼-inch diameter, a beam path angle of about 90 degrees, and PDC cutters advances a borehole in a basalt formation having an average hardness of about 40 (ksi). The laser-mechanical bit is rotated at a rate of about 1200 rpm. The WOB is less than about 500 lbs. The laser beam is in a pattern of the type shown in FIG. 2 and is about 25 kW at the face of the rock. The ROP is about 21 ft/hr.

Example 9

40 (ksi) Basalt Formation

A laser-mechanical fixed cutter bit of the type of the embodiment shown in FIG. 3, having an 8½-inch diameter, having a beam-path angle of about 139 degrees, and PDC cutters advances a borehole in a granite formation having an average hardness of about 40 (ksi). The laser-mechanical bit is rotated at a rate of about 600 rpm. The WOB is about less than about 1500 lbs. The laser beam is in a pattern of the type shown in FIG. 2 and is about 80 kW at the face of the rock. The ROP is about 11 ft/hr.

Figure 12:
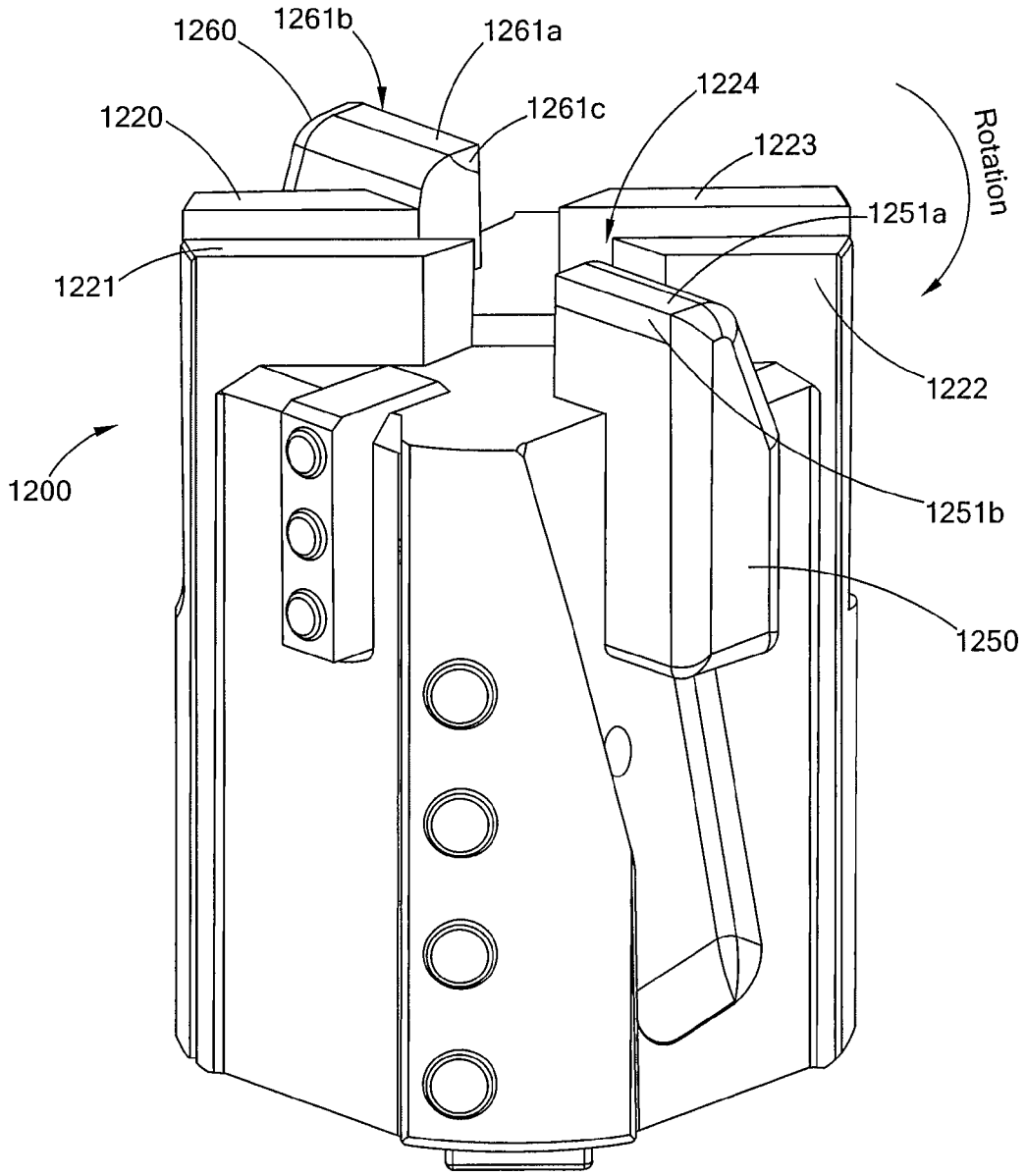
FIG. 12 is a perspective view on an embodiment of a scraper laser-mechanical bit in accordance with the present invention.

Turning to FIG. 12 there is provided a prospective view of a scraper type laser mechanical bit. Thus, the bit 1200 has a beam path channel 1224, and beam blades 1220, 1221, 1222, 1223. The bit 1200 has a first scraper 1250, which has hard faced surfaces 1251*a*, 1251*b*, and an inner hard faced surface (not seen in the view of the drawing). Hard face surfaces 1251*a* and 1251*b* form a sharp leading edge that contacts the laser affected borehole material. The hard face material may be tungsten carbide that is hard faced onto the scraper 1250, harden steal, or other such materials. The bit 1200 has a second scraper 1260, which has hard faced surfaces 1261*a*, 1261*b*, and 1261*c*. The hard face surfaces 1261*a* and 1261*b* form a sharp leading edge that contacts the laser affected borehole material. The hard face material may be tungsten carbide that is hard faced onto the scraper 1260, harden steal, or other such materials. The bit has a beam path angle of 135 degrees.

Figure 13:
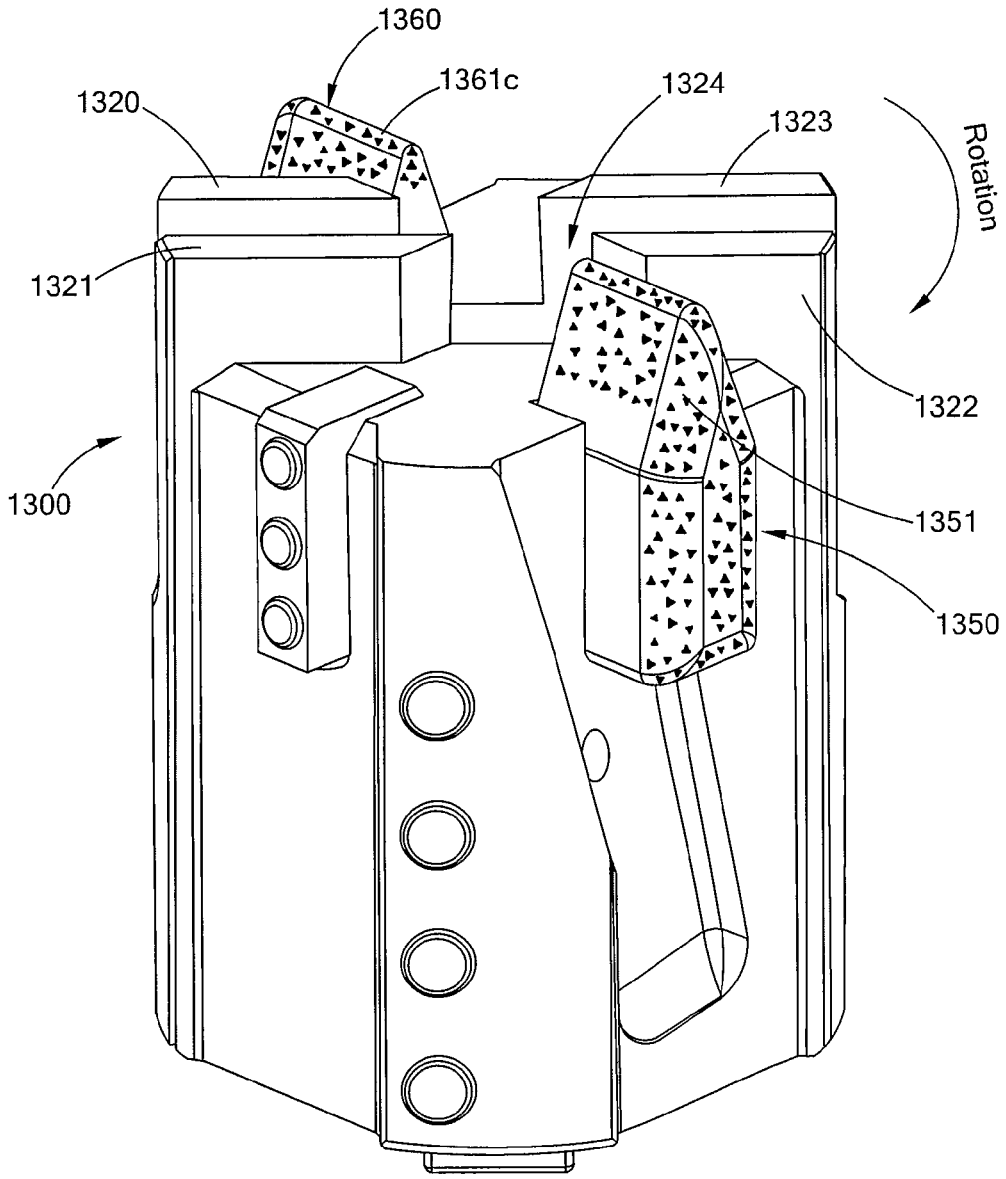
FIG. 13 is a perspective view of an embodiment of a laser-mechanical bit in accordance with the present invention.

Turning to FIG. 13 there is provided a prospective view of a scraper type laser mechanical bit. Thus, the bit 1300 has a beam path channel 1324, and beam blades 1320, 1321, 1322, 1323. The bit 1300 has a first scraper 1350, which has impregnated diamond grits, or similar hardened cutting impregnations, e.g., 1351. The bit 1300 has a second scraper 1360, which has impregnated diamond grits, or similar hardened cutting impregnations, e.g., 1361. The bit has a beam path angle of 135 degrees.

Figure 14A:
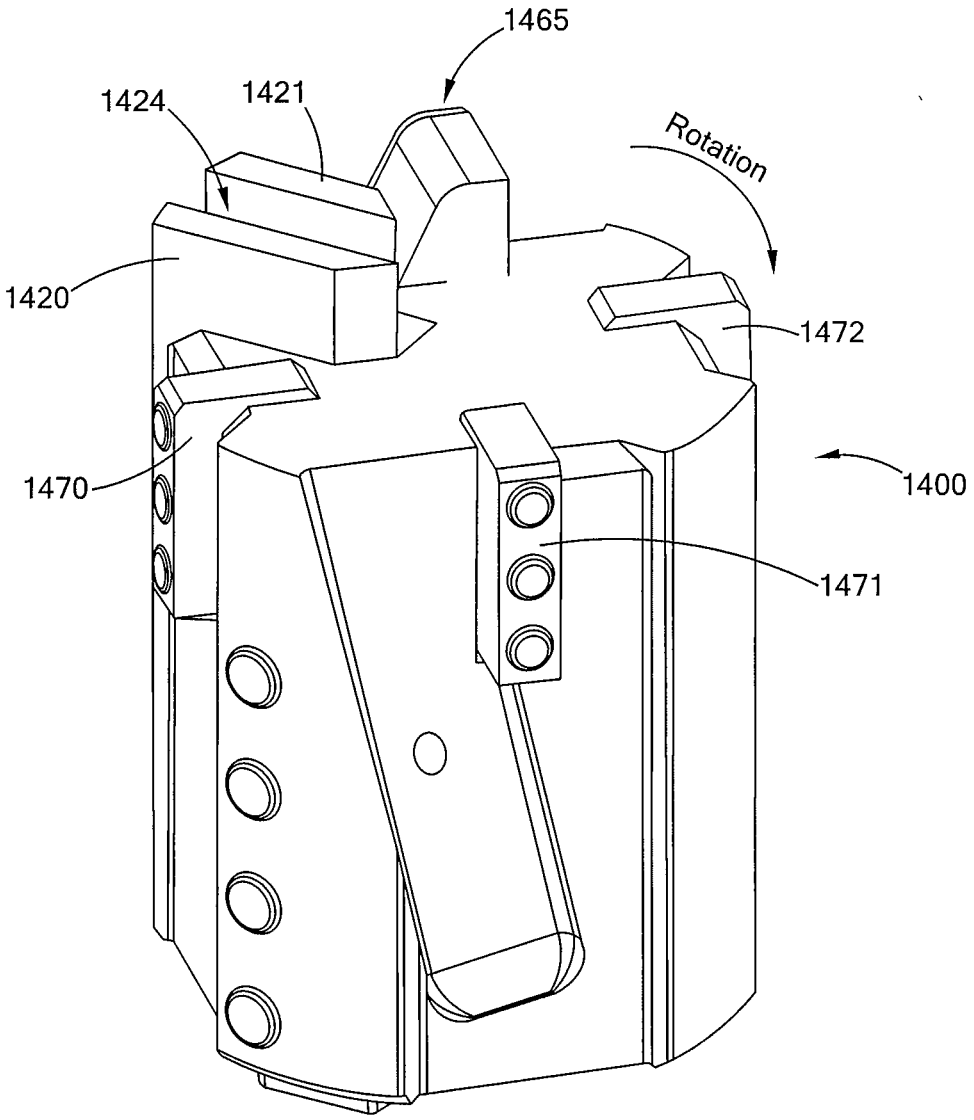
FIG. 14A is a perspective view of an embodiment of a laser-mechanical bit in accordance with the present invention.
Figure 14B:
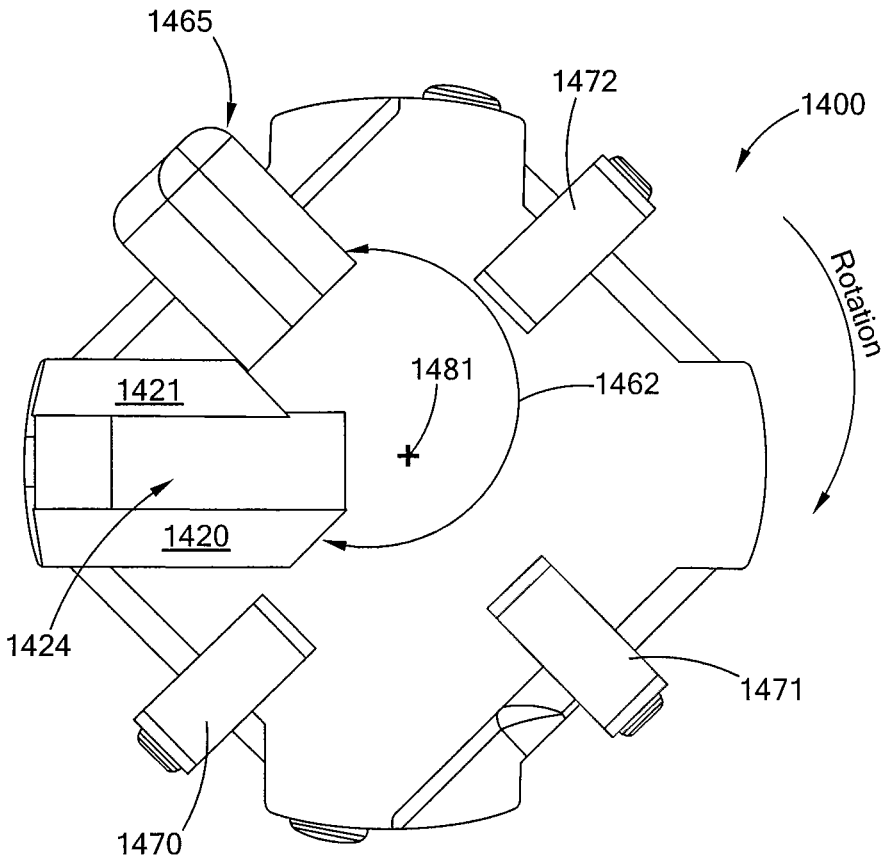
FIG. 14B is a bottom view of the embodiment of FIG. 14B.

Turning to FIGS. 14A and 14B there is provided a perspective view and bottom view, respectively of an ultra-high power laser-mechanical bit, that may preferably be utilized with laser beam powers of greater than about 50 kW, greater than about 75 kW and greater than about 100 kW (although is may also be employed with lower laser powers). The bit 1400 has a beam path channel 1424 and beam blades

1420, 1421. The bit has a mechanical removal device 1465, e.g., a cutter blade and cutters, a scraper, etc. The bit 1400 has 3 gauge blades 1470, 1471, 1472 for support gauge pads to provide stability for the bit during drilling. The bit has a beam path angle shown by arrow 1462, that may be greater than about 180 degrees, greater than about 270 degrees, greater than about 300 degrees, and greater than about 315 degrees. The larger beam path angle, may provide benefits, for example, in processes where the higher laser powers melt the borehole and then it solidifies or practically solidifies (e.g., the laser affected material), before the mechanical removal device contacts it. The bit of the embodiment of FIG. 14 would be a flat bottom bit type. The beam path channel 1424 extends about partway across the bottom of the bit to about the central axis 1481. The beam path channel may extend up to and end at, or include the central axis.

The laser mechanical bits and methods of the present inventions may be utilized with a laser drilling system having a single high power laser, or a system having two or three high power lasers, or more. The high power laser beam may have 10 kW, 20 kW, 40 kW, 80 kW or more power; and have a wavelength in the 800 nm to 1600 nm range. High power solid-state lasers, specifically semiconductor lasers and fiber lasers are preferred, because of their short start up time and essentially instant-on capabilities. The high power lasers for example may be fiber lasers or semiconductor lasers having 10 kW, 20 kW, 50 kW or more power and, which emit laser beams with wavelengths from about 1083 to about 2100 nm, for example about the 1550 nm (nanometer) ranges, or about 1070 nm ranges, or about the 1083 nm ranges or about the 1900 nm ranges (wavelengths in the range of 1900 nm may be provided by Thulium lasers). Examples of preferred lasers, and in particular solid-state lasers, such as fibers lasers, are disclosed and taught in the following U.S. Patent Application Publications 2010/0044106, 2010/0044105, 2010/0044103, 2010/0215326 and 2012/0020631, the entire disclosure of each of which are incorporated herein by reference. By way of example, and based upon the forgoing patent applications, there is contemplated the use of a 10 kW laser, the use of a 20 kW, the use of a 40 kW laser, as a laser source to provide a laser beam having a power of from about 5 kW to about 40 kW, greater than about 8 kW, greater than about 18 kW, and greater than about 38 kW at the work location, or location where the laser processing or laser activities, are to take place. There is also contemplated, for example, the use of more than one, and for example, 4, 5, or 6, 20 kW lasers as a laser source to provide a laser beam having greater than about 40 kW, greater than about 60 kW, greater than about 70 kW, greater than about 80 kW, greater than about 90 kW and greater than about 100 kW. One laser may also be envisioned to provide these higher laser powers.

In addition to the forgoing examples and embodiments, the implementation of a beam path channel, a beam path and beam blades and the use of high power laser energy, in down hole tools may also be utilized in holes openers, reamers, whipstocks, perforators and other types of boring tools. The various embodiments of the laser-mechanic bits set forth in this specification may be used with the various high power laser systems, presently know or that may be developed in the future, or with existing non-high power laser systems, which may be modified in-part based on the teachings of this specification, to create a laser system. The various embodiments of the laser-mechanic bits set forth in this specification may also be used with known laser-drilling down hole rotational sources, other such sources of rotation that may be developed in the future, or with existing non-high power laser rotational sources, which may be modified in-part based on the teachings of this specification to provide for rotation of the laser-mechanical bit. Further the various configurations, components, and associated teachings of laser-mechanical bits are applicable to each other and as such components and configurations of one embodiment may be employed with another embodiment, and combinations and variations of these, as well as, future structures and systems, and modifications to existing structures and systems based in-part upon the teachings of this specification. Thus, for example, the structures, bits, and configurations provided in the various Figures and Examples of this specification may be used with each other and the scope of protection afforded the present inventions should not be limited to a particular embodiment, configuration or arrangement that is set forth in a particular example or a particular embodiment in a particular Figure.

Many other uses for the present inventions may be developed or released and thus the scope of the present inventions is not limited to the foregoing examples of uses and applications. Thus, for example, in addition to the forgoing examples and embodiments, the implementation of a beam path channel, a beam path, flat bottom laser-mechanical bit, specific laser beam cutter blade angles, and/or beam blades in conjunction with the use of high power laser energy, in down hole tools, may also be utilized in holes openers, reamers, perforators, whipstocks, and other types of boring tools.

The present inventions may be embodied in other forms than those specifically disclosed herein without departing from their spirit or essential characteristics. The described embodiments and examples are to be considered in all respects only as illustrative and not restrictive.

What is claimed:

1. A flat bottom fixed cutter laser-mechanical bit comprising:

a. a bottom section having a central axis, a width and a flat bottom end, wherein the bottom end is configured to engage a borehole surface;

b. a beam path channel defined, in part, by a plurality of beam blades, wherein the beam path channel forming a shape, wherein the shape includes at least one member of a group comprising: a rectangle and an ellipse extends across the width of the flat bottom end of the bottom section and through the central axis;

c. a plurality of cutter blades; and, d. the cutter blades and the beam blades each having a lower end;

e. wherein, the lower ends are configured to be essentially coplanar, thereby defining the flat bottom end;

f. whereby, the bit is capable of laser-mechanical drilling an essentially flat bottom borehole; and, g. a beam blade having a passage in fluid communication with a junk slot, the junk slot being located on the exterior surface of the bit.

2. The laser-mechanical bit of claim 1, wherein the beam blades comprise a first and second pair of blades.

3. The laser-mechanical bit of claim 1, comprising a means for limiting the depth of cut.

4. The laser-mechanical bit of claim 3, wherein the means for limiting the depth of cut, the beam blades and the cutter blades have substantially the same height.

5. The laser-mechanical bit of claim 3, the means for limiting the depth of cut has a greater height than the beam blades and the cutter blades.

6. The laser-mechanical bit of claim 5, wherein the beam path channel comprises a beam path slot in a side surface of the bottom section.

7. The laser-mechanical bit of claim 3, wherein the bottom section width is at least about 4 inches; and the beam blades have a height of at least about 1;4 inch and a width of at least about 1% inches.

8. The laser-mechanical bit of claim 7, wherein the beam path channel comprises a beam path slot in a side surface of the bottom section.

9. The laser-mechanical bit of claim 1, wherein the bottom section width is at least about 6 inches; and the beam blades have a height of at least about 1h inch and a width of at least about 2% inches.

10. The laser-mechanical bit of claim 9, having a beam path angle of greater than 90 degrees.

11. The laser-mechanical bit of claim 9, having a beam path angle of from about 90 degrees to about 135 degrees.

12. The laser-mechanical bit of claim 9, having a beam path angle of about 90 degrees.

13. The laser-mechanical bit of claim 9, having a beam path angle of about 135 degrees.

14. The laser-mechanical bit of claim 9, having a beam path angle of less than about 150 degrees.

15. The laser-mechanical bit of claim 1, wherein the beam path channel comprises a beam path slot in a side surface of the bottom section.

16. The laser-mechanical bit of claim 15, having a beam path angle of greater than 90 degrees.

17. The laser-mechanical bit of claim 15, having a beam path angle of from about 90 degrees to about 135 degrees.

18. The laser-mechanical bit of claim 15, having a beam path angle of less than about 150 degrees.

19. The laser-mechanical bit of claim 1, comprising a body section associated with the bottom section; and a beam path slot in a side surface of the bottom section and extending into a side surface of the body section.

20. The laser-mechanical bit of claim 1, wherein the beam path channel comprises a beam path slot in a side surface of the bottom section.

21. The laser-mechanical bit of claim 1, wherein the beam path channel comprises a beam path slot in a side surface of the bottom section.

22. The laser-mechanical bit of claim 1, having a beam path angle of greater than about 90 degrees.

23. The laser-mechanical bit of claim 1, having a beam path angle of from about 90 degrees to about 135 degrees.

24. The laser-mechanical bit of claim 1, having a beam path angle of about 90 degrees.

25. The laser-mechanical bit of claim 1, having a beam path angle of about 135 degrees.

26. The laser-mechanical bit of claim 1, having a beam path angle of less than about 150 degrees.

27. The laser-mechanical bit of claim 1, having a beam path angle of from about 90 degrees to about 135 degrees.

28. The laser-mechanical bit of claim 1, having a beam path angle of less than about 150 degrees.

29. A laser-mechanical bit comprising:

a. a bit body section and bottom section;

b. the bottom section comprising two beam blades, the bottom section defining a 1) portion of a beam path channel and 2) a portion of a beam path slot forming a shape, wherein the shape formed by the beam blades includes at least one member of a group comprising: a rectangle and an ellipse, and wherein the beam path slot is in fluid communication with the beam blades and the beam path channel;

c. a means for boring with mechanical force; and, d. at least one beam blade has a passage in fluid communication with a junk slot, the junk slot being located along the exterior surface of the bit; and e. wherein the beam path channel extends across the width of the bottom section; and f. wherein the means for boring comprises a pair of blades each comprising a cutter; the beam blade comprises an inner surface and an outer surface, wherein the inner surface defines an inner plane and outer surface defines an outer plane; wherein the inner plane is adjacent a laser beam path and wherein the outer plane is removed from the laser beam path; and at least a portion of the cutter is positioned within the inner plane.

30. The bit of claim 29, wherein the beam path slot extends into the bit body section.

31. The bit of claim 29, wherein the beam blades extend along an outer side of the bottom section and along at least a portion of an outer side of the bit body section.

32. The bit of claim 29, comprising four beam blades.

33. The bit of claim 29, wherein the means for boring's cutters are juxtaposed.

34. A laser-mechanical drilling bit for advancing a borehole in the earth, the bit comprising:

a. a body characterized by a bottom end configured for engagement with a borehole surface;

b. a beam path channel containing a laser beam path; wherein the beam path channel divides the bottom end into a first and a second section;

c. the first bottom end section having a beam blade, a cutter blade, and a means for limiting the depth of cut; and, d. the second bottom end section having a beam blade, a cutter blade, and a means for limiting the depth of cut, e. the bottom section comprising two beam blades, the bottom section defining both 1) a portion of a beam path channel and 2) a portion of a beam path slot, forming a shape, wherein the shape formed by the beam blades includes at least one member of a group comprising: a rectangle and an ellipse, and wherein the beam path slot is in fluid communication with the beam blades and the beam path channel;

f. a means for boring with mechanical force; and, g. a beam blade has a passage in fluid communication with a junk slot, the junk slot being located along the exterior surface of the bit.

35. The bit of claim 34, wherein the means for limiting the depth of cut comprises a blade having depth limiters along a bottom end of the blade.

36. The bit of claim 34, wherein the means for limiting the depth of cut comprises depth limiters positioned on a beam blade.

37. The bit of claim 34, wherein the first bottom end section has a beam path angle of from about 90 degrees to about 135 degrees.

38. The bit of claim 34, wherein the first bottom end section and the second bottom end section have beam path angles from about 90 degrees to about 135 degrees.

39. The bit of claim 38, wherein the first bottom end section beam path angle is substantially the same as the second bottom end section beam path angle.

40. The bit of claim 34, having a beam path angle of less than about 150 degrees.

41. The bit of claim 34, the beam blade passage in fluid communication with a helical shaped junk slot.

42. The bit of claim 41, wherein the junk slot is defined at least in party by the beam blade.

43. The bit of claim 34, wherein the junk slot is defined at least in party by the beam blade.

44. A laser-mechanical drilling bit for advancing a borehole in the earth, the bit comprising:

a. a body characterized by a bottom end configured for engagement with a borehole surface;

b. a beam path channel; wherein the beam path channel divides the bottom end into a first and a second section;

c. a beam path slot having an angled end, and forming a shape, wherein the shape includes at least one member of a group comprising: a rectangle and an ellipse, wherein the beam path slot is in optical and fluid communication with the beam path channel and a junk slot, the junk slot being located along the exterior surface of the bit;

d. the first bottom end section having a beam blade, a plurality of cutter blades, and a means for limiting the depth of cut; and, e. the second bottom end section having a beam blade, a plurality of cutter blades, and a means for limiting the depth of cut.

45. The bit of claim 44, wherein the first bottom end section has a beam path angle of from about 90 degrees to about 135 degrees.

46. The bit of claim 44, wherein the first bottom end section and the second bottom end section have beam path angles from about 90 degrees to about 135 degrees.

47. The bit of claim 46, wherein the first bottom end section beam path angle is substantially the same as the second bottom end section beam path angle.

48. A laser-mechanical drilling bit for advancing a borehole in the earth, the bit comprising:

a. a body characterized by a bottom end and a central axis of rotation, wherein the bottom end is configured for engagement with a borehole surface;

b. a beam path contained within a channel; wherein the beam path, wherein the beam path is in fluid communication with a junk slot, the junk slot being located along the exterior surface of the bit, and divides the bottom end into a first and a second section;

c. the first bottom end section having a beam blade, a cutter blade, and a means for limiting the depth of cut;

d. the second bottom end section having a beam blade, a cutter blade, and a means for limiting the depth of cut;

e. the first bottom end section cutter blade comprising a plurality of cutters, and the second bottom end section cutter blade comprising a plurality of cutters; and, f. the cutters positioned with respect to the central axis of rotation, whereby during rotation and deliver of a laser beam through the beam path to a surface of the borehole, each cutter will contact a laser-affected surface.

49. The bit of claim 48, comprising a plurality of first bottom end section cutter blades and a plurality of second bottom end section cutter blades.

50. The bit of claim 49, comprising at least 10 cutters.

51. The bit of claim 49, comprising at least 12 cutters.

52. The bit of claim 48, comprising at least 6 cutters.

* * * * *